US011654339B2

(12) United States Patent
Clarke et al.

(10) Patent No.: US 11,654,339 B2
(45) Date of Patent: May 23, 2023

(54) MULTI-MATERIAL IRON GOLF CLUB HEAD

(71) Applicant: KARSTEN MANUFACTURING CORPORATION, Phoenix, AZ (US)

(72) Inventors: Jacob T. Clarke, Apex, NC (US); Cory S. Bacon, Cave Creek, AZ (US); Dave Wu, Pingtung (TW); Martin R. Jertson, Phoenix, AZ (US); Travis D. Milleman, Portland, OR (US); Ryan M. Stokke, Anthem, AZ (US)

(73) Assignee: KARSTEN MANUFACTURING CORPORATION, Phoenix, AZ (US)

( * ) Notice: Subject to any disclaimer, the term of this patent is extended or adjusted under 35 U.S.C. 154(b) by 37 days.

(21) Appl. No.: 17/305,712

(22) Filed: Jul. 13, 2021

(65) Prior Publication Data

US 2021/0339094 A1 Nov. 4, 2021

Related U.S. Application Data

(63) Continuation of application No. 16/286,462, filed on Feb. 26, 2019, now Pat. No. 11,058,931.
(Continued)

(51) Int. Cl.
*A63B 53/04* (2015.01)

(52) U.S. Cl.
CPC ..... *A63B 53/0475* (2013.01); *A63B 53/0412* (2020.08); *A63B 53/0445* (2020.08); *A63B 2209/00* (2013.01)

(58) Field of Classification Search
CPC ..... A63B 53/047; A63B 53/0475; A63B 53/0479; A63B 53/0483
See application file for complete search history.

(56) References Cited

U.S. PATENT DOCUMENTS 4,874,171 A 10/1989 Ezaki et al.
4,883,274 A 11/1989 Hsien
(Continued)

FOREIGN PATENT DOCUMENTS

JP H10-277186 10/1998
JP 2003-052867 2/2003
(Continued)

OTHER PUBLICATIONS

International Search Report and Written Opinion for Int'l Patent Application No. PCT/US2019/019661, filed on Feb. 26, 2019.
(Continued)

*Primary Examiner* — Michael D Dennis

(57) ABSTRACT

Described herein is a tour iron having a golf club head with a faceplate, a body, and an insert. A sole, top rail, rear, and the faceplate enclose a cavity within the body. The cavity can house the insert. The insert can comprise a low-density material, allowing weight to be concentrated around the peripheral edge of the golf club head. The rear of the golf club head has an inflection seam running from the heel to the toe. The golf club head has an upper portion, above the inflection seam and a lower portion below the inflection seam. The upper portion can have a rear opening. The faceplate, body, and insert can be formed of different materials having different densities. The golf club head has a comparatively high moment of inertia and a low center of gravity. Other embodiments and methods are described herein.

20 Claims, 13 Drawing Sheets

Related U.S. Application Data

(60) Provisional application No. 62/768,543, filed on Nov. 16, 2018, provisional application No. 62/713,424, filed on Aug. 1, 2018, provisional application No. 62/635,020, filed on Feb. 26, 2018.

(56) References Cited

U.S. PATENT DOCUMENTS

| | | | | |
|---|---|---|---|---|
| 5,078,397 | A | 1/1992 | Aizawa | |
| 5,198,062 | A | 3/1993 | Chen | |
| 5,312,106 | A | 5/1994 | Cook | |
| 5,425,535 | A | 6/1995 | Gee | |
| 5,429,353 | A | 7/1995 | Hoeflich | |
| 5,588,923 | A | 12/1996 | Schmidt et al. | |
| 5,766,092 | A | 6/1998 | Mimeur et al. | |
| 6,030,293 | A | 2/2000 | Takeda | |
| 6,042,486 | A | 3/2000 | Gallagher | |
| 6,093,116 | A | 7/2000 | Hettinger | |
| 6,200,228 | B1 | 3/2001 | Takeda | |
| 6,592,469 | B2 | 7/2003 | Gilbert | |
| 6,617,537 | B1 | 9/2003 | Chiu et al. | |
| 6,743,114 | B2 | 6/2004 | Best | |
| 6,743,117 | B2 | 6/2004 | Gilbert | |
| 6,843,733 | B1 | 1/2005 | Llewellyn et al. | |
| 6,921,344 | B2 | 7/2005 | Gilbert | |
| 6,929,563 | B2 | 8/2005 | Nishitani | |
| 6,932,717 | B2 | 8/2005 | Hou et al. | |
| 6,964,620 | B2 | 11/2005 | Gilbert et al. | |
| 7,004,853 | B2 | 2/2006 | Deshmukh | |
| 7,125,343 | B2 | 10/2006 | Imamoto | |
| 7,153,222 | B2 | 12/2006 | Gilbert et al. | |
| 7,166,042 | B2 | 1/2007 | Gilbert et al. | |
| 7,182,698 | B2 | 2/2007 | Tseng | |
| 7,207,899 | B2 | 4/2007 | Imamoto et al. | |
| 7,232,377 | B2 | 6/2007 | Gilbert et al. | |
| 7,371,190 | B2 | 5/2008 | Gilbert et al. | |
| 7,390,270 | B2 | 6/2008 | Roberts et al. | |
| 7,476,162 | B2 | 1/2009 | Stites et al. | |
| 7,662,050 | B2 | 2/2010 | Gilbert et al. | |
| 7,731,604 | B2 | 6/2010 | Wahl et al. | |
| 7,744,487 | B2 | 6/2010 | Tavares et al. | |
| 7,803,068 | B2 | 9/2010 | Clausen et al. | |
| 7,811,180 | B2 | 10/2010 | Roach et al. | |
| 7,922,604 | B2 | 4/2011 | Roach et al. | |
| 7,976,403 | B2 | 7/2011 | Gilbert et al. | |
| 7,980,960 | B2 | 7/2011 | Gilbert | |
| 7,998,001 | B2 | 8/2011 | Soracco | |
| 8,088,025 | B2 | 1/2012 | Wahl et al. | |
| 8,157,670 | B2 | 4/2012 | Oldknow et al. | |
| 8,157,673 | B2 | 4/2012 | Gilbert et al. | |
| 8,221,263 | B2 | 7/2012 | Tavares et al. | |
| 8,388,464 | B2 | 3/2013 | Gilbert et al. | |
| 8,647,218 | B2 | 2/2014 | Gilbert et al. | |
| 8,690,705 | B2 | 4/2014 | Molinari | |
| 8,753,220 | B2 | 6/2014 | Roach et al. | |
| 8,758,163 | B2 | 6/2014 | Stites | |
| 8,911,302 | B1 | 12/2014 | Ivanova et al. | |
| 8,920,258 | B2 | 12/2014 | Dolezel et al. | |
| 8,926,448 | B1 | 1/2015 | Ivanova et al. | |
| 8,939,848 | B2 | 1/2015 | Soracco et al. | |
| 8,968,114 | B2 | 3/2015 | Boyd et al. | |
| 8,973,243 | B2 | 3/2015 | Su | |
| 9,056,231 | B2 | 6/2015 | Wallans | |
| 9,199,141 | B2 | 12/2015 | Cardani et al. | |
| 9,259,629 | B2 | 2/2016 | Gilbert et al. | |
| 9,283,448 | B2 | 3/2016 | Sander | |
| 9,370,697 | B2 | 6/2016 | Beno et al. | |
| 9,381,407 | B2 | 7/2016 | Dolezel et al. | |
| 9,381,409 | B1 * | 7/2016 | Griffin | A63B 60/00 |
| 9,387,370 | B2 | 7/2016 | Hebreo et al. | |
| 9,555,296 | B2 | 1/2017 | Gilbert et al. | |
| 9,586,104 | B2 | 3/2017 | Roach | |
| 9,675,852 | B2 | 6/2017 | Westrum | |
| 9,821,203 | B2 | 11/2017 | Dolezel et al. | |
| 9,895,584 | B1 | 8/2018 | Su | |
| 10,039,963 | B2 | 8/2018 | Ripp et al. | |
| 10,052,535 | B1 | 8/2018 | Westrum et al. | |
| 10,076,692 | B2 | 9/2018 | Gilbert et al. | |
| 10,112,084 | B2 | 10/2018 | Stokke et al. | |
| 2004/0116208 | A1 * | 6/2004 | De Shiell | A63B 60/00 473/345 |
| 2005/0014573 | A1 * | 1/2005 | Lee | A63B 53/0475 473/335 |
| 2005/0020378 | A1 | 1/2005 | Krumme et al. | |
| 2005/0037860 | A1 | 2/2005 | Gilbert et al. | |
| 2005/0096151 | A1 | 5/2005 | Hou et al. | |
| 2007/0049403 | A1 | 3/2007 | Chen | |
| 2007/0265107 | A1 | 11/2007 | Wang et al. | |
| 2008/0058117 | A1 | 3/2008 | Roach | |
| 2008/0242444 | A1 | 10/2008 | Park et al. | |
| 2009/0149277 | A1 | 6/2009 | Deng et al. | |
| 2009/0163295 | A1 | 6/2009 | Tseng | |
| 2009/0280923 | A1 | 11/2009 | Park et al. | |
| 2010/0151962 | A1 | 6/2010 | Breier et al. | |
| 2011/0034273 | A1 | 2/2011 | Clausen et al. | |
| 2011/0269571 | A1 | 11/2011 | Gilbert et al. | |
| 2012/0289360 | A1 | 11/2012 | Breier et al. | |
| 2013/0288823 | A1 | 10/2013 | Hebreo | |
| 2014/0274456 | A1 | 9/2014 | Cardani et al. | |
| 2015/0111663 | A1 | 4/2015 | Kuhar et al. | |
| 2015/0157905 | A1 | 6/2015 | Kim et al. | |
| 2015/0209630 | A1 | 7/2015 | Kawaguchi et al. | |
| 2015/0273287 | A1 | 10/2015 | Doi et al. | |
| 2016/0184669 | A1 | 6/2016 | Deshmukh et al. | |
| 2016/0199705 | A1 | 7/2016 | Oldknow | |
| 2016/0287955 | A1 | 10/2016 | Ritchie et al. | |
| 2016/0296809 | A1 | 10/2016 | Golden et al. | |
| 2016/0346638 | A1 | 12/2016 | Snyder | |
| 2017/0065858 | A1 | 3/2017 | Tassistro et al. | |
| 2017/0080301 | A1 | 3/2017 | Dolezel et al. | |
| 2017/0259134 | A1 | 9/2017 | Ines et al. | |
| 2018/0140910 | A1 | 5/2018 | Parsons et al. | |
| 2018/0147457 | A1 * | 5/2018 | Bacon | A63B 53/04 |
| 2018/0221726 | A1 | 8/2018 | Westrum et al. | |
| 2018/0221730 | A1 | 8/2018 | Petersen et al. | |
| 2019/0118049 | A1 | 4/2019 | Tassistro et al. | |
| 2019/0299068 | A1 | 10/2019 | Hosooka | |

FOREIGN PATENT DOCUMENTS

| | | |
|---|---|---|
| JP | 2012-024409 | 2/2012 |
| JP | 2013-059680 | 4/2013 |
| JP | 3214539 | 1/2018 |

OTHER PUBLICATIONS

International Search Report and Written Opinion for Int'l Patent Application No. PCT/US2020/036497, filed on Jun. 5, 2020.

Xxio Forged Irons, www.xxiousa.com, Men's Golf Clubs / Xxio Forged Series / Xxio Forged Irons, accessed May 3, 2019.

Extended European Search Report and Written Opinion for PCT/US2019/019661 (EP patent Application No. 19758199.4) filed on Oct. 20, 2021.

* cited by examiner

MULTI-MATERIAL IRON GOLF CLUB HEAD

CROSS-REFERENCES

This is a continuation of U.S. patent application Ser. No. 16/286,462, filed Feb. 26, 2019, which claims benefit of U.S. Provisional Patent Application No. 62/635,020, filed on Feb. 26, 2018; U.S. Provisional Patent Application No. 62/713,424, filed Aug. 1, 2018; and U.S. Provisional Patent Application No. 62/768,543, filed on Nov. 16, 2018, the contents of all of which are incorporated herein by reference.

TECHNICAL FIELD

The present disclosure relates generally to golf equipment, and more particularly, to a multi-material iron golf club head, and methods to manufacture said golf club head.

BACKGROUND

Typically, iron-type golf club heads comprise various styles, such as muscle-back, cavity-back, or tour irons. Golfers having a high skill level with a low handicap prefer to play compact and aesthetically sleek tour irons. Tour irons have a higher loft, lower center of gravity (hereafter "CG"), shorter length of shaft, a smaller profile, and a thinner top line. Tour irons generally have a sleek, classic look and a desirable sound. Forged tour irons are, in particular, thought to offer an improved "feel" over other types of irons, such as cast irons, and provide aesthetic sight lines. Generally, low handicap golfers, such as tour players, desire iron type club heads with the CG low and close to the face of the club. Tour irons allow these golfers to further shape their shots by manipulating the part of the club face that impacts the golf ball, because of a smaller sweet spot for straight flight. Although challenging for a high handicap golfer to use effectively, tour irons fill a niche demand for the highly skilled and often low handicap golfers.

On the other hand, game improvement irons are typically designed to cater to high handicap golfers who desire increased forgiveness and higher loft in their irons. High handicap golfers tend to play iron type club heads with a higher moment of inertia (MOI), which gives the club head more forgiveness. Game improvement irons, such as deep cavity back, muscle-back, or hollow-bodied irons, allow for perimeter weighting, which increases the forgiveness of the club head, and results in greater distance due to the face having room to bend. However, game improvement irons understandably "feel" less like a solid-bodied tour iron and can sound less pure to golfers who are accustomed to traditional solid irons. Game improvement irons have a large profile, resulting in a bulky feel. These game improvement irons can also have a thick top line and other shaping features that many golfers consider less aesthetically pleasing. The golf club head described herein caters to aspiring golfers who desire a club that shares the benefits of both game improvement and tour irons.

There is a need in the art for a club head having the compact size and solid feel and sound of traditional tour irons, without sacrificing the high moment of inertia and perimeter weighting of traditional game improvement irons, that can be used by mid-low handicap players.

Figure 1:
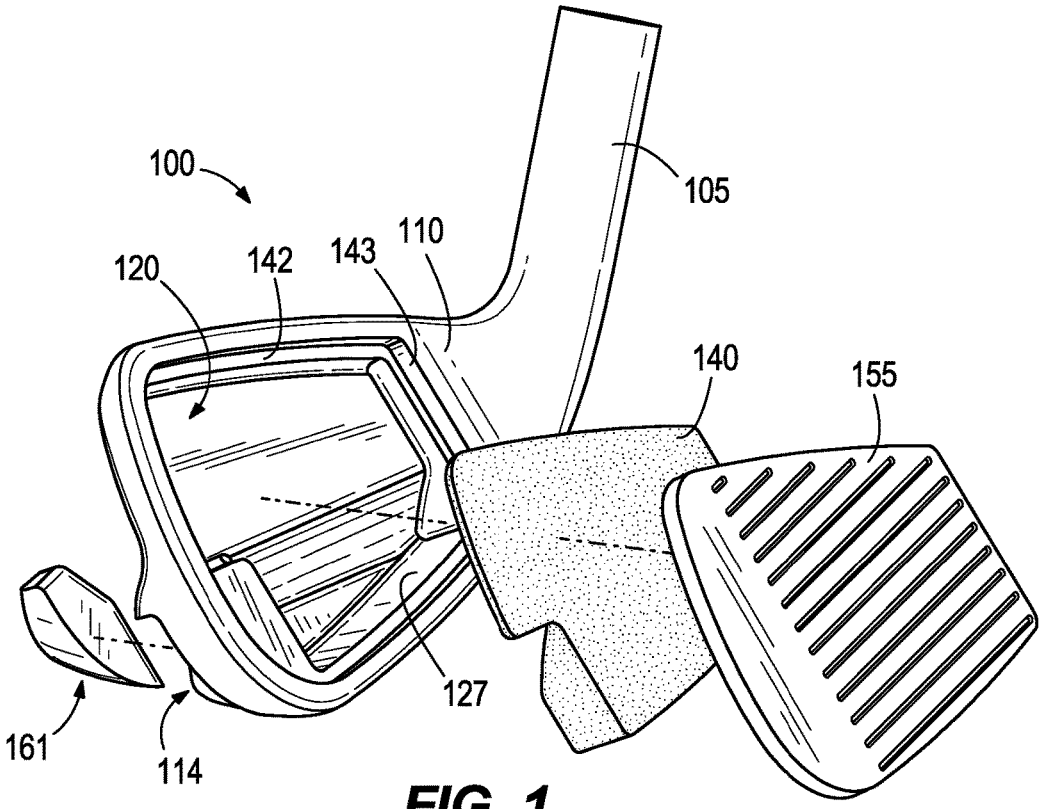
FIG. 1 shows a exploded perspective view of a golf club head according to an embodiment.

It is well understood by those familiar with golf that tour irons are visibly distinct from game-improvement irons by both their size and appearance. Accordingly, tour irons comprise design requirements different than game-improvement irons. The golf clubs described herein satisfy a market demand for tour style irons while retaining the functional benefits of game-improvement irons.

Specifically, the golf club head described herein shares the aesthetically appealing features of tour irons (e.g. compact size, forged, solid feel), and the performance advantages of game-improvement irons (e.g. perimeter weighting and high forgiveness). Described herein is a golf club head having a body that forms a cavity, wherein an insert can fit within the cavity, and the cavity is enclosed either by a cap in the rear of the body or by a faceplate of the body. Accordingly, the golf club head provides a golfer with iron clubs having a tour style while retaining a level of forgiveness necessary for an intermediate or beginner skill golfer to make the most accurate shots possible for their skill level. Generally, tour irons are designed for highly skilled golfers or low handicap to mid handicap players, while game-improvement irons are designed for low to intermediate skill level golfers also having higher handicaps (over 10). The golf club head described herein provides an option for the golfer who desires to play with a set of tour irons lacking the skills to use traditional tour irons.

Additionally, the golf club head provides an option for the highly skilled golfer who desires to increase the accuracy of their shots through a high-MOI design. Although the golf club head described herein can comprise a MOI that is lower than certain game-improvement or standard irons, the club head nonetheless comprises an MOI that is higher than other golf club heads within the same category, namely tour or small profile irons. Furthermore, the disclosed golf club head provides a low CG that is desirable for high skill golfers. The golf club head described herein can be exemplified by, but not limited to, these embodiments.

The golf club head can be manufactured by methods that include swedging (swagging) the faceplate onto the body of the golf club head. A boundary between the faceplate and the body after swedging can be laser welded in a surface fusions treatment process. The insert is not damaged by the swedging or laser welding.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

DETAILED DESCRIPTION

Described herein is a golf club having a hollow golf club head, or partially/nearly hollow golf club head, each of which comprise a low-density insert (The hollow golf club head or partially/nearly hollow golf club head is hereafter referred to as "golf club head."). The golf club has a golf club head, a shaft, and a grip. The golf club head comprises a body having a hosel, a front, a rear, a top rail, and a sole. The body can comprise a cavity. The faceplate, the sole, the rear and the top rail enclose a cavity. In some embodiments, the cavity of the golf club head can be enclosed from the front by the faceplate. In some embodiments, the cavity can open at the rear of the club, partially exposing the cavity. An insert can fit within the cavity. The front of the golf club head can further comprise a faceplate, which encloses the cavity from the front.

One embodiment of the golf club head described herein includes a body that forms a cavity and a low-density insert, wherein the cavity opens towards the front of the golf club head. The body has an internal cavity formed in the center of the club head. The body can be cast or forged. The cavity can receive and harbor the low-density insert.

The golf club head has a low-density center, a high-density perimeter, and, as mentioned above, a low-density insert to move weight to the perimeter thereby improving overall foregiveness. The insert comprises a low-density material, such as aluminum, titanium, or a composite. Filling the cavity with a solid insert improves the acoustics and the feel of the golf club head over other similar hollow-bodied irons. In some embodiments, adhesives and/or tape are used to further secure the insert into the cavity and to prevent rattling.

The faceplate encloses the front opening of the golf club head and forms the cavity. Swedging, press-fitting, and other low-temperature methods are used for securing the faceplate. TIG welding is not used. In some embodiments, the faceplate can be further secured to the body by laser welding, because laser welding is very precise and does not create a large heat-affected zone (hereafter "HAZ") to affect the insert, tape, and/or adhesives. If the faceplate is TIG welded onto the front of the golf club head body, the insert, tape, and/or adhesives are exposed to high temperatures and are damaged, thereby corrupting the weight distribution of the insert and corrupting the material properties of the tape and/or adhesives.

A high-density perimeter of the golf club head can be also accomplished by a toe weight and/or a tip weight in the hosel. In some embodiments, the body can further comprise a toe cavity. A toe weight can be mounted within the toe cavity. The toe weight comprises a high-density material, such as tungsten. Additionally, in some embodiments, the golf club head can include a toe screw weight for swing weighting.

In a second embodiment of the golf club head, the cavity of the body is exposed via an opening in the upper portion of the rear. Similar to the first embodiment, the golf club head of the second embodiment comprises a body and a low-density insert. The body can be cast or forged. The body comprises a rear opening in an upper portion of the body. The low-density insert is housed in the cavity of the body. In this embodiment, the insert comprises a material that can be injected into the cavity, such as a thermoplastic composite, foam, or other filler damping material.

The golf club head further comprises a faceplate that forms a front boundary of the cavity. An injection molding process can form the low-density insert within the cavity of the body. The golf club head can further include a toe weight in a toe cavity of the body and/or a tip weight in the hosel for perimeter weighting. Additionally, the golf club head can include a toe screw weight for swing weighting.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "front," "back," "rear," "top," "bottom," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The term "couple" and similar terms should be broadly understood and refer to connecting two or more elements, mechanically and/or otherwise. For example, two or more mechanical elements may be mechanically coupled, but not be electrically or otherwise coupled. Coupling may be for any length of time, e.g., permanent or semi-permanent or only for an instant.

The term MOI as described herein can be a quantity expressing a body's tendency to resist angular acceleration. MOI is also known as angular mass or rotational inertia. MOI determines the torque needed to achieve a desired angular acceleration about a rotational axis. A higher MOI gives a club head more forgiveness, meaning the golfer will notice more consistent shots even when the golf ball is struck with a portion of the strike-face that is off-center. MOI is raised by moving weight away from the center of the golf club head and towards the perimeter of the golf club head. In order to preserve a desirable overall golf club head weight, to increase MOI, the center of a golf club head must comprise either a cavity or a lighter material than the main golf club head.

The aspects of the golf club described herein may be applied to one or more golf clubs within a set of irons. In some embodiments, the set of irons comprises irons having varying club head size, shaft length, lie angle, loft angle, head weight, and/or other parameters. Each club head in the set of irons can be numbered according to convention with numbers ranging from 1 to 10. Most commonly a set is numbered from 3 to 9. Furthermore, the set of irons can comprise one or more wedges, which have a loft angle higher than the numbered irons.

In some embodiments, the golf club head can be a wedge. In many embodiments, the loft angle of the golf club head is less than approximately 50 degrees, less than approximately 49 degrees, less than approximately 48 degrees, less than approximately 47 degrees, less than approximately 46 degrees, less than approximately 45 degrees, less than approximately 44 degrees, less than approximately 43 degrees, less than approximately 42 degrees, less than approximately 41 degrees, or less than approximately 40 degrees. Further, in many embodiments, the loft angle of the golf club head is greater than approximately 16 degrees, greater than approximately 17 degrees, greater than approximately 18 degrees, greater than approximately 19 degrees, greater than approximately 20 degrees, greater than approximately 21 degrees, greater than approximately 22 degrees, greater than approximately 23 degrees, greater than approximately 24 degrees, or greater than approximately 25 degrees.

In many embodiments, the loft angle of the golf club head is less than approximately 64 degrees, less than approximately 63 degrees, less than approximately 62 degrees, less than approximately 61 degrees, less than approximately 60 degrees, less than approximately 59 degrees, less than approximately 58 degrees, less than approximately 57 degrees, less than approximately 56 degrees, less than approximately 55 degrees, or less than approximately 54 degrees. Further, in many embodiments, the loft angle of the golf club head is greater than approximately 46 degrees, greater than approximately 47 degrees, greater than approximately 48 degrees, greater than approximately 49 degrees, greater than approximately 50 degrees, greater than approximately 51 degrees, or greater than approximately 52 degrees.

In many embodiments, the golf club head can comprise a total volume of between 1.9 cubic inches and 2.7 cubic inches. In some embodiments, the total volume of the golf club head can be between 1.9 cubic inches and 2.4 cubic inches, 2.0 cubic inches and 2.5 cubic inches, 2.1 cubic inches and 2.6 cubic inches, 2.2 cubic inches and 2.7 cubic inches, 2.3 cubic inches and 2.7 cubic inches, or 2.4 cubic inches and 2.7 cubic inches. In other embodiments, the total volume of the golf club head 100 can be 1.9 cubic inches, 2.0 cubic inches, 2.1 cubic inches, 2.2 cubic inches, 2.3 cubic inches, 2.4 cubic inches, 2.5 cubic inches, 2.6 cubic inches, or 2.7 cubic inches.

In many embodiments, the golf club head can comprise a total mass of between 200 grams and 300 grams. In some embodiments, the golf club head can comprise a total mass of between 200 grams and 210 grams, 210 grams and 220 grams, 220 grams and 230 grams, 230 grams and 240 grams, 240 grams and 250 grams, 250 grams and 260 grams, 255 grams and 260 grams, 260 grams to 270 grams, 265 grams to 275 grams, 270 grams and 280 grams, 275 grams and 280 grams, or 250 grams and 270 grams. In other embodiments, the total mass can be 200 grams, 205 grams, 210 grams, 220 grams, 225 grams, 230 grams, 235 grams, 240 grams, 245 grams, 250 grams, 255 grams, 260 grams, 265 grams, 270 grams, 275 grams, 280 grams, 285 grams, 290 grams, 295 grams, or 300 grams.

The golf club head described herein can be viewed from various perspectives, while in address position, including but not limited to: a front view, a rear view, a toe-side view, a heel-side view, a top view, a sole view, and various perspective views. For example, the front view of the golf club head 100, views the club head from a direction forward of the loft plane 20, parallel to the ground plane 10. The rear view of the golf club head 100 views the club head from a direction rearward of the rear 103, parallel to the ground plane 10. The toe-side view of the golf club head 100 views the club head from a toe-to-heel direction that is parallel to the ground plane 10. The heel-side view of the golf club head 100 views the club head from a heel-to-toe direction that parallel to the ground plane 10. The sole view of the golf club head 100 views the club head from a sole-to-top direction orthogonal to the ground plane 10. The top view of the golf club head 100 views the club head from a top-to-sole direction orthogonal to the ground plane 10.

I. Golf Club Head with Insert and Enclosing Faceplate

Described herein is a golf club head 100. The golf club head 100 can be a tour style golf club head with forgiveness as discussed above. The golf club head 100 can comprises a body having a cavity that houses an insert. The golf club head comprises a faceplate, a body, and an insert. The body comprises an upper portion, a lower portion, a sole, a rear, and a top rail. The rear can further comprise an inflection seam. The inflection seam is the boundary between the upper portion and lower portion of the golf club head. The faceplate and a portion of the body define a striking surface of the golf club head. The faceplate, the sole, the rear, and the top rail enclose a cavity.

The cavity of the body opens towards the front of the golf club head and is enclosed by a faceplate. The faceplate can be swedged and laser welded to the body. The club head is a tour iron club head, and has a volume between 1.8 cubic inches and 2.7 cubic inches (30 cubic centimeters (cc) and 45 cc). The body of the golf club head can be cast or forged from a metal material.

The insert comprises a low-density material and fills the cavity formed by the body of the golf club head. Reducing mass in the center of the golf club head allows extra mass to be concentrated at its perimeter to increase moment of inertia values of the golf club head. As discussed above, the golf club head comprises a lower portion and an upper portion. The lower portion comprises a depth greater than the upper portion. The lower portion thereby has more mass concentrated on the peripheral heel end, toe end, and the sole. Lowering the mass of the body results in a low CG, which increases launch angle and reduces spin. As introduced above, there is a need in the art for an iron that couples tour iron sizing with a comparatively high moment of inertia from perimeter weighting and a low CG from low positioning of mass. In some embodiments, a tip weight positioned in the hosel and/or a toe weight positioned in a toe cavity of the body provide additional perimeter weighting.

A. Parts of the Golf Club Head

Turning to FIGS. 1-13, the golf club head 100 comprises a faceplate 155, a body 110, and an insert 140 as discussed above. The body 110 may further comprise an upper portion 108, a lower portion 109, a sole 107, a rear 103, a toe side 101, a heel side 102, and a top rail 106. The faceplate 155 and a portion of the body may define a strikeface 111. The faceplate 155, the sole 107, the rear 103, and the top rail 106 enclose a cavity 120. The upper portion 108 is bounded by the top rail 106. The lower portion 109 is bounded by the sole 107. The rear 103 may comprise an inflection seam 130. The inflection seam 130 can stretch from the toe side 101 to the heel side 102 of the golf club head. The inflection seam 130 bounds the upper portion 108 to the top rail 106. The inflection seam 130 bounds the lower portion 109 to the sole 107. The inflection seam 130 marks the end of a uniform upper portion depth 116, as described below. As shown in FIGS. 4-12, the inflection seam 130 is depicted as an inflection point in any cross-sectional view taken in a top rail-to-sole direction from the toe-side view.

Figure 2:
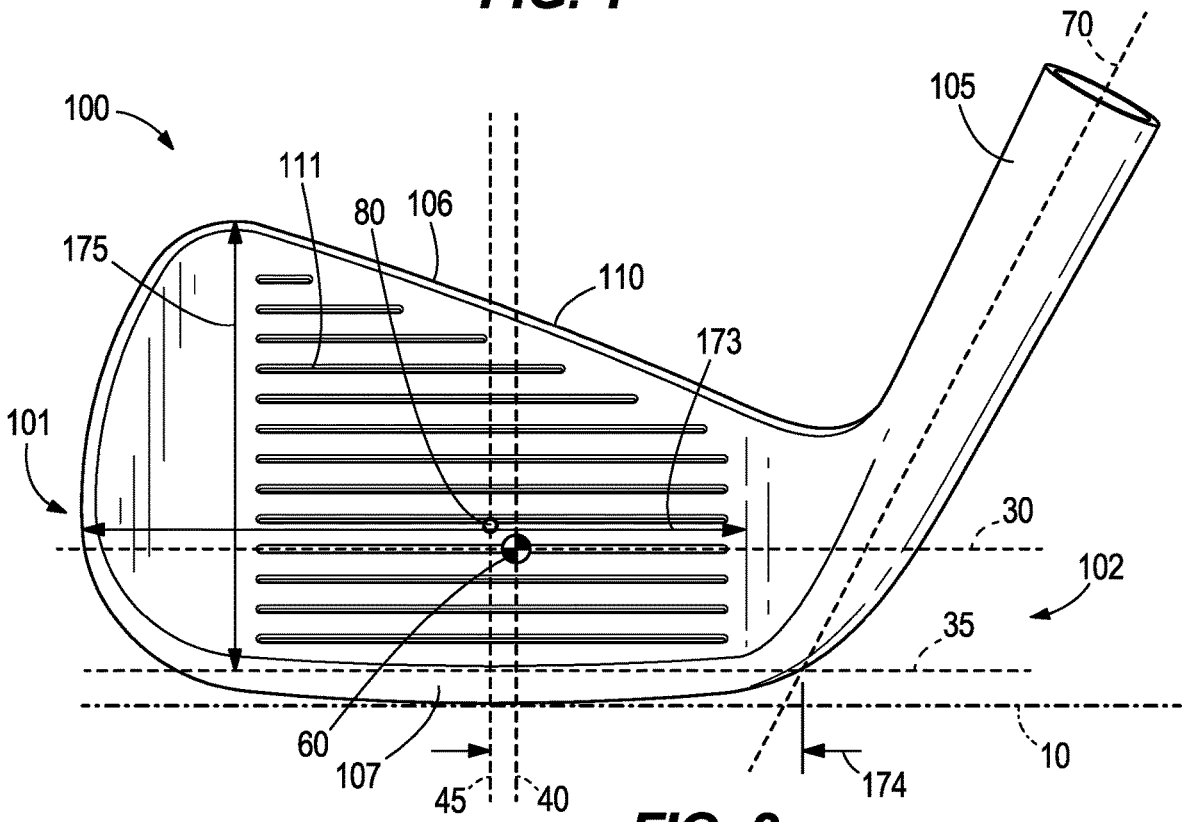
FIG. 2 shows a front view of the golf club head of FIG. 1.
Figure 3:
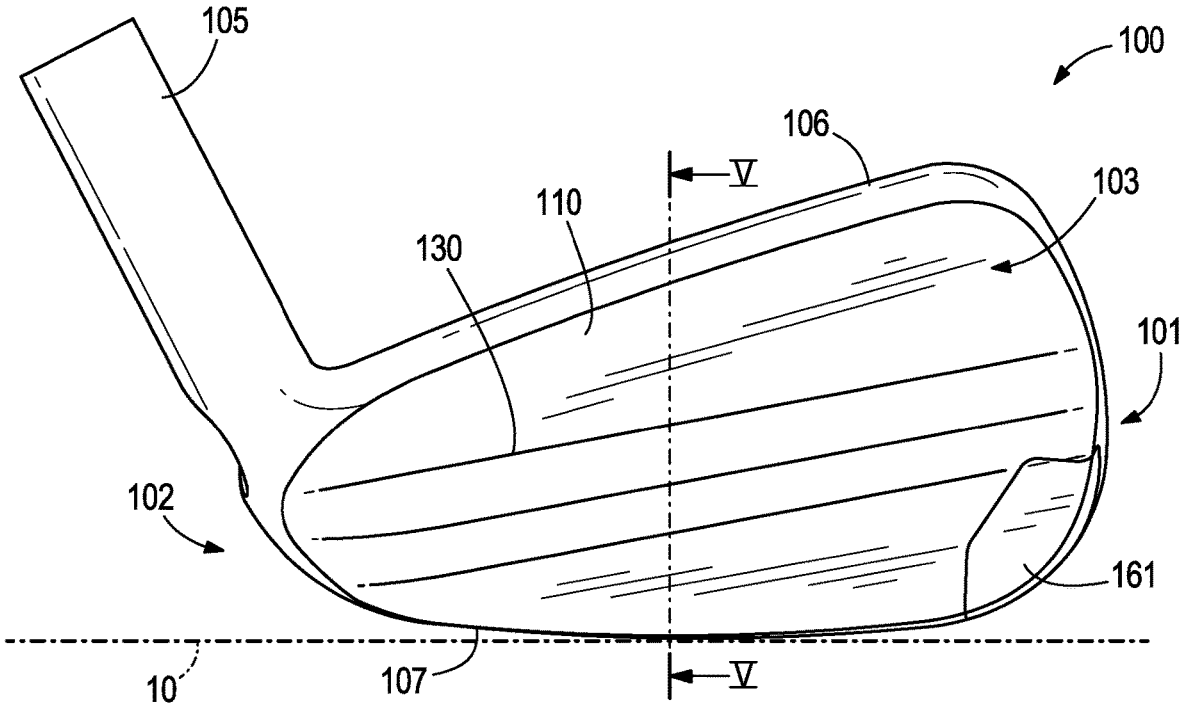
FIG. 3 shows a rear view of the golf club head of FIG. 1.
Figure 4:
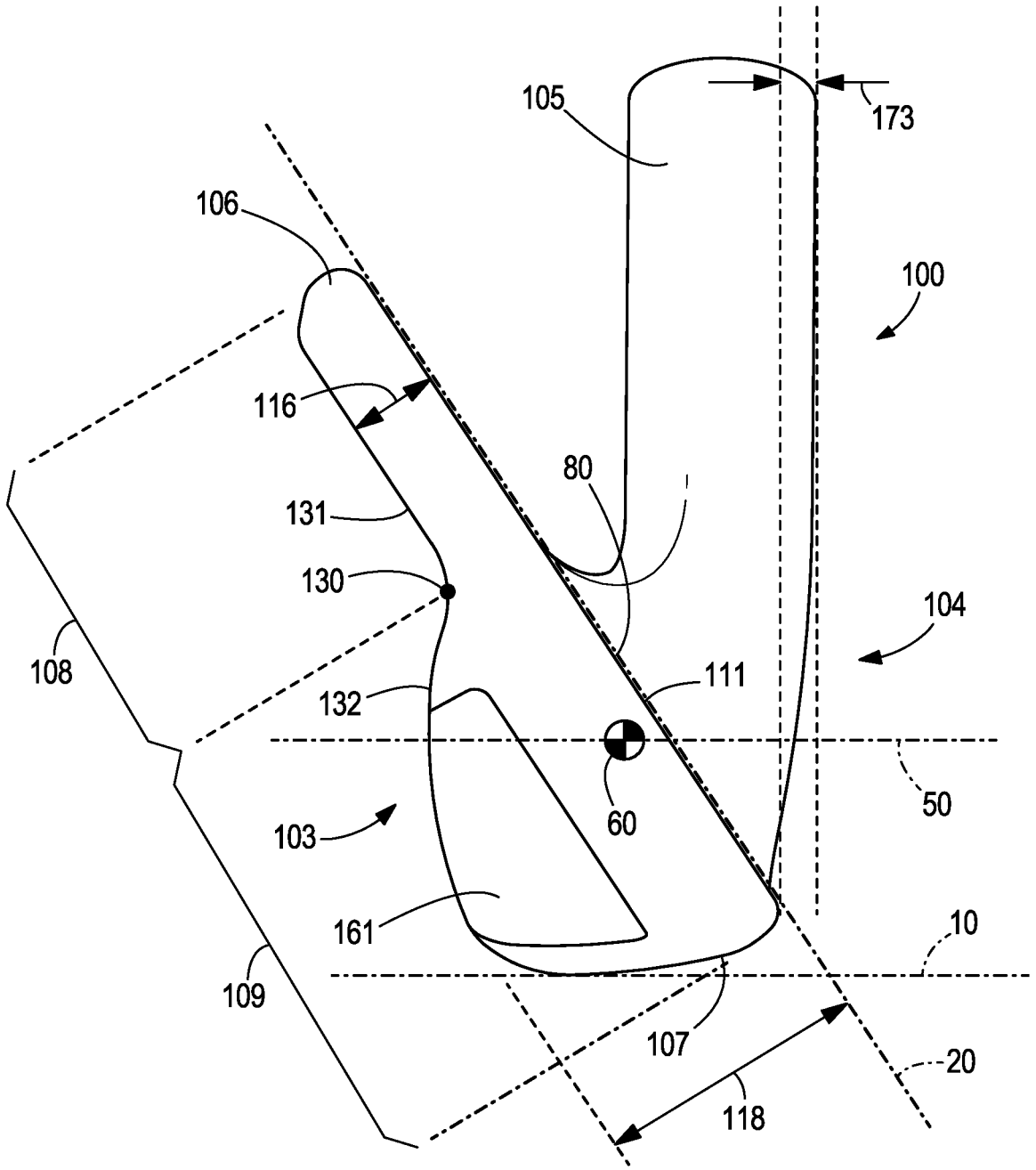
FIG. 4 shows toe-side view of the golf club head of FIG. 1.

As illustrated in FIGS. 2 and 3, a ground plane 10 provides a reference for the ground when the golf club is at address position. As illustrated in FIG. 4, a face plane 20 is parallel to the strikeface 111. As illustrated in FIG. 2, a centerplane 45 is perpendicular to the loft plane 20, and coincident with a centerpoint 80 of the strikeface 111. As shown in FIGS. 2 and 4, the golf club head 100 can have a coordinate system centered around the CG 60 of the golf club head 100. Golf club heads 200 and 300, described below, can have similar coordinate axes. An x-axis 30 reference axis extends in a toe-to-heel direction and through the CG 60. The x-axis 30 is parallel with the strikeface. A y-axis 40 reference axis extends in a top rail-to-sole direction and through the CG 60. The y-axis 40 is orthogonal to the ground plane 10 when the golf club head 100 is at address position. A z-axis 50 reference axis extends in a front-to-rear direction and through the CG 60. The z-axis 50 is parallel to the ground plane 10 and perpendicular to the x-axis 30 and the y-axis 40. Furthermore, a hosel axis 70 reference axis extends through the concentric center of the hosel 105. A lead edge axis 35 is parallel to the ground plane 10, extends in a heel-to-toe direction, and is coincident with a point that is lowest on the generally planar strikeface 111 along the center of the strikeface 111. A lead edge plane is coincident with the lead edge axis 35 and parallel to the ground plane 10.

1) Upper and Lower Portion of the Golf Club Head

Figure 5:
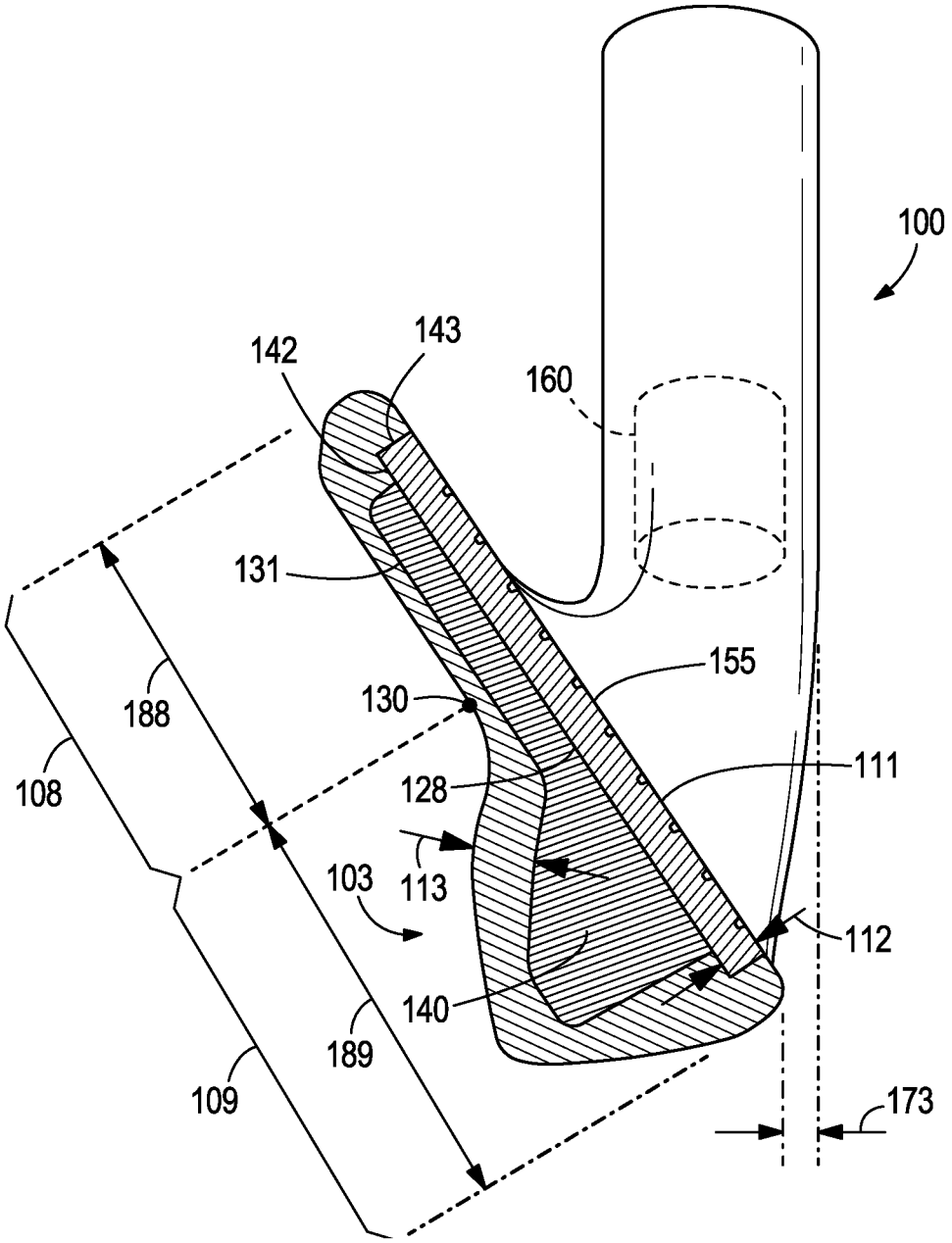
FIG. 5 shows a cross-sectional toe-side view of the golf club head of FIG. 1, along the line V-V in FIG. 3.

As illustrated in FIGS. 4 and 5, the golf club head 100 comprises the upper portion 108 and the lower portion 109. As discussed above, the upper portion 108 can be separated from the lower portion 109 by the inflection seam 130. The upper portion 108 of the rear 103 of the body can comprise an uniform depth 116. The rear 103 comprises an upper wall 131 and a lower wall 132. By staying substantially parallel to the loft plane 20, the upper wall of the rear 103 enables a constant depth 116 in the upper portion 108 of the golf club head 100. At the inflection seam 130, the rear contour transitions between the upper portion 108 and the lower portion 109 of the golf club head 100, causing a shift in the depth of the golf club head 100. This change in depth leads to the lower portion 109 having a greater depth 118 than the upper portion 108, as described below. The greater depth of the lower portion 109 is beneficial for lowering the CG of the golf club head 100 and improving launch characteristics.

This contour of the rear 103 of the golf club head 100 enables mass to be placed lower in the golf club head 100 than in golf club heads with a flat rear design. By moving mass lower in the club head, the CG is lowered. This allows for improved ball launch and spin characteristics of the golf ball when impact by the golf club head 100. The full benefits of the CG location are best understood by way of comparison to a golf club head with a flat rear, as provided below in Example 3. In some embodiments, the golf club head 100 can comprise a CG that is lower than the CG of a flat back comparison golf club head by between 0.030 inch and 0.050 inch. In some embodiments, the CG is lowered by between 0.030 inch and 0.032 inch, 0.032 inch and 0.034 inch, 0.034 inch and 0.036 inch, 0.036 inch and 0.038 inch, 0.038 inch and 0.040 inch, 0.040 inch and 0.042 inch, 0.042 inch and 0.044 inch, 0.044 inch and 0.046 inch, 0.046 inch and 0.048 inch, or 0.048 inch and 0.050 inch.

The rear contour can vary between embodiments in order to allow the upper portion 108 and the lower portion 109 to have different depths, volumes, or masses. As shown in the cross sections of FIGS. 10 and 11, in some embodiments, the lower wall 132 of the rear 103 can comprise a shelf 139 just below the inflection seam 130. The shelf 139 can be between the upper wall 131 and the remainder of the lower wall 132. In these embodiments, the shelf 139 extends backwards and/or downwards from the inflection seam 130. In some embodiments, such as the one illustrated in FIG. 11, the shelf 139 is approximately perpendicular to the loft plane 20. By varying the rear contour, the depths, volumes, or masses of the upper and lower portions 108, 109 can be altered, which affects the location of the CG and the value of the MOI.

2) Heights of the Upper Portion and Lower Portion

As illustrated in FIGS. 4 and 5, the golf club head 100 comprises the upper portion 108 and the lower portion 109, which are divided by the inflection seam 130. The upper portion 108 comprises a height 188 measured along the centerplane 45 from the top rail 106 to the inflection seam 130, in a direction parallel to the loft plane 20. The upper portion height 188 can be between 0.60 inch and 0.90 inch. In some embodiments, the upper portion height 188 can be between 0.60 inch and 0.65 inch, 0.65 inch and 0.70 inch, 0.70 inch and 0.75 inch, 0.75 inch and 0.80 inch, 0.80 inch and 0.85 inch, 0.085 inch and 0.90 inch, 0.60 inch and 0.70 inch, 0.70 inch and 0.80 inch, or 0.80 inch and 0.90 inch.

The lower portion 109 comprises a height 189 measured along the centerplane 45 from the top rail 106 to the inflection seam 130, in a direction parallel to the loft plane 20. The lower portion height 189 can be between 0.80 inch and 1.10 inch. In some embodiments, the lower portion height 189 can be between 0.80 inch and 0.85 inch, 0.85 inch and 0.90 inch, 0.90 inch and 0.95 inch, 0.95 inch and 1.0 inch, 1.0 inch and 1.05 inch, 1.05 inch and 1.10 inch, 0.9 inch and 1.0 inch, or 1.0 inch and 1.1 inch.

A ratio of the upper portion height 188 and the lower portion height 189 can be between 9:8 (54:48) and 6:11 (54:99). In some embodiments, the ratio of the upper portion height 188 and the lower portion height 189 can be between 9:8 (54:48) and 6:8 (54:72), 6:8 (54:72) and 9:11 (54:66), or 9:11 (54:66) and 6:11 (54:99). A higher ratio of the upper and lower portion heights 188, 189 can result in a lower CG because the lower portion 109 comprises a greater depth and mass, as described below. A low CG improves launch and spin characteristics by reducing the torque imparted to the golf club head 100 upon impact with a golf ball. A low CG can also increase the ball speed and improve the feel of the golf club head 100.

3) Depths of the Upper Portion and Lower Portion of the Golf Club Head

As illustrated in FIGS. 4 and 5, the upper portion 108 of the golf club head 100 can comprise a uniform depth. The upper portion depth 116 of club head 100 can be between 0.200 inch and 0.250 inch. In some embodiments, the upper portion depth 116 can be between 0.200 inch and 0.210 inch, 0.205 inch and 0.215 inch, 0.210 inch and 0.220 inch, 0.215 inch and 0.225 inch, 0.220 inch and 0.230 inch, 0.225 inch and 0.235 inch, 0.230 inch and 0.240 inch, 0.235 inch and 0.245 inch, 0.240 inch and 0.250 inch, or 0.245 inch and 0.250 inch.

The lower portion 109 comprises a depth 118 measured perpendicular to the loft plane 20 from the strikeface 111 to an outer surface of the rear 103, along the centerplane 45. The lower portion depth 118 can vary in a top rail-to-sole direction and/or in a heel-to-toe direction. The lower portion depth 118 is equal or greater in depth than the depth of the upper portion 116 of the golf club head 100. The lower portion depth 118 can be between 0.270 inch and 0.780 inch. In other embodiments, the lower portion depth 118 can be between 0.270 inch and 0.320 inch, 0.320 inch and 0.380 inch, 0.380 inch and 0.430 inch, 0.430 inch and 0.480 inch, 0.480 inch and 0.530 inch, 0.530 inch and 0.580 inch, 0.580 inch and 0.630 inch, 0.630 inch and 0.680 inch, 0.680 inch and 0.730 inch, 0.730 inch and 0.780 inch, 0.270 inch and 0.470 inch, 0.320 inch and 0.520 inch, 0.370 inch and 0.570 inch, 0.420 inch and 0.620 inch, 0.470 inch and 0.670 inch, 0.420 inch and 0.620 inch, 0.470 inch and 0.670 inch, 0.520 inch and 0.720 inch, or 0.570 inch and 0.770 inch.

In the toe 101 and the heel 102 of the club head 100, the lower portion depth 118 can differ from the lower portion depth 118 at the centerplane 45. A minimum lower portion depth 118 in the toe 101 can be between 0.300 inch and 0.460 inch. In other embodiments, the lower portion depth 118 in the toe region 101 can be between 0.300 inch and 0.320 inch, 0.320 inch and 0.330 inch, 0.330 inch and 0.340 inch, 0.340 inch and 0.360 inch, 0.360 inch and 0.380 inch, 0.380 inch and 0.400 inch, 0.400 inch and 0.420 inch, 0.420 inch and 0.440 inch, or 0.440 inch and 0.460 inch.

The lower portion depth 118 at the heel 102 can differ from the lower portion depth at the centerplane 45 as well. A minimum lower portion depth 118 in the heel region 102 can be between 0.270 inch and 0.315 inch. In other embodiments, the lower portion depth 118 in the heel region 102 can be between 0.270 inch and 0.280 inch, 0.280 inch and 0.290 inch, 0.290 inch and 0.300 inch, 0.300 inch and 0.310 inch, 0.310 inch and 0.320 inch, 0.320 inch and 0.340 inch, 0.340 inch and 0.360 inch, 0.360 inch and 0.380 inch, 0.380 inch and 0.400 inch, 0.400 inch and 0.420 inch, 0.420 inch and 0.440 inch, or 0.440 inch and 0.460 inch.

A maximum depth of the club head 100 is located within the lower portion 109 of the body 110. The maximum of depth of the club head 100 is measured perpendicular to the loft plane 20 from the strikeface 111 to an outer surface of the rear 103. The maximum depth can be between 0.670 inch to 0.770 inch. In other embodiments, the maximum depth can be between 0.670 inch to 0.690 inch, 0.690 inch and 0.710 inch, 0.710 inch and 0.730 inch, 0.730 inch and 0.750 inch, or 0.750 inch and 0.770 inch.

In some embodiments, a ratio between the upper portion depth 116 and the lower portion depth 118 can be between 1:3 and 4:5. In some embodiments, the ratio between the upper 116 and lower 118 depths can be between 1:3 and 1:2, between 1:2 and 2:3, or between 2:3 and 4:5.

4) Volume of the Upper Portion and Lower Portion of the Golf Club Head

Referring to FIGS. 4 and 5, the upper and lower portions 108, 109 of the golf club head 100 can comprise a volume. The volume is measured from a plane adjacent the heel 102 and coincident with an edge/periphery of the faceplate 155 to the toe 101. The volume of the upper portion 108 can be between 0.20 cubic inches and 0.60 cubic inches. In some embodiments, the volume of the upper portion 108 can be between 0.20 cubic inches and 0.30 cubic inches, 0.25 cubic inches and 0.35 cubic inches, 0.30 cubic inches and 0.40 cubic inches, 0.35 cubic inches and 0.45 cubic inches, 0.40 cubic inches and 0.50 cubic inches, 0.45 cubic inches and 0.55 cubic inches, or 0.50 cubic inches and 0.60 cubic inches. In some embodiments, the volume of the upper portion 108 is 0.48 cubic inches.

As illustrated in FIG. 5, the upper portion 108 and the lower portion 109 together form the body 110, which defines the cavity 120. A portion of the cavity 120 within the upper portion 108 of the body 110 can have a volume between 0.05 cubic inches and 0.40 cubic inches (0.82 cc and 6.55 cc). In some embodiments, the cavity volume in the upper portion 108 can be between 0.05 cubic inches and 0.15 cubic inches, 0.10 cubic inches and 0.20 cubic inches, 0.15 cubic inches and 0.25 cubic inches, 0.20 cubic inches and 0.30 cubic inches, 0.25 cubic inches and 0.35 cubic inches, 0.30 cubic inches and 0.40 cubic inches, or 0.35 cubic inches and 0.45 cubic inches. In some embodiments, the cavity volume in the upper portion 108 is 0.17 cubic inches.

To properly place the CG low within the golf club head 100, the golf club head 100 below the inflection seam 130 (i.e. the lower portion 109), is larger in volume than the golf club head 100 above the infection seam 130 (i.e. the upper portion 108). The volume of the lower portion 109 of the club head 100 is measured the same as the upper portion 108 (i.e., measured from a plane adjacent the heel 102 and coincident with an edge/periphery of the faceplate 155 to the toe) The volume of the lower portion 109 can be between 1.15 cubic inches and 1.55 cubic inches. In some embodiments, the volume of the lower portion 109 can be between 1.15 cubic inches and 1.35 cubic inches, 1.25 cubic inches and 1.45 cubic inches, 1.35 cubic inches and 1.55 cubic inches, 1.20 cubic inches and 1.30 cubic inches, 1.30 cubic inches and 1.40 cubic inches, or 1.40 cubic inches and 1.50 cubic inches. In some embodiments, the volume of the upper portion is 1.36 cubic inches.

A portion of the cavity 120 within the lower portion 109 can have a volume between 0.15 cubic inches and 0.60 cubic inches (2.46 cc and 9.83 cc). In some embodiments, the cavity volume in the lower portion 109 can be between 0.15 cubic inches and 0.25 cubic inches, 0.20 cubic inches and 0.30 cubic inches, 0.25 cubic inches and 0.35 cubic inches, 0.30 cubic inches and 0.40 cubic inches, 0.35 cubic inches and 0.45 cubic inches, 0.40 cubic inches and 0.50 cubic inches, 0.45 cubic inches and 0.55 cubic inches, or 0.50 cubic inches and 0.60 cubic inches. In some embodiments, the cavity volume in the lower portion 109 is 0.37 cubic inches.

5) Overall Volume of the Cavity

Referring back to FIG. 1, the golf club head 100 can comprise the body 110 comprising a cavity 120 in a central portion of the golf club head 100. The cavity 120 is filled with the low-density insert 140, which increases the forgiveness of the golf club head 100 without sacrificing the solid feel and look of a tour iron. The forgiveness of the golf club head 100 corresponds to the amount of perimeter weighting, which is affected by the volume of the cavity 120. A larger cavity eliminates more mass from a central region of the golf club head 100 than a smaller cavity. Consequently, a larger cavity allows more weight to be positioned on the perimeter of the golf club head 100.

The cavity 120 can have a volume between 0.2 cubic inches and 0.8 cubic inches (3.28 cc and 13.11 cc). In some embodiments, the cavity 120 volume can be between 0.2 cubic inches and 0.3 cubic inches, 0.2 cubic inches and 0.25 cubic inches, 0.25 cubic inches and 0.30 cubic inches, 0.30 cubic inches and 0.40 cubic inches, 0.30 cubic inches and 0.35 cubic inches, 0.35 cubic inches and 0.40 cubic inches, 0.40 cubic inches and 0.50 cubic inches, 0.40 cubic inches and 0.45 cubic inches, 0.45 cubic inches and 0.50 cubic inches, 0.50 cubic inches and 0.60 cubic inches, 0.50 cubic inches and 0.55 cubic inches, 0.55 cubic inches and 0.60 cubic inches, 0.60 cubic inches and 0.70 cubic inches, 0.60 cubic inches and 0.65 cubic inches, 0.65 cubic inches and 0.70 cubic inches, 0.70 cubic inches and 0.80 cubic inches, 0.70 cubic inches and 0.75 cubic inches, 0.75 cubic inches and 0.80 cubic inches. In other embodiments, the cavity 120 can have a volume of 0.20 cubic inch, 0.22 cubic inch, 0.24 cubic inch, 0.26 cubic inch, 0.28 cubic inch, 0.30 cubic inch, 0.32 cubic inch, 0.34 cubic inch, 0.36 cubic inch, 0.38 cubic inch, 0.40 cubic inch, 0.42 cubic inch, 0.44 cubic inch, 0.46 cubic inch, 0.48 cubic inch, 0.50 cubic inch, 0.52 cubic inch, 0.54 cubic inch, 0.56 cubic inch, 0.58 cubic inch, 0.60 cubic inch, 0.62 cubic inch, 0.64 cubic inch, 0.66 cubic inch, 0.68 cubic inch, 0.70 cubic inch, 0.72 cubic inch, 0.74 cubic inch, 0.76 cubic inch, 0.78 cubic inch, or 0.80 cubic inch.

The cavity 120 can have a volume that is between 5% and 60% of the total club head volume, described above. In some embodiments, the cavity 120 can have a volume that is between 5% and 10%, 10% and 30%, 15% and 35%, 20% and 40%, 25% and 45%, 30% and 50%, 35% and 55%, or 40% and 60% of the total club head volume. In one embodiment, the volume of the cavity 120 is between 17% and 32% of the club head volume.

Increasing the volume of the cavity 120 results in the elimination of weight from the central region of body 110. This saved weight can be redistributed around the perimeter of the golf club head 100 to give the golf club head 100 greater forgiveness.

The heights, depths, and volumes of the upper and lower portions 108, 109 of the body 110 provide the club head 100 with a low-positioned CG 60. Therefore, the golf club head 100 comprises a lower CG than a golf club head having a flat rear, as exemplified in Example 3 below. As described above, the golf club head 100 can comprise a CG 60 that is lower than the CG of a flat back comparison golf club head by between 0.030 inch and 0.050 inch. The lower CG 60 causes the golf club head 100 to have better launch characteristics, better spin characteristics, and higher ball speed than a flat back golf club head.

6) Thickness Profiles of the Golf Club Head

The thickness of the rear 103 of the body 110 also affects the weighting and thereby the CG location of the golf club head 100. The thickness is measured from an exterior surface of the rear 103 to an interior surface of the rear 103 within the cavity 120. In some embodiments, the rear 103 of the body 110 is thicker adjacent the sole 107 of the body 110. Due to the density of the body 110 material, the greater thickness adjacent the sole 107 moves mass downward compared to a golf club head body having a uniform rear thickness. As illustrated in the cross-section of FIG. 5, the rear 103 of the body 110 can have a thickness 113. The rear thickness 113 can range between 0.030 inch and 0.100 inch. In some embodiments, the thickness 113 can be 0.030 inch, 0.040 inch, 0.050 inch, 0.060 inch, 0.070 inch, 0.080 inch, 0.090 inch, or 0.100 inch. The rear thickness 113 can be constant across the rear 103. In some embodiments, the rear thickness 113 varies across the rear 103 in a heel-to-toe direction and/or in a top rail-to-sole direction. Varying the thickness 113 of the rear 103 can assist in moving mass towards the sole 107 and rear 103 of the golf club head 100. Shifting the mass towards the sole 107 and rear 103 lowers the CG, which improves launch characteristics, improves spin characteristics, and increases ball speed.

7) Cavity of the Body

As illustrated in FIGS. 1 and 5, body 110 can comprise an internal peripheral edge 127 that defines the cavity 120 outer boundaries. The internal peripheral edge 127 circumscribes the cavity 120. The peripheral edge 127 internally bounds the top rail 106, sole 107, toe 101, and heel 102. The internal peripheral edge 127 can follow the contours of the external edge of the golf club head 100. Because the peripheral edge 127 of the cavity 120 extends as close to the edges of the golf club head 100 as possible, the size of the cavity 120 is maximized. Consequently, the size of the low-density insert 140 and its weighting benefits are also maximized.

In some embodiments, not depicted, the peripheral edge 127 gently tapers so that in a cross-section of the golf club head 100, taken in a front-to-rear direction, the cavity 120 covers a larger area closer to the front 104 and smaller area closer to the rear 103. In these embodiments, this tapered geometry enables the larger area adjacent the front 104 to harbor more surface area of the low-density insert thereby placing it closer to the front 104. Less internal cavity area is left for the low density insert and more of the high density material is left in the rear 103 of the golf club head 100. Thus, the shaping of the cavity 120 can enable the placement of more mass adjacent the rear 103 and sole 107 of the golf club head 100, shifting the CG down and back.

8) Indentation in the Cavity of the Golf Club Head

As shown in FIGS. 1 and 5, the front 104 of the body 110 further comprises an indentation 142 for receiving the faceplate 155. The indentation 142 connects to a front opening of the cavity 120, but is not considered part of the cavity 120. The indentation 142 comprises a peripheral edge 143 that generally follows the contours of the golf club head 100, including, but not limited to, the top rail 106, an edge of the body within the toe 101, the sole 107, and a roughly vertical dividing line adjacent the heel 102. The peripheral edge 143 of the indentation 142 is offset from the internal peripheral edge 127 that defines the cavity 120. The footprint of the indentation 142, as bounded by the peripheral edge 143, is larger than the area circumscribed by the internal peripheral edge 127 at a front of the cavity 120. The indentation 142 has a depth approximately equivalent to the thickness of the faceplate 155, described below.

The faceplate 155 aligns with the indentation 142 and sits within the cavity 120 and is seated on the indentation 142. The insert 140 (as described below) fits within the cavity to a volume that is flush with the indentation 142. The remaining volume of the cavity 120 is filled by the faceplate 155 that seats on the indentation 142. Together, the insert 140 and the faceplate 155 fill the entire volume of the cavity 120 and the indentation 142 of the golf club head 100. The insert 140 does not cover the indentation 142, but rather sits flush with the indentation 142. Thereby, the insert 140 does not interfere with the faceplate 155 seating on the indentation 142.

In other embodiments as described below, the insert 140 does not fill the volume of the cavity 120 to the indentation 142, but only a portion. Again, these embodiments entail an insert 140 that does not interfere with the faceplate 155 seating on the indentation 142.

B. Inserts of the Golf Club Head

In contrast to traditional, single-material tour irons, the golf club head 100 comprises a low-density insert 140 that fits within the cavity 120 of the body 110. As illustrated in FIG. 1, the insert 140 is shaped to fit within the cavity 120. The insert 140 completely fills or partially fills the cavity 120, as described above. In some embodiments, the insert 140 shares wall geometry with the cavity 120. The shape of the insert 140 can be identical or almost identical to the shape of the cavity 120. In embodiments where the insert substantially fills the cavity 140, the volume and other dimensions of the insert 120 approximately correspond to the respective volume and other dimensions of the cavity 140. As described below, manufacturing tolerances and the insertion of tape and/or adhesive into the cavity 120 can necessitate a slightly smaller volume for the insert 140 compared to the cavity 120.

1) Multi-Material (Multi-Density) Inserts

In some embodiments, a multi-material insert 440 is employed in place of the insert 140. The multi-material insert 440 can comprise dimensions and a volume similar to the dimensions and volume of insert 140. The multi-material insert 440 can comprise a first portion 150 and a second portion 160 of different materials having different densities. In some embodiments, the first portion 450 is a low-density portion and the second portion 460 is a weight. Adding weight to a lower portion of the insert 440 lowers the CG 60 of the golf club head 100, which improves launch characteristics and increases ball speed. Adding weight to lower the CG 60 can also increase ball speed and improve the feel of the golf club head 100. In other embodiments, the first portion 450 is a vibration damping material, and the second portion 460 is a low-density material. Forming the first portion 450 from a vibration damping material can affect the feel and sound of the golf club head 100. The feel, sound, and perimeter weighting of the golf club head 100 can be altered by forming the insert 440 from multiple materials.

The insert 440 can be formed with the first portion 450 and the second portion 460 in any orientation or combination with respect to each other, so long as the first and second portions 450, 460 form an insert 440 configured to fit within the cavity 120 of the body 110 as described above. The first portion 450 can be separate from the second portion 460 or integrally formed into a single multi-material insert 440. Various embodiments of a multi-material insert 440, 440B, 440C, and 440D are depicted in FIGS. 6-9 and described below.

Figure 6:
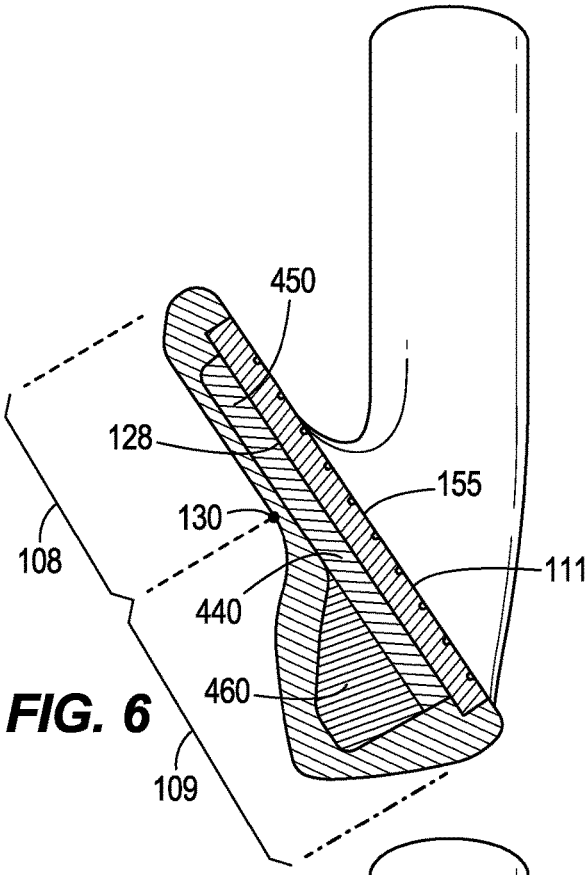
FIG. 6 shows a cross-sectional toe-side view of the golf club head of FIG. 1, along the line V-V in FIG. 3, according to an first embodiment with a multi-material insert.

Referring to FIG. 6, the insert 440 comprises a first portion 450 and a second portion 460. Insert 440 can be designed to fit within the cavity 120 of golf club head 100. The cross-sectional cutaway of FIG. 6 is taken along the centerplane 45 of the golf club head 100. The first portion 450 of the insert 440 is adjacent the strikeplate 155 and comprises a first material. The second portion 460 of the insert 440 is adjacent the rear 103 of the body 110 and comprises a second material. The first portion 450 overlaps the second portion 460. The first portion 450 of the insert 440 comprises a front surface that abuts a rear surface 128 of the faceplate 155. The second portion 460 does not engage the faceplate 155. The second portion 460 comprises a front surface that engages a rear surface of the first portion 450. The second portion 460 is confined within a section of the cavity 120 within the lower portion 109 of the golf club head 100.

In some embodiments, the engaging surfaces of one or both of the first and second portions 450, 460 comprise small features (not shown) that extend out from the generally planar surfaces to increase the engagement surface area. These small features can comprise protrusions, lips, ribs, hooks, or any other suitable feature. These features allow the first portion 450 to be secured onto the second portion 460 through a molding process or co-molding process.

Figure 7:
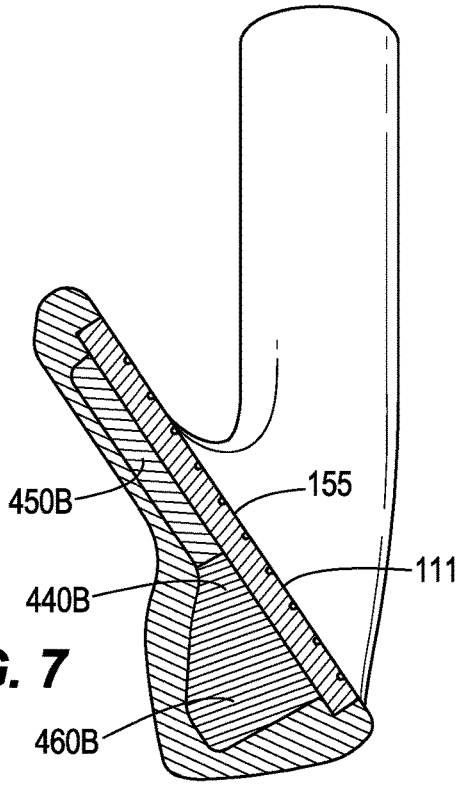
FIG. 7 shows a cross-sectional toe-side view of the golf club head of FIG. 1, along the line V-V in FIG. 3, according to a second embodiment with a multi-material insert.
Figure 8:
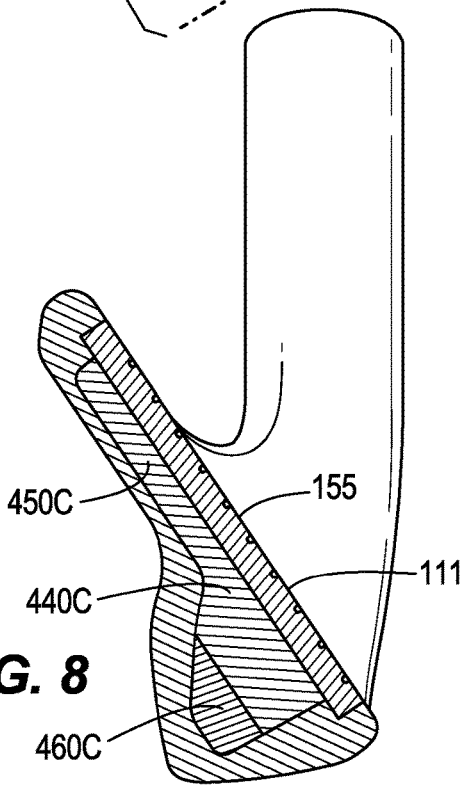
FIG. 8 shows a cross-sectional toe-side view of the golf club head of FIG. 1, along the line V-V in FIG. 3, according to a third embodiment with a multi-material insert.
Figure 9:
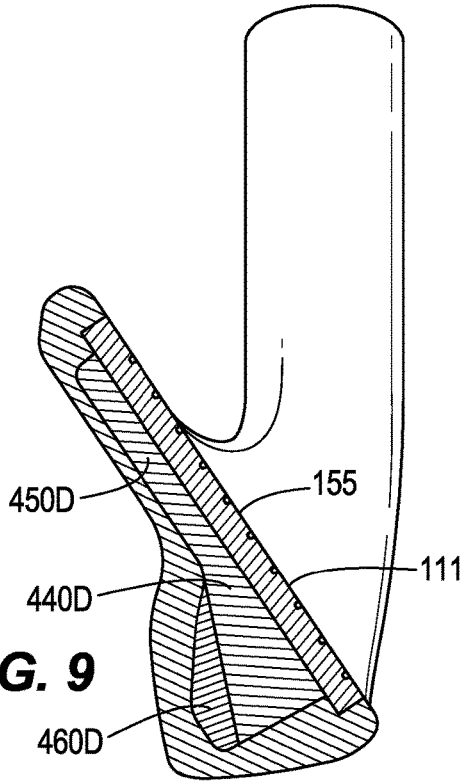
FIG. 9 shows a cross-sectional toe-side view of the golf club head of FIG. 1, along the line V-V in FIG. 3, according to a fourth embodiment with a multi-material insert.
Figure 11:
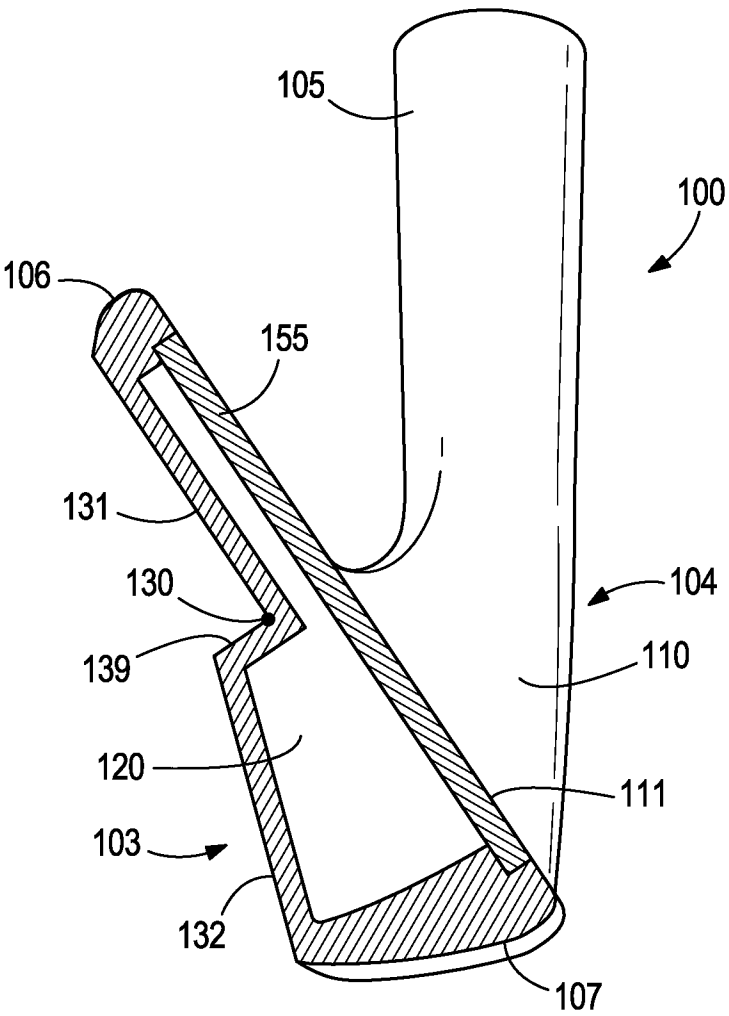
FIG. 11 shows a cross-sectional toe-side view of a golf club head, according to an embodiment having a rear shelf angled at 90 degrees from the loft plane.
Figure 10:
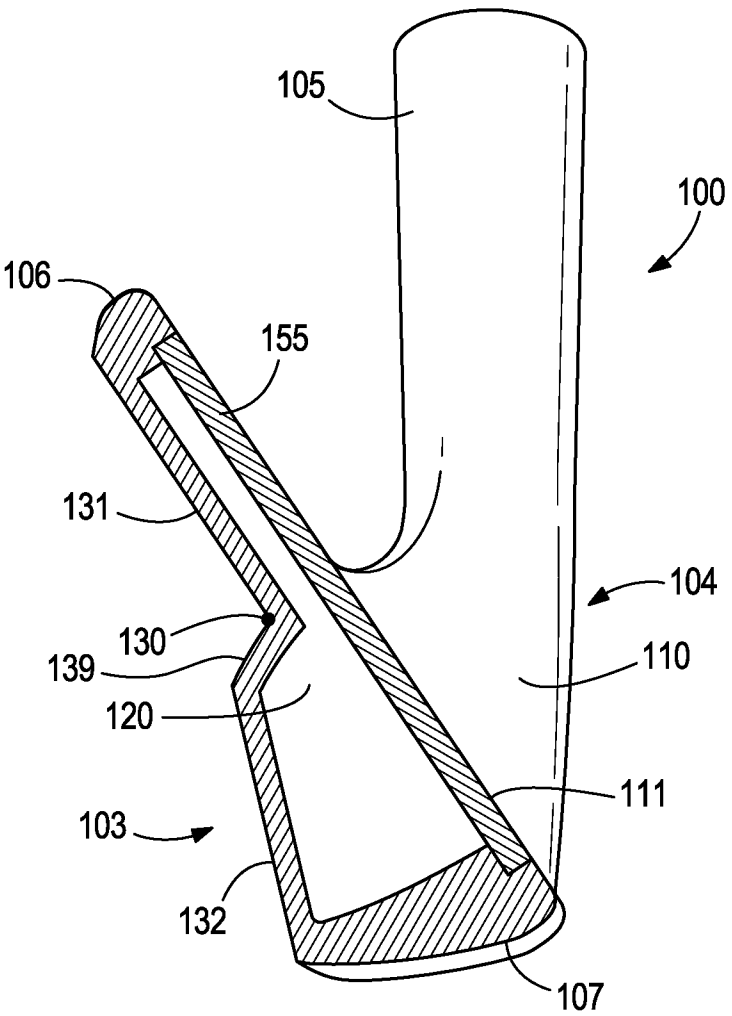
FIG. 10 shows a cross-sectional toe-side view of a golf club head, according to an embodiment having a rear shelf.

Turning now to FIGS. 7-9, three more example embodiments of multi-material inserts are depicted within a cross-sectional view of the club head 100, taken along the centerplane 45. The second embodiment of a multi-material insert 440B comprises a first portion 450B and a second portion 460B, arranged as illustrated in FIG. 7. In this embodiment, the first portion 450B forms an upper section of the insert 440B and the second portion 460B forms a lower section of the insert 440B. Both the first portion 450B and the second portion 460B are flush against the faceplate 155. The first portion 450B fills the section of the cavity 120 within the upper portion 108 of the body 110. The second portion 460B fills the section of the cavity 120 within the lower portion 109 of the body 110. The second portion 460B is flush against the entire interior sole wall of the cavity 120.

The third embodiment of a multi-material insert 440C comprises a first portion 450C and a second portion 460C, arranged as illustrated in FIG. 8. In this embodiment, the first portion 450C comprises a majority of the volume of the insert 440C. The first portion 450C extends partially into a rear end of the insert 440C. The entire second portion 460C is located rearward of the first portion 450C. The first portion 450C is flush against the faceplate 155 from the top rail 106 to the sole 107 in the cavity of the golf club head 100. The second portion 460C does not engage the faceplate 155. The second portion 460C partially fills and is completely located in the section of the cavity 120 within the lower portion 109 of the body 110. The second portion 460C engages a section of an interior sole wall and rear backwall of the cavity 120. In some embodiments, the second portion 460C is formed from a high density material.

The fourth embodiment of a multi-material insert 440D comprises a first portion 450D and a second portion 460D, arranged as illustrated in FIG. 9. In this embodiment, the first portion 450D extends partially into a rear end of the insert 440D. The first portion 450D engages the second portion 460D along a plane that is angled with respect to the loft plane 20. Furthermore, the first portion 450D is wider adjacent a bottom of the insert 440D than adjacent a top of the insert 440D. With respect to the golf club head 100, the first portion 450D is wider adjacent the sole 107 than adjacent the top rail 106. The first portion 450D is flush against the faceplate 155 from the top rail 106 to the sole 107 in the cavity 120 of the golf club head 100. The second portion 460D does not engage the faceplate 155. The second portion 460D partially fills and is completely located in the section of the cavity 120 within the lower portion 109 of the body 110. The second portion 460C engages a rear backwall of the cavity 120. In some embodiments, the second portion 460D is formed from a high density material. The golf club head 100 having the multi-material insert 440 offers feel and sound improvements over a tour iron lacking an insert.

In yet another embodiment of the golf club head 100 having a multi-material insert, not shown, the second portion, similar to second portions 460, 460B, 460C, 460D, can be located primarily in the toe 101 of the golf club head 110. This provides a toe weighting effect, acting similar to the toe weight 161, described below. Embodiments with the second portion of the insert acting as a toe weight have no need for an external toe weight. This can improve the aesthetics and simplify manufacturing by eliminating the need for welding in a toe weight.

2) Volume of the Cavity Filled by Insert of the Golf Club Head

As mentioned above, the insert 140 can fully or partially fill the cavity 120 of the golf club head 100. The insert 140 can fill a volume of the cavity 120 between 80% and 100%. In some embodiments, the insert 140 can fill a volume of the cavity 120 between 80% and 85%, 85% and 90%, 90% and 95%, 95% and 100%, 80% and 90%, or 90% and 100%. In embodiments having a multi-material insert, such as insert 440, the first portion 450 can fill a majority of the cavity 120. The second portion 460 can fill the remainder of the cavity 120. In some embodiments, not depicted, the first and second portions together only partially fill the cavity 120. In embodiments having a multi-material insert 440, the first portion 450 can fill between 20% to 90% of the volume of the cavity 120. In some embodiments, the first portion 450 can fill between 20% and 30%, 30% and 40%, 40% and 50%, 50% and 60%, 60% and 70%, 70% and 80%, or 80% and 90%. The second portion 460 can fill between 10% to 80% of the volume of the cavity 120. In some embodiments, the second portion 460 can fill between 10% and 20%, 20% and 30%, 30% and 40%, 40% and 50%.

The volumes of the first and second portions 450, 460 affect the overall weighting of the golf club head 100 because the first and second portions 450, 460 are formed with different materials having different densities, as described in detail below. In the design of a golf club head, many design parameters must be considered together. By forming the insert from multiple materials, the mass placement can be controlled to increase perimeter weighting and lower the CG, leading to improved launch characteristics and higher ball speeds.

3) Tape Layers Combined with Insert in the Golf Club Head

Figure 12:
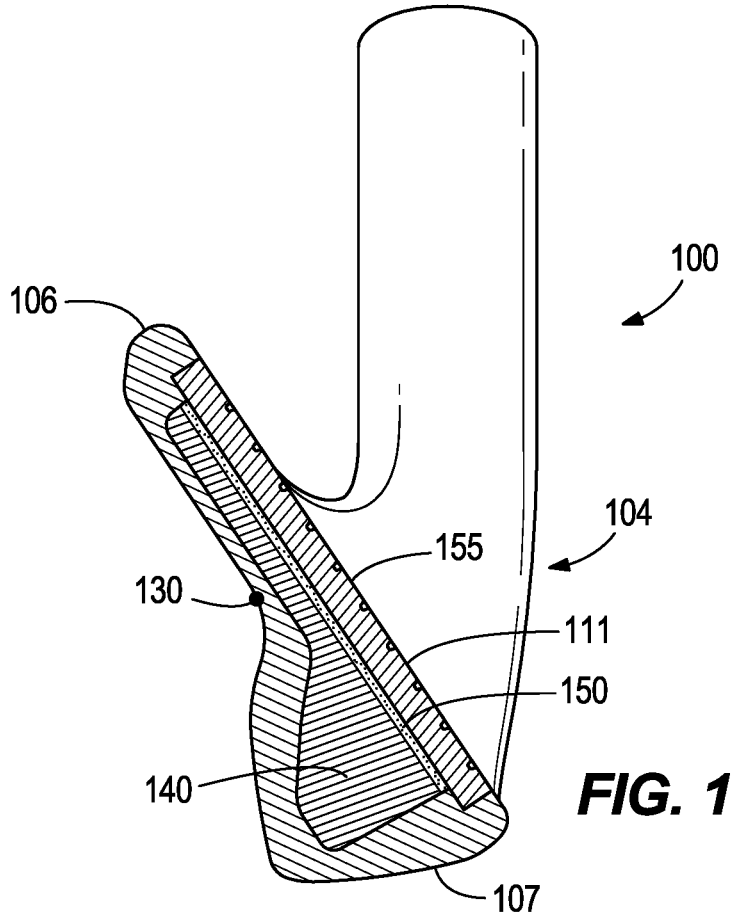
FIG. 12 shows a cross-sectional toe-side view of the golf club head of FIG. 1, along the line V-V in FIG. 3, including a tape layer.

In some embodiments, a tape layer 150 is placed within the cavity 120 between the insert 140 and the strikeface 111. As seen in FIG. 12, the tape layer 150 is sandwiched between the insert 140 and the faceplate 155. Golf club head embodiments having a multi-material insert, such as 440, can similarly comprise a tape layer 150 between the first portion 450 and the faceplate 155 or between the first portion 450 of the insert 440 and the body 110. Within the golf club head 100, the insert 140 fits within the body 110, the tape layer 150 can optionally lay on the insert 140, and the faceplate 155 covers the tape layer 150 and fills the indentation 142 of the body 110.

In some embodiments, not shown, a second tape layer can lie flush with an interior surface of the rear 103 of the body 110 within the cavity 120. The second tape layer can be sandwiched between the rear 103 of the body 110 and the insert 140. In some embodiments, a third tape layer can lie flush at a bottom of the cavity 120. The third tape layer can be sandwiched between the sole 107 of the body 110 and the insert 140. The golf club head 100 can comprise one or more of the first tape layer 150, the second tape layer, and the third tape layer.

The tape layer 150, second tape layer, or third tape layer can comprise a material such as a very high bond (hereafter "VHB") tape. The VHB tape is compressible, such that an original thickness of the tape layer 150 (measured orthogonal to the strikeface 111) when initially provided is greater than a thickness of the compressed tape layer within the assembled golf club head 100. The second and third tape layers can be similarly compressible. The compressible nature of the one or more tape layers reduces the likelihood of rattling caused by manufacturing tolerances between the body 110 and the insert 140. Furthermore, the one or more tape layers can provide vibration damping as well as positively affect the feel and sound of the golf club head 100.

C. Faceplate of the Golf Club Head

The full golf club head 100 is formed by the combination of the body 110, the insert 120, and the faceplate 155. The body 110 comprises an opening of the cavity 120 at the front 104 of the golf club head 100. The opening is covered by the faceplate 155, to entirely enclose the cavity 120 and the insert 140. As shown in FIGS. 2 and 3, the cavity 120 and the insert 140 are not visible from the outside of the golf club head 100 when the insert 140 is positioned within the cavity 120. By concealing the insert 140 within the golf club head 100, the look of the golf club head 100 can resemble the look of traditional tour irons.

Consequently, a portion of the front 104 of the body 110 and the faceplate 155 form the strikeface 111. The strikeface 111 can cover between 70% and 95% of the surface area of the front 104 of the golf club head 100. In some embodiments, the strikeface 111 can cover between 70% and 80%, 75% and 85%, 80% and 90%, or 85% and 95% of the surface area of the front of the golf club head 100. Furthermore, a front surface of the strikeface 111 may comprise one or more grooves. In some embodiments, the grooves extend beyond the edge of the faceplate 155 and onto a portion of the body 110.

The faceplate 155 can comprise a different material than the body 110, as described below. In some embodiments, the material of the faceplate 155 is stronger than the material of the body 110. To exploit the benefits of the faceplate 155 material, the majority of the strikeface 111 is formed by the faceplate 155. The faceplate 155 can form between 50% and 95% of the surface area of the front 104 of the golf club head 100. In some embodiments, the faceplate 155 can form between 50% and 60%, 60% and 70%, 70% and 80%, 80% and 90%, or 85% and 95% of the surface area of the strikeface 111. Despite having different materials, the faceplate 155 and the body 110 portion of the strikeface 111 both give a solid feel because the insert 140 solidly supports the faceplate 155. The body 110, the insert 140, and the faceplate 155 can all contribute to a consistent feel and sound for the golf club head 100 when the golf club head 100 impacts a golf ball on various regions of the faceplate 155.

1) Other Faceplate Characteristics

The support provided to the faceplate 155 by the insert 140 enables a thin faceplate 155 to be used in the golf club head 100. As illustrated in FIG. 5, the faceplate 155 of the golf club head 100 has a thickness 112. The thickness 112 can range between 0.030 inch and 0.100 inch. In some embodiments, the faceplate thickness 112 can be 0.030 inch, 0.040 inch, 0.050 inch, 0.060 inch, 0.070 inch, 0.080 inch, 0.090 inch, or 0.100 inch. The faceplate thickness 112 can be constant across the faceplate 155. In some embodiments, the faceplate thickness 112 can vary in a heel-to-toe direction or in a top rail-to-sole direction. In some embodiments, the faceplate thickness 112 can vary in a radial direction from a center of the faceplate 155.

In other embodiments, the faceplate 155 can further comprise variable thickness regions. In some embodiments, a central region of the faceplate 155 can be thicker than a peripheral region of the faceplate 155. In some embodiments, the thickened central region can comprise an elliptical shape. The thickness of the faceplate 155 can taper from the central towards a periphery of the faceplate 155.

D. Other Peripheral Weights (Tip Weights, Toe Weights) in the Golf Club Head

Figure 13:
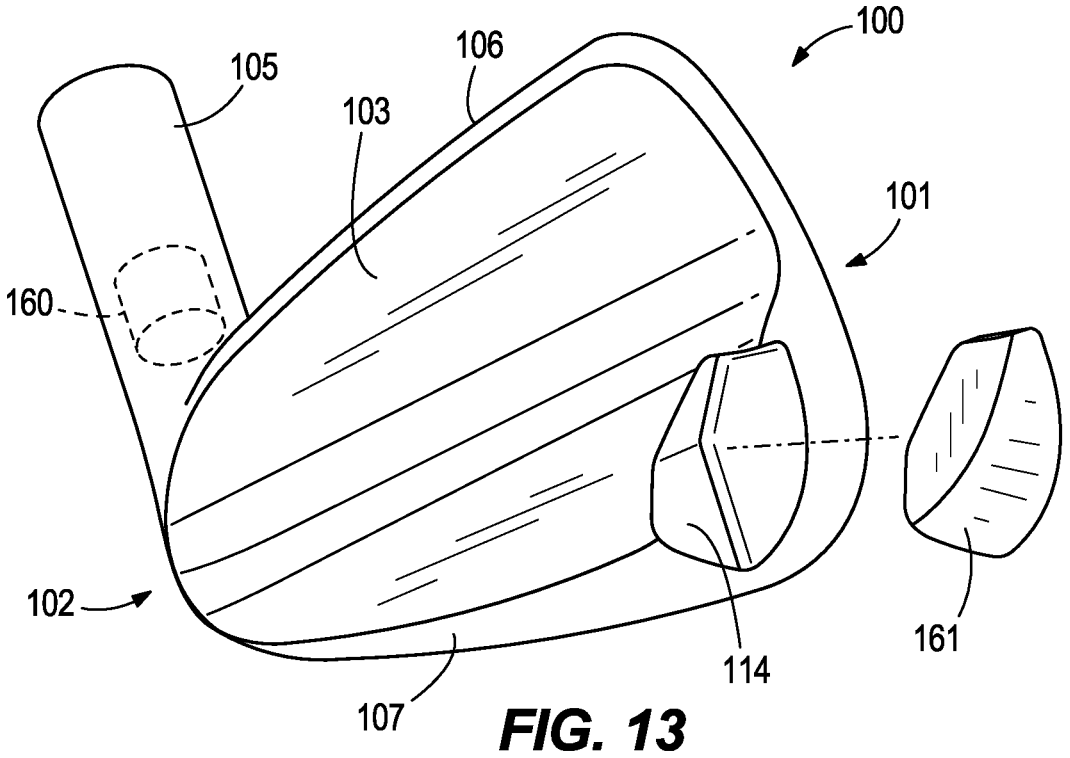
FIG. 13 shows a rear perspective view of the golf club head of FIG. 1, including an exploded view of the toe cavity and toe weight.
Figure 14:
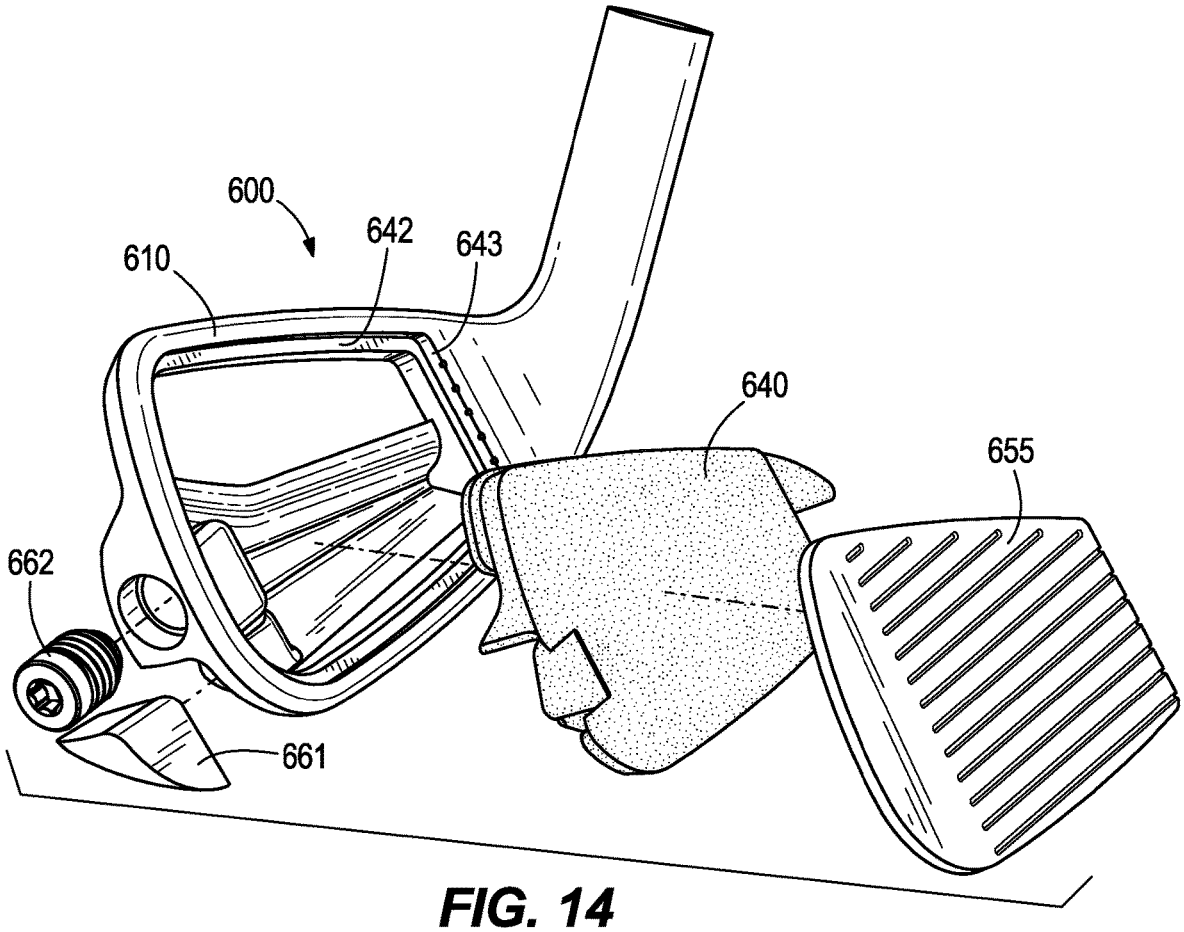
FIG. 14 shows an exploded view of a golf club head, according to a second embodiment.
Figure 15:
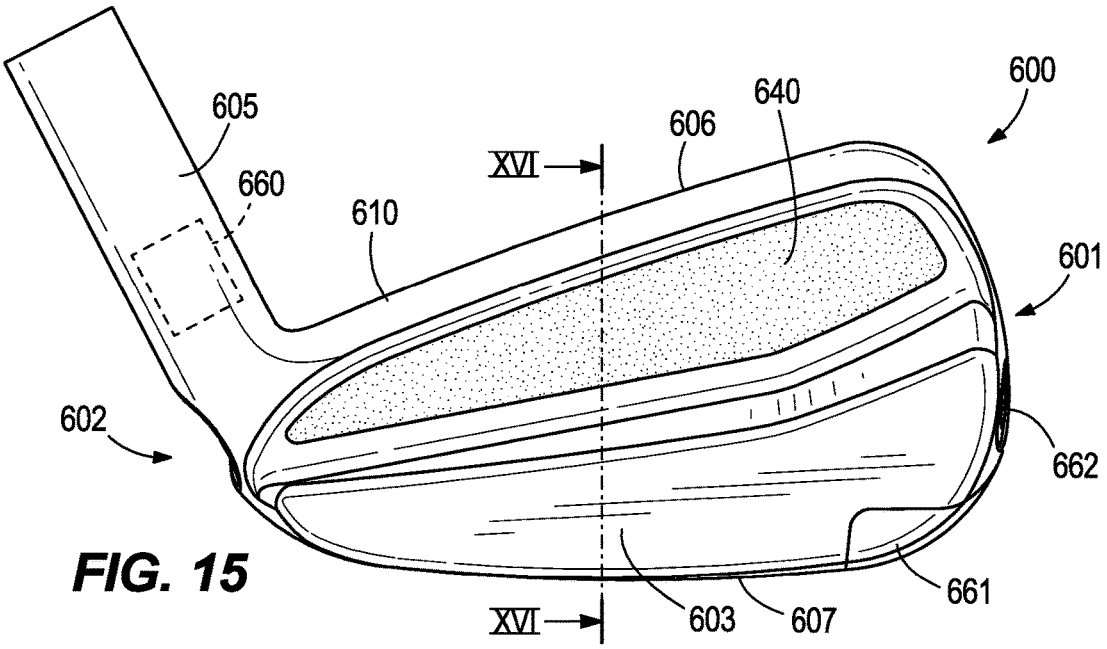
FIG. 15 shows a rear view of the golf club head of FIG. 14.
Figure 16:
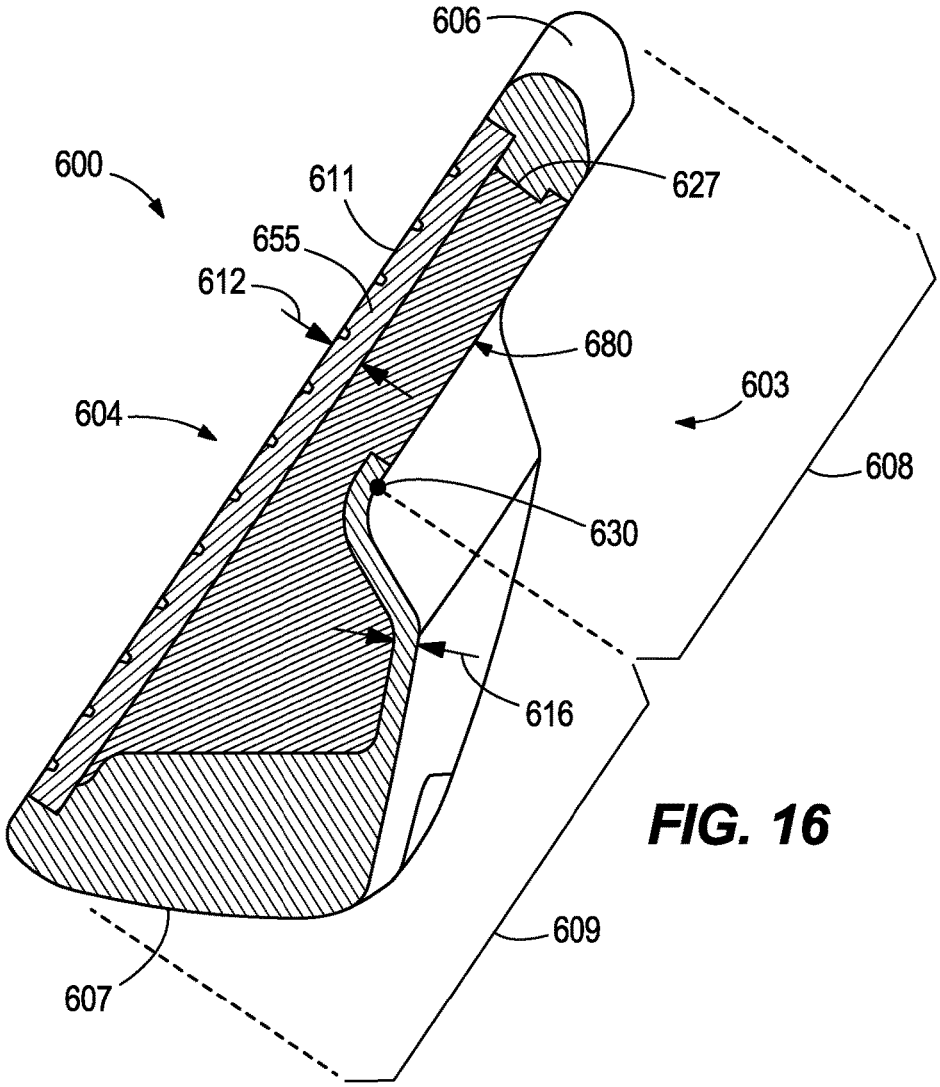
FIG. 16 shows a cross-sectional heel-side view of the golf club head of FIG. 14, along the line XVI-XVI in FIG. 15.

In addition to the perimeter weighting and swing characteristics provided by the insert 140 and the body 110, the golf club head 100 can further comprise other perimeter types of weights. In some embodiments, the golf club head 100 can further comprise a tip weight 160. The tip weight 160 is a weight that fits at the juncture between the hosel 105 and the golf club shaft. The tip weight 160 provides additional perimeter weighting to the club head 100. As illustrated in FIG. 13, the tip weight 160 fits within the hosel 105 of the body 110. The tip weight 160 can by cylindrical, spherical, cube-shaped, or any other suitable shape. The tip weight 160 may be located higher or lower in the hosel 105 than is pictured in FIG. 13.

As illustrated in FIGS. 1 and 13, the body 110 of the golf club head 100 can further comprise a toe cavity 114. The toe cavity 114 is designed to house a toe weight 161, which improves the perimeter weighting and swing characteristics of the golf club head 100. FIG. 3 illustrates the toe cavity 114 with the toe weight 161 installed. FIG. 13 illustrates the toe weight 161 removed from the toe cavity 114. In some embodiments, the toe cavity 114 is located partially in the sole 107 and partially in the toe 101. In some embodiments, the toe cavity 114 is located fully in the toe 101 of the golf club head 100, adjacent the sole 107. In some embodiments, the toe cavity 114 is located completely in the sole 107, adjacent the toe 101. In some embodiments, the toe cavity 114 is located completely in the toe 101. In some embodiments, the toe cavity 114 is located in the center of the toe 101, approximately half way between the top rail 106 and the sole 107.

In some embodiments, the toe cavity 114 is visible from the rear view of the body 110 of the club head 100. In other embodiments, the toe cavity 114 is not visible from the rear view of the body 110. In some embodiments, the toe cavity 114 is visible from the toe-side view of the body 110. In other embodiments, the toe cavity 114 is not visible from the toe-side view of the body 110. In some embodiments, the toe cavity 114 is visible from the sole view of the body 110. In other embodiments, the toe cavity 114 is not visible from the sole view of the body 110. In the embodiment of FIGS. 1-13, the toe cavity 114 is visible from the rear view, the sole view, and the toe-side view.

The toe weight 161 is shaped to match the contours of the toe cavity 114 of the body 110. An external wall of the toe weight 161 is designed follow the curve of the golf club head body 110. In some embodiments, the mass of the toe weight 161 can be between 5% and 45% of the mass of the body 110. In some embodiments, the mass of the toe weight 161 can be between 5% and 20%, 5% and 15%, 10% and 20%, 15% and 25%, 20% and 40%, 20% and 30%, 30% and 40%, or 35% and 45% of the mass of the body 110.

In some embodiments, the body 110 of the golf club head 100 can further comprise a toe screw weight port, not depicted, in the toe 101. The golf club head 100 can further comprise a toe screw weight that fits within the screw weight port. In some embodiments, the toe screw weight can comprise a weight between 2 grams and 15 grams, as described below. A screw weight having one weight value can be exchanged for a different screw weight having a different weight value in order to customize the golf club head 100 to a golfer's swing.

In some embodiments, there is a combination of weights as described above including the insert, toe weight, tip weight, and the toe screw weight. Other embodiments can comprise a multi-material insert combined with one or more of a toe weight, a tip weight, and a toe screw weight.

E. Materials

The materials that form the body 110, the insert 140, and the faceplate 155 affect the mass distribution of the golf club head 100. Consequently, the MOI and CG of the golf club head 100 are also affected by the densities of the materials. Furthermore, the materials provide the strength and flexibility necessary for the golf club head 100. The golf club head 100 comprises one or more, two or more, three or more, or four or more materials. In some embodiments, the materials may be a first density, second density, third density, fourth density, fifth density or sixth density.

In some embodiments, the faceplate 155 can comprise a first material of a first density. The body 110 can comprise a second material of a second density. The insert 140 can comprise a third material of a third density. The third density can be less than the first density and/or the second density. In some embodiments, the faceplate 155 can be the same material as the body 110 (and thereby the same densities). As discussed above and in some embodiments, the insert 440 can comprise two or more materials wherein the materials are a different density over each other, and can be different or the same over the materials of the faceplate 155 and/or the body 110.

1) Body Materials

The body 110 may comprise a material, such as steel, a steel alloy, or any other suitable material. In some embodiments, the body 110 can comprise a material of a density that is different over the faceplate 155 and the insert 140. The material can comprise a material selected from the group consisting of a steel-based material or a steel alloy. In some embodiments, the body material can be 8620 carbon steel, which comprises iron and approximately 0.17-0.23% wt. carbon, 0.15-0.35% wt. silicon, 0.60-0.90% wt. manganese, 0.15-0.30% wt. molybdenum, 0.40-0.70% wt. nickel, 0.40-0.65% wt. chromium, 0.040% wt. phosphorus, and trace amounts of other elements. In some embodiments, the body material can be 300 grade steel, which comprises iron and approximately 18-19% wt. nickel, 8.5-9.5% wt. cobalt, 4.6-5.2% wt. molybdenum, 0.5-0.8% wt. titanium, 0.05-0.15% wt. aluminum, and trace amounts of other elements. In some embodiments, the body material can be maraging steel, which comprises iron and approximately 17-19% wt. nickel, 8-12.5% wt. cobalt, 3.0-5.2% wt. molybdenum, 0.15-1.6% wt. titanium, 0.05-0.15% wt. aluminum, and trace amounts of other elements. The density of the body 110 material can range between 7.70 and 8.10 grams per cubic centimeter (hereafter "g/cc"). In some embodiments, the density of the body material can be 7.70 g/cc, 7.75 g/cc, 7.80 g/cc, 7.85 g/cc, 7.90 g/cc, 7.95 g/cc, 8.05 g/cc, or 8.10 g/cc. In one embodiment, the density of the body material is 7.85 g/cc.

2) Insert Materials

The insert 140 comprises a material, such as titanium, a titanium alloy, aluminum, an aluminum alloy, an elastomer, a polymer matrix composite, any other suitable low density material, or any other suitable density material that is lower than the body 110 material. The aluminum alloy can be high strength aluminum alloy, or a composite aluminum alloy coated with a high-strength alloy. The polymer matrix composite can be a glass-filled elastomer, a stainless steel-filled elastomer, a tungsten-filled elastomer, a thermoplastic polyurethane (TPU), a thermoplastic elastomer (TPE), or any other elastomer matrix composite, a Kevlar® (aramid) fiber-reinforced polymer, a carbon-fiber reinforced polymer, or any combination of a suitable resin and a suitable reinforcing fiber. The polymer matrix composite material can be an elastomer matrix composite. In some embodiments the metal material can be a steel-based material, a titanium-based material, an aluminum alloy, a titanium alloy, or any combination thereof. The steel-based material can be a 17-4 PH stainless steel, 431, 455, 475, C300, a maraging steel, or other types of stainless steel. The aluminum alloy can be high strength aluminum alloy, or a composite aluminum alloy coated with a high-strength alloy. The titanium alloy can be Ti-9S, Ti-6-4, and Ti-15-3-3-3. The titanium alloy can be an $\alpha$-$\beta$ titanium alloy.

The insert 140 may comprise a material of a density that is different over the body 110 and the faceplate 155. Suitable materials for the insert 140 can include any materials that have a density lower than the density of the body material. In some embodiments, particularly ones with a metal insert material, the density of the insert 140 material can range between 2.4 to 5.0 g/cc. In some embodiments, the density of the insert 140 material can be 2.4 g/cc, 2.5 g/cc, 2.6 g/cc, 2.7 g/cc, 2.8 g/cc, 2.9 g/cc, 3.0 g/cc, 3.1 g/cc, 3.2 g/cc, 3.3 g/cc, 3.4 g/cc, 3.5 g/cc, 3.6 g/cc, 3.7 g/cc, 3.8 g/cc, 3.9 g/cc, 4.0 g/cc, 4.1 g/cc, 4.2 g/cc, 4.3 g/cc, 4.4 g/cc, 4.5 g/cc, 4.6 g/cc, 4.7 g/cc, 4.8 g/cc, 4.9 g/cc, or 5.0 g/cc. In one embodiment, the insert 140 material is aluminum and the density of the insert 130 material is approximately 2.7 g/cc. In another embodiment, the insert 140 material is titanium and the density of the insert 140 material is approximately 4.5 g/cc.

In some embodiments, particularly ones with a polymer matrix composite material, the density of the insert 140 can range between 1.0 and 12.0 g/cc. In polymer matrix composite material preferred embodiments, the density of the insert 140 can range between 1.0 g/cc and 5.0 g/cc. In some embodiments, the density of the insert 140 can be 1.0 g/cc, 1.5 g/cc, 2.0 g/cc, 2.5 g/cc, 3.0 g/cc, 3.5 g/cc, 4.0 g/cc, 4.5 g/cc, or 5.0 g/cc. When the density of the insert 140 is low, a central portion of the club head that houses the insert 140 is lighter, allowing weight to be redistributed to the periphery of the club head. The redistributed weight increases the MOI.

In some embodiments of the golf club head 100, the insert 440 comprises distinct portions formed from different materials and different densities. In some embodiments, the first and second portions 450, 460 of the insert 440 can each be formed from any of the materials mentioned above for the single-material insert. In some embodiments, the first portion 450 of the insert 140 is formed from an elastomer or polymer matrix composite material, comprising a density between 0.8 g/cc and 1.4 g/cc, and the second portion 460 of the insert 440 is formed from aluminum or an aluminum alloy, comprising a density between 1.5 g/cc and 3.0 g/cc.

In some embodiments of the golf club head 100, the first portion 450 of the insert 440 can comprise any of the material mentioned above having a density between 1.0 g/cc and 12.0 g/cc. In some embodiments, the second portion 460 of the insert 440 can comprise a material that has a density higher than the density of the body material. In some embodiments, the second portion 460 of the insert 440 can be a weight portion comprising any of the materials described below for the toe weight 161 and having a density between 14.0 and 19.6 g/cc. In some of these embodiments, the toe weight 161 is not necessary, because the second portion 460 of the insert 140 serves a similar purpose.

The weight of the insert 140 or 440 can range between 10 grams and 50 grams. In some embodiments, the weight of the insert 140 can be 10 grams, 11 grams, 12 grams, 13 grams, 14 grams, 15 grams, 16 grams, 17 grams, 18 grams, 19 grams, 20 grams, 21 grams, 22 grams, 23 grams, 24 grams, 25 grams, 26 grams, 27 grams, 28 grams, 29 grams, 30 grams, 31 grams, 32 grams, 33 grams, 34 grams, 35 grams, 36 grams, 37 grams, 38 grams, 39 grams, 40 grams, 41 grams, 42 grams, 43 grams, 44 grams, 45 grams, 46 grams, 47 grams, 48 grams, 49 grams, or 50 grams. In multi-material insert embodiments where the second portion 460 of the insert comprises a material similar to the material of the toe weight 161 described below, the insert 140 or 440, and the weight of the insert 140 or 440 can range between 10 grams and 70 grams. In some embodiments, the weight of the multi-material insert 140 or 440 can be between 10 grams and 20 grams, 20 grams and 30 grams, 30 grams and 40 grams, 40 grams and 50 grams, 50 grams and 60 grams, or 60 grams and 70 grams.

Furthermore, the insert 140 and 440 provides structural support to the strikeface 111. For embodiments having a metal insert material, the insert 140 or 440 or a portion of the insert 140 or 440 can comprise a Rockwell B hardness between 30 HRB and 100 HRB. In some embodiments, the insert 140 or 440 or a portion of the insert 140 or 440, can have Rockwell B hardness between 30 HRB and 40 HRB, 40 HRB and 50 HRB, 50 HRB and 60 HRB, 60 HRB and 70 HRB, 70 HRB and 80 HRB, 80 HRB and 90 HRB, 90 HRB and 100 HRB. In other embodiments the insert 140 or a portion of the insert 140 can have a Rockwell B hardness of 30 HRB, 31 HRB, 32 HRB, 33 HRB, 34 HRB, 35 HRB, 36 HRB, 37 HRB, 38 HRB, 39 HRB, 40 HRB, 41 HRB, 42 HRB, 43 HRB, 44 HRB, 45 HRB, 46 HRB, 47 HRB, 48 HRB, 49 HRB, 50 HRB, 51 HRB, 52 HRB, 53 HRB, 54 HRB, 55 HRB, 56 HRB, 57 HRB, 58 HRB, 59 HRB, 60 HRB, 61 HRB, 62 HRB, 63 HRB, 64 HRB, 65 HRB, 66 HRB, 67 HRB, 68 HRB, 69 HRB, 70 HRB, 71 HRB, 72 HRB, 73 HRB, 74 HRB, 75 HRB, 76 HRB, 77 HRB, 78 HRB, 79 HRB, 80 HRB, 81 HRB, 82 HRB, 83 HRB, 84 HRB, 85 HRB, 86 HRB, 87 HRB, 88 HRB, 89 HRB, 90 HRB, 91 HRB, 92 HRB, 93 HRB, 94 HRB, 95 HRB, 96 HRB, 97 HRB, 98 HRB, 99 HRB, or 100 HRB. For other embodiments having a metal insert the insert 140 or 440 or a portion of the insert 140 or 440 can comprise a Rockwell C hardness between 30 HRC and 60 HRC. In some embodiments, the insert 140 or 440 can have a hardness between 30 HRC and 40 HRC, 35 HRC and 45 HRC, 40 HRC and 50 HRC, 45 HRC and 50 HRC, or 50 HRC and 60 HRC. In other embodiments, the insert can have a Rockwell C hardness of 30 HRC, 31 HRC, 32 HRC, 33 HRC, 34 HRC, 35 HRC, 36 HRC, 37 HRC, 38 HRC, 39 HRC, 40 HRC, 41 HRC, 42 HRC, 43 HRC, 44 HRC, 45 HRC, 46 HRC, 47 HRC, 48 HRC, 49 HRC, 50 HRC, 51 HRC, 52 HRC, 53

HRC, 54 HRC, 55 HRC, 56 HRC, 57 HRC, 58 HRC, 59 HRC, or 60 HRC. For some embodiments comprising a titanium or titanium alloy insert 140 or 440, the insert hardness is 44 HRC.

3) Faceplate Materials

The faceplate 155 can be formed from a faceplate material. In some embodiments, the faceplate material is the same material as the body 110 material. In other embodiments, the faceplate material is a different material than the body material. In some embodiments, the faceplate 155 can comprise a material of a density that is different over the body 110 and the insert 140.

The faceplate material can be a steel-based material, a titanium-based material, a titanium alloy, or any combination thereof. The steel-based material can be a carbon steel, a 17-4 PH stainless steel, 431, 455, 475, C300, a maraging steel, or other types of stainless steel. The titanium alloy can be Ti-7S+(ST721), Ti-9S, Ti-6-4, Ti-15-3-3-3, or any other suitable titanium alloy. The titanium alloy may be an $\alpha$-$\beta$ titanium alloy. In embodiments where the faceplate 155 is a titanium-based material, an aluminum alloy, a titanium alloy, or any combination thereof, the density of the faceplate 155 material can range between 2.6 and 8.7 g/cc. In some embodiments, the density of the faceplate material can be 2.6 g/cc, 2.8 g/cc, 3.0 g/cc, 3.2 g/cc, 3.4 g/cc, 3.6 g/cc, 3.8 g/cc, 4.0 g/cc, 4.2 g/cc, 4.4 g/cc, 4.6 g/cc, 4.8 g/cc, 5.0 g/cc, 5.2 g/cc, 5.4 g/cc, 5.6 g/cc, 5.8 g/cc, 6.0 g/cc, 6.2 g/cc, 6.4 g/cc, 6.6 g/cc, 6.8 g/cc, 7.0 g/cc, 7.2 g/cc, 7.4 g/cc, 7.6 g/cc, 7.8 g/cc, 8.0 g/cc, 8.2 g/cc, 8.4 g/cc, 8.6 g/cc, or 8.7 g/cc. In embodiments where the faceplate 155 is a steel-based material, the density of the faceplate material can range between 7.7 g/cc and 8.1 g/cc.

4) Tip Weight Material

The tip weight 160 can comprise a material that is different over the material of the body 110, faceplate 155, and the insert 140 or 440. The tip weight 160 comprises a high-density material, such as tungsten or any other suitable metal or metal alloy material. The density of the tip material 160 can range between 1.1 g/cc and 19.6 g/cc. In some embodiments, the density of the tip weight 160 material can be 1.1 g/cc, 1.5 g/cc, 2.0 g/cc, 2.5 g/cc, 3.0 g/cc, 3.5 g/cc, 4.0 g/cc, 4.5 g/cc, 5.0 g/cc, 5.5 g/cc, 6.0 g/cc, 6.5 g/cc, 7.0 g/cc, 7.5 g/cc, 8.0 g/cc, 8.5 g/cc, 9.0 g/cc, 9.5 g/cc, 10.0 g/cc, 10.5 g/cc, 11.0 g/cc, 11.5 g/cc, 12.0 g/cc, 12.5 g/cc, 13.0 g/cc, 13.5 g/cc, 14.0 g/cc, 14.5 g/cc, 15.0 g/cc, 15.5 g/cc, 15.8 g/cc, 16.0 g/cc, 16.2 g/cc, 16.4 g/cc, 16.6 g/cc, 16.8 g/cc, 17.0 g/cc, 17.2 g/cc, 17.4 g/cc, 17.6 g/cc, 17.8 g/cc, 18.0 g/cc, 18.2 g/cc, 18.4 g/cc, 18.6 g/cc, 18.8 g/cc, 19.0 g/cc, 19.2 g/cc, 19.4 g/cc, or 19.6 g/cc. The weight of the tip weight 160 can range between 0 grams and 18 grams. In some embodiments, the weight of the tip weight 160 can be 0 grams (in the embodiment where there is no tip weight), 1 grams, 2 grams, 3 grams, 4 grams, 5 grams, 6 grams, 7 grams, 8 grams, 9 grams, 10 grams, 11 grams, 12 grams, 13 grams, 14 grams, 15 grams, 16 grams, 17 grams, or 18 grams. In most embodiments, the tip weight 160 ranges between 0 grams and 9 grams.

5) Toe Weight Material

The toe weight 161 can comprise a material that is different over the material of the body 110, faceplate 155, the tip weight 160, and the insert 140 or 440. The toe weight 161 comprises a high-density material, such as tungsten or any other suitable metal or metal alloy material. The density of the toe weight 161 material can range between 14.0 and 19.6 g/cc. In some embodiments, the density of the toe weight 161 material can be 14.0 g/cc, 14.2 g/cc, 14.4 g/cc, 14.6 g/cc, 14.8 g/cc, 15.0 g/cc, 15.2 g/cc, 15.4 g/cc, 15.6 g/cc, 15.8 g/cc, 16.0 g/cc, 16.2 g/cc, 16.4 g/cc, 16.6 g/cc, 16.8 g/cc, 17.0 g/cc, 17.2 g/cc, 17.4 g/cc, 17.6 g/cc, 17.8 g/cc, 18.0 g/cc, 18.2 g/cc, 18.4 g/cc, 18.6 g/cc, 18.8 g/cc, 19.0 g/cc, 19.2 g/cc, 19.4 g/cc, or 19.6 g/cc. The weight of the toe weight 161 can range between 10 grams and 40 grams. In some embodiments, the weight of the toe weight 161 can be 10 grams, 11 grams, 12 grams, 13 grams, 14 grams, 15 grams, 16 grams, 17 grams, 18 grams, 19 grams, 20 grams, 21 grams, 22 grams, 23 grams, 24 grams, 25 grams, 26 grams, 27 grams, 28 grams, 29 grams, 30 grams, 31 grams, 32 grams, 33 grams, 34 grams, 35 grams, 36 grams, 37 grams, 38 grams, 39 grams, and 40 grams. In some embodiments, the weight of the toe weight 161 can range between 12 grams and 26.5 grams.

6) Toe Screw Weight Material

The toe screw weight (swing weight) can comprise any high-density material similar to the high-density materials of the tip weight or the toe weight. The density of the toe screw material can be similar to the density of the tip weight materials. The weight of the toe screw weight can be similar to the weight of the tip weight, described above.

II. Golf Club Head with Rear Opening

Described herein is a golf club head 600. Like golf club head 100, golf club head 600 can be a tour style golf club head with forgiveness as discussed above. The golf club head 100 can comprises a body 610 having a cavity 620 that houses an insert 640. The golf club head 600 comprises a faceplate 655, a body 610, and an insert 640. The body 610 comprises an upper portion 608, a lower portion 609, a sole 607, a rear 603, and a top rail 606. The rear 603 can further comprise an inflection seam 630. The inflection seam 630 is the boundary between the upper portion 608 and lower portion 609 of the golf club head 600. The faceplate 655 and a portion of the body define a strikeface 611 (striking surface) of the golf club head. The faceplate 655, the sole 607, the rear 603, and the top rail 606 enclose a cavity 620.

FIGS. 14-23 depict a golf club head 600 similar to golf club head 100. The golf club head 600 comprises a body 610 forming a cavity 620, a faceplate 655, a rear opening 680 and a low-density insert 640 in the cavity. The body 610 comprises an upper portion 608, a lower portion 609, a sole 607, a rear 603, and a top rail 606. The rear 603 can further comprise an inflection seam 630. The inflection seam 630 is the boundary between the upper portion 608 and lower portion 609 of the golf club head 600. The faceplate 655 and a portion of the body 610 define a strikeface 611 (striking surface) of the golf club head 600.

The body 610 is similar to body 110. The faceplate 655, the sole 607, and the rear 603 form a cavity 620 with a rear opening 680 in the upper portion 608 of the golf club head 600. The rear opening 680 of the body 610 partially exposes the cavity 620. After assembly, the insert 640 is visible through the opening 680 in the rear 603. The body 610 further comprises an indentation 642 in the front 604 of the body 610 for receiving the faceplate 655 similar to the indentation 142 described above for club head 100.

The insert 640 harbors within the cavity 620. The insert 640 can comprise a non-metal or polymer based material. The insert material can be injected into the cavity 620 of the golf club head 600 through the rear opening 680 to form the insert 640 within the cavity 620. In other embodiments, the insert 640 can comprise a metal material, similar to the insert 140 described above. The faceplate 655 encloses the cavity 620 at a front 604 of the golf club head 600. The faceplate 655 and a front 604 of the body 610 together define a strikeface 611.

The golf club head 600 is a tour iron club head, and has a volume between 1.8 cubic inches and 2.7 cubic inches (30 cubic centimeters (cc) and 45 cc). The body 610 of the golf club head 600 can be cast or forged from a metal material.

The insert 640 comprises a low-density material and fills the cavity 620 formed by the body 610 of the golf club head 600. Reducing mass in the center of the golf club head 600 allows extra mass to be concentrated at its perimeter to increase moment of inertia values of the golf club head 600. As discussed above, the golf club head 600 comprises a lower portion 609 and an upper portion 608. The lower portion 609 comprises a depth greater than the upper portion 608. The lower portion 609 thereby has more mass concentrated on the peripheral heel 602, toe 601, and the sole 607. Lowering the mass of the body 610 results in a low CG 60, which increases launch angle, reduces spin, and increases ball speed. As introduced above, there is a need in the art for an iron that couples tour iron sizing with a comparatively high moment of inertia from perimeter weighting and a low CG from low positioning of mass. In some embodiments, a tip weight 660 positioned in the hosel and/or a toe weight 661 positioned in a toe cavity 614 of the body 610 provide additional perimeter weighting. In some embodiments, a toe screw weight 662 (swing weight) positioned in a toe screw weight cavity 663 (swing weight cavity) of the body 610 provides additional perimeter weighting.

The golf club head 600 can be described with the same reference planes and axes as golf club head 100. The definitions of the ground plane 10, loft plane 20, centerplane 45, centerpoint 80, lead edge axis 35, lead edge plane, x-axis 30, y-axis 40, z-axis 50, and hosel axis 70 remain the same for golf club head 600 as for golf club head 100.

A. Parts of the Golf Club Head

As discussed above and illustrated in FIGS. 15 and 16, the body 610 comprises at least an upper portion 608, a lower portion 609, a sole 607, a top rail 606, a rear 603, a front 604, a toe 601, a heel 602, and a hosel 605 respectively similar to the upper portion 108, the lower portion 109, sole 107, top rail 106, rear 103, front 104, toe 101, heel 102, and hosel 605 of golf club head 100. In some embodiments, the faceplate 655 that is welded or swedged (swagged) over the front opening of the body 610.

The body 610 comprises an inflection seam 630 and rear contours similar to the inflection seam 130 and rear contours of golf club head 100. The heights of the upper and lower portions 608, 609, the depths of the upper and lower portions 608, 609, and the thickness of the rear 603 are similar to the heights of the upper and lower portions 108, 109, the depths of the upper and lower portions 108, 109, and the thickness of the rear 103 of golf club head 100.

The body 610 further comprises an opening wall 682 in the rear of the body 610. The opening wall 682 defines the rear opening 680. The rear opening 680 of the body 610 is located in upper portion 608 of the club head 600, which is above the inflection seam 630. The uniform depth of the upper portion 608 in conjunction with the location of the rear opening 680 fully in the upper portion 608 allows for a flat surface surrounding the opening 680. On all sides of the opening wall 682 of the body 610 (the rear opening 680), an exterior surface of the golf club head 600 is planar. This planar surface is necessary to provide a seal around the rear opening 680 during injection of the insert material into the cavity 620 during manufacturing, as described further below.

To identify the size of the rear opening 680, a projected area can be taken of the rear 603 (not including the hosel 605 or the sole 607), parallel to the loft plane 20. The projected area of the rear 603 can be compared to the projected area circumscribed by the opening wall 682. The opening wall 682 circumscribes (the rear opening covers) an area between 25% and 50% of a projected area of a rear 603 of the club head 600. In some embodiments, the opening wall 682 can circumscribe a percent of the rear area between 25% and 30%, 25% and 35%, 30% and 40%, 35% and 45%, 40% and 50%, or 45% and 50%. In other embodiments, the opening wall 682 can circumscribe a percent of the rear area of 25%, 26%, 27%, 28%, 29%, 30%, 31%, 32%, 33%, 34%, 35%, 36%, 37%, 38%, 39%, 40%, 41%, 42%, 43%, 44%, 45%, 46%, 47%, 48%, 49%, or 50%.

In some embodiments, the insert 640 is visible through the rear opening 680. In some embodiments, between 10% and 60% of the insert can be visible through the rear opening 680. In some embodiments, between 10% and 20%, 15% and 25%, 20% and 30%, 25% and 35%, 30% and 40%, 35% and 45%, 40% and 50%, 45% and 55%, or 50% and 60% of the insert 640 can be visible through the rear opening 680. In some embodiments, a badge, not shown, is placed over the rear opening 680. In these embodiments, the badge can cover between 10% and 60% of the insert. In some embodiments, the badge can cover between 10% and 20%, 15% and 25%, 20% and 30%, 25% and 35%, 30% and 40%, 35% and 45%, 40% and 50%, 45% and 55%, or 50% and 60% of the insert 640.

The rear 603 with an opening wall 682 defining a rear opening 680 contributes to a low mass of the upper portion 608. Filling the rear opening 680 with a material having a density lower than the density of the body material results in a golf club head 600 having a low CG. Reducing the mass of the upper portion 608 both lowers CG and allows weight to be distributed to the perimeter to improve the golf club head's forgiveness. Various design parameters can contribute to a low mass of the upper portion. As described above for golf club head 100, the keeping a uniform upper portion depth also contributes to a low mass of the upper portion 608.

Since the material used to form the body 610 generally has a higher density than the material of the insert 640, the mass of the upper portion 608 can be reduced by replacing the portion of the rear body 610 circumscribed by the opening wall 682 with insert material. When compared to a similar golf club head having a solid rear formed fully from a body material, the golf club head 600 comprises a lower CG because of the rear opening 680. The percent projected area of the opening 680 and the density of the insert material can reduce the mass of the upper portion 608 by between 1 gram and 17 grams. In some embodiments, the mass of the upper portion 608 can be reduced by between 1 gram and 3 grams, 3 grams and 5 grams, 5 grams and 7 grams, 7 grams and 9 grams, 9 grams and 11 grams, 11 grams and 13 grams, 13 grams and 15 grams, or 15 grams and 17 grams. In other embodiments, the mass of the upper portion 608 can be reduced by 1 gram, 2 grams, 3 grams, 4 grams 5 grams, 6 grams, 7 grams, 8 grams, 9 grams, 10 grams, 11 grams, 12 grams, 13 grams, 14 grams, 15 grams, 16 grams, or 17 grams. This reduction in the mass of the upper portion 108 of the body 610 assists in lowering the CG, improving launch and spin characteristics and increasing ball speed.

The body 610 of the golf club head 600 defines the cavity 620. The cavity 620 of the body 610 can be configured to receive a low-density insert 640 that increases the MOI of the golf club head 600 without sacrificing the desirable solid feel of a tour iron. The regions, volumes, and contours of the cavity 620 are similar to the regions, volumes, and contours of cavity 120. Adjacent a front opening of the cavity 620, the body 610 comprises an internal peripheral edge 627, similar to the internal peripheral edge 127 of golf club head 100. The sole 607, the top rail 606, the rear 603, the internal peripheral edge 627, and the faceplate 655 define the cavity 620. The cavity 620 both connects to the rear opening 680 of the body 610 and is enclosed at the front 604 of the body 610 by the faceplate 655. The cavity 620 is exposed through the rear opening 680 of the rear 603 of the body 610.

B. Insert of the Golf Club Head

The insert 640 is configured to fit within the cavity 620 of the body 610 in order to increase the MOI and retain the solid feel of the golf club head 600. The volume of the insert 640 can be similar to the volume of the insert 140 of golf club head 100. In some embodiments, the volume of the insert 640 can be greater than the volume of the cavity 620 because the insert 640 extends beyond the cavity 620 into the rear opening 680.

Figure 19:
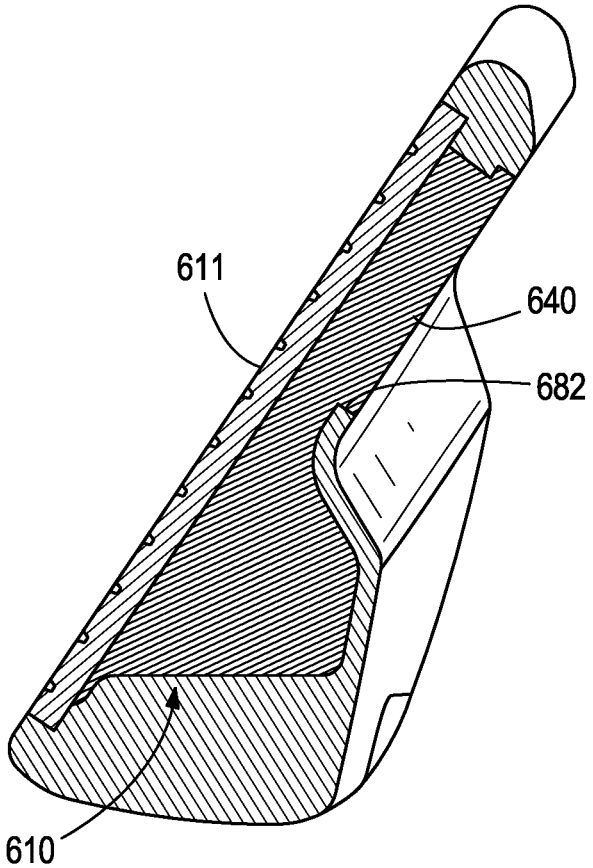
FIG. 19 shows a cross-sectional heel-side view of the golf club head of FIG. 14, along the line XVI-XVI in FIG. 15.
Figure 20:
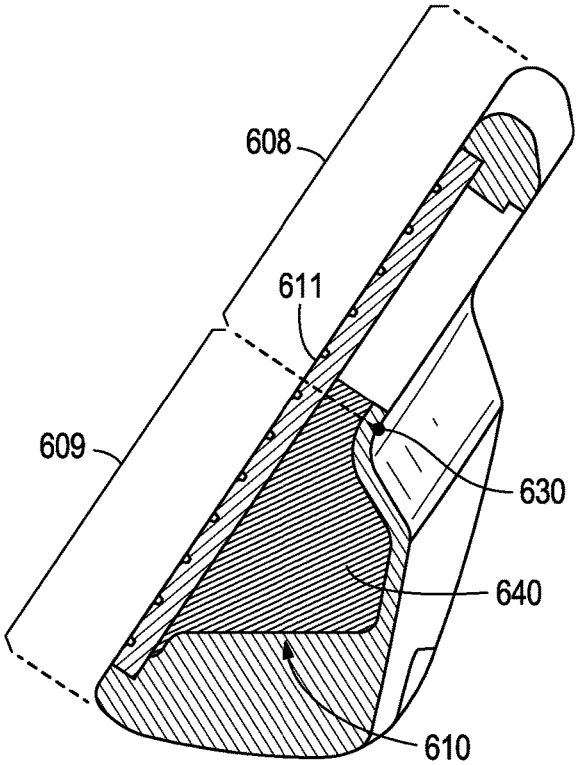
FIG. 20 shows a cross-sectional heel-side view of the golf club head of FIG. 14, along the line XVI-XVI in FIG. 15, according to a first embodiment with a partial-fill insert.
Figure 21:
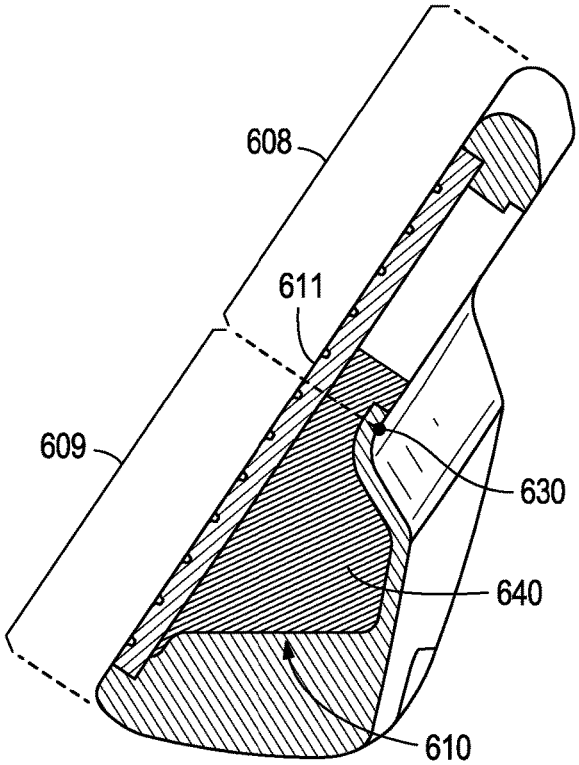
FIG. 21 shows a cross-sectional heel-side view of the golf club head of FIG. 14, along the line XVI-XVI in FIG. 15, according to a second embodiment with a partial-fill insert.
Figure 22:
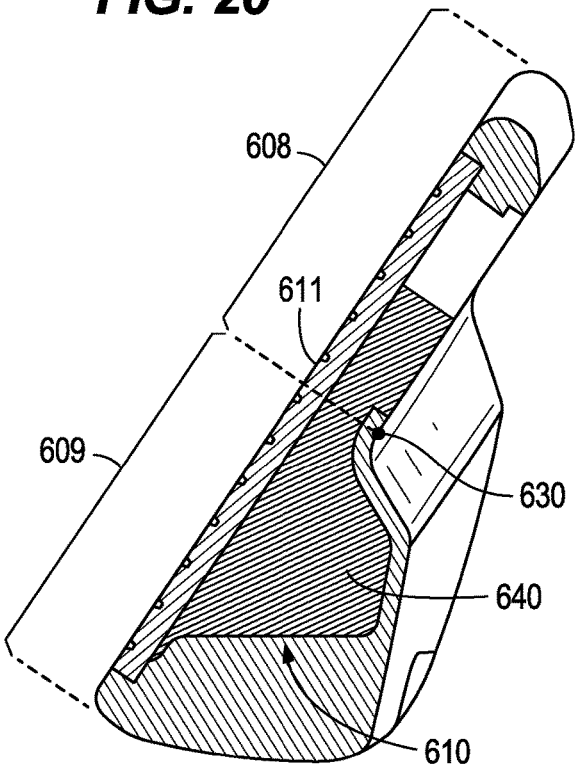
FIG. 22 shows a cross-sectional heel-side view of the golf club head of FIG. 14, along the line XVI-XVI in FIG. 15, according to a third embodiment with a partial-fill insert.
Figure 23:
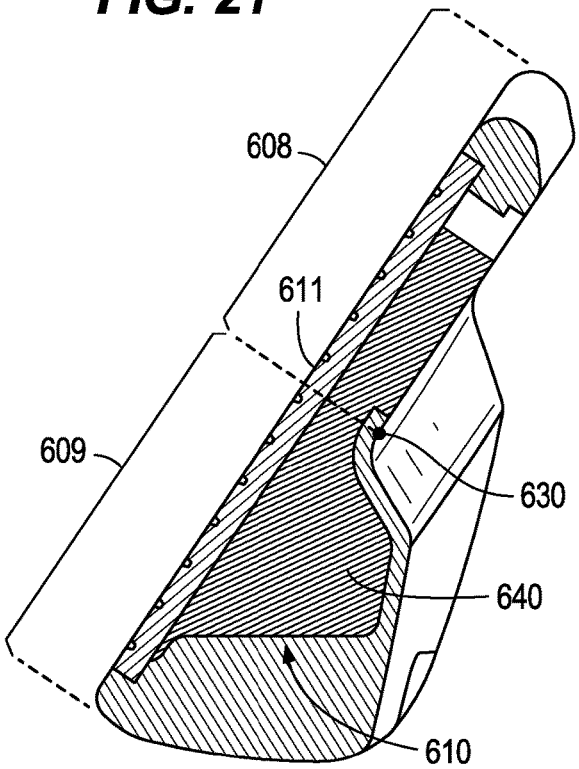
FIG. 23 shows a cross-sectional heel-side view of the golf club head of FIG. 14, along the line XVI-XVI in FIG. 15, according to a fourth embodiment with a partial-fill insert.

The insert 640 completely fills or partially fill the cavity 620, as described above for golf club head 100. The insert 640 can fill a percent volume of the cavity 620, as described for golf club head 100. In some embodiments, as illustrated in FIG. 19, the insert 640 can fill 100% of the cavity 620 and extend into the rear opening 680. As illustrated in FIG. 20, the insert 640 can fill 60% of the cavity 620. As illustrated in FIG. 21, the insert 640 can fill 70% of the cavity 620 and extend partially into the rear opening 680. As illustrated in FIG. 22, the insert 640 can fill 80% of the cavity 620 and extend partially into the rear opening 680. As illustrated in FIG. 23, the insert 640 can fill 90% of the cavity 620 and extend partially into the rear opening 680. In some embodiments, not shown, the insert 640 can fill only the cavity 620 and not fill the rear opening 680. In some embodiments, the insert 640 can comprise a metal material and fill only the cavity 620. In this example embodiment, not shown, the opening wall 682 of the body 610 can taper to blend into the insert 640, providing a less distinct boundary for the rear opening 680.

In some embodiments, the insert 640 is formed prior to insertion into golf club head 600, as described below. In other embodiments, the insert 640 is formed within the cavity 620 of the body 610. In these embodiments, the opening wall 682 that forms the rear opening 680 can serve as a port for the insert 640 to be injected into the cavity 620, as described below.

C. Cavity of the Body

A front surface of the body cavity 620 can be enclosed by the faceplate 655. The faceplate 655 and the strikeface 611 can be similar to the faceplate 155 and strikeface 611 of golf club head 100. However, in some embodiments, the strikeface 611 can be integrally formed with the body 610. The strikeface 611 comprises a thickness 612 similar to the thickness 112 of strikeface 111 of golf club head 100.

The body 610 is partially or fully filled by the insert 640, which is secured within the golf club head 600 by the faceplate 655. In some embodiments, the cavity 620 further houses a tape layer 150 and/or adhesive, similar to the tape layer 150 and/or adhesive of golf club head 100.

Figure 17:
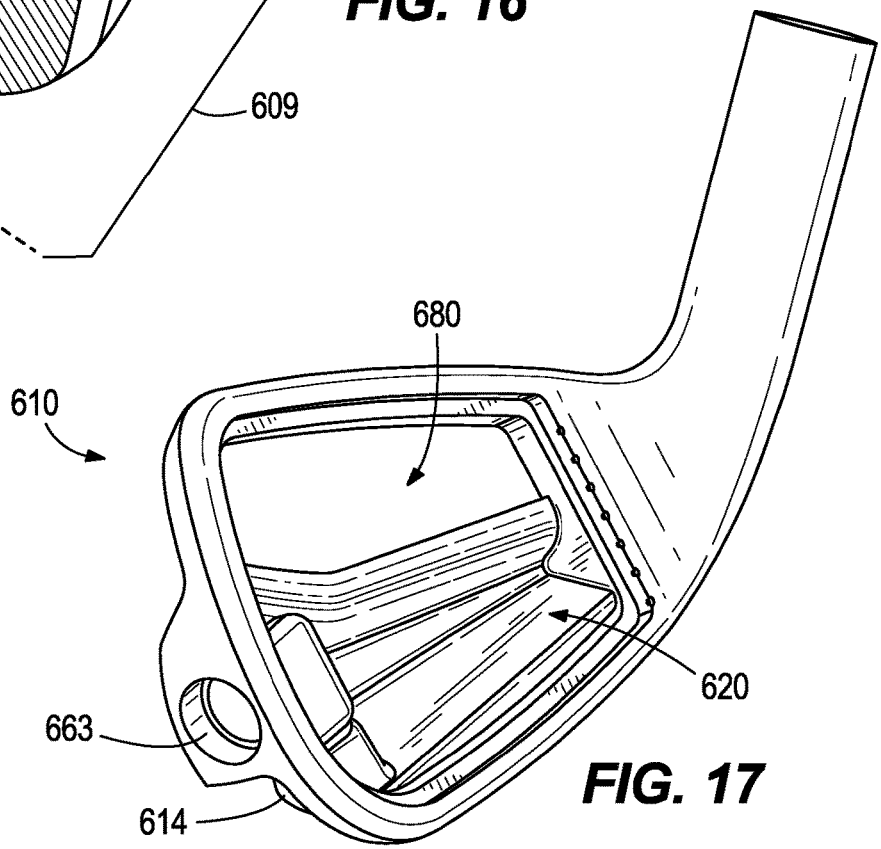
FIG. 17 shows a front perspective view of the body of the golf club head of FIG. 14.
Figure 18:
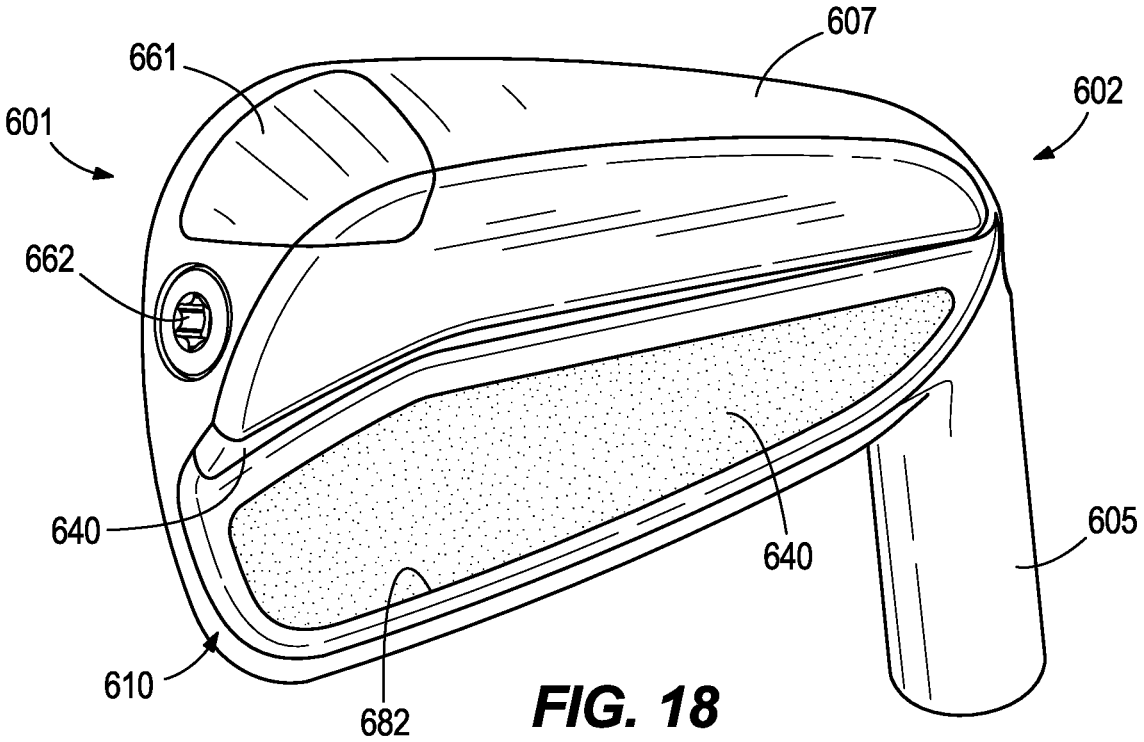
FIG. 18 shows a rear perspective view of the golf club head of FIG. 14.

In some embodiments, the golf club head 600 further comprises a shaft tip weight 660, similar to the shaft tip weight 160 of golf club head 100. In some embodiments, the body 610 further comprises a toe cavity 614 housing a toe weight 661, similar to the toe cavity 114 and toe weight 161 of golf club head 100. The golf club head 600 can further comprise a toe screw cavity 663 and a toe screw weight 662 for adjusting swing weighting, as depicted in FIGS. 17 and 18. The toe screw weight can comprise a weight between 2 grams and 15 grams, as described for the optional toe screw weight of golf club head 100. The toe screw weight 662 can be removed and replaced with a different screw weight 662 having a different weight value to customize the golf club head 600 to a golfer's swing.

D. Materials of the Club Head Body with Rear Opening

The materials used to form the components of golf club head 600, can be similar to the materials used to form the components of golf club head 100, as described above. In particular, the body 610 can comprise the same body material as body 110. The insert 640 can comprise the same insert material as insert 140. The faceplate 655 can comprise the same faceplate material as faceplate 155. The toe weight 661, tip weight 660, and toe screw weight 662 can comprise the same materials as the toe weight 161, tip weight 160, and toe screw weight materials as golf club head 100.

III. Golf Club Head Characteristics

A. Golf Club Head Measurements

The golf club head 100, 600 can be a tour iron. The golf club heads 100, 600 described herein can be a tour iron head comprising a blade length, a hosel-x length, an offset distance, and an upper portion depth characteristic of tour iron.

As illustrated in FIG. 2, the golf club head 100 comprises a blade length 173. The blade length 173 is measured as the maximum distance from an edge of the strikeface 111 in the heel region 102 to an edge of the club head 100 in the toe region 101. The blade length of a generic tour iron can be less than 2.8 inches. The blade length of a game-improvement iron is generally greater than 2.8 inches. The blade length 173 of golf club head 100 is less than 2.8 inches, as is characteristic of a tour iron. In some embodiments, the blade length 173 of golf club head 100 can be between 2.2 inch and 2.8 inch, 2.2 inch and 2.4 inch, 2.4 inch and 2.6 inch, or 2.6 inch and 2.8 inch.

As illustrated in FIG. 2, a hosel-X length 174 is measured from the centerplane 45 to an intersection of the hosel axis 70 with the lead edge axis 35. The hosel-X length of a tour iron is generally less than 1.5 inches, and the hosel-X length of a game improvement iron is generally greater than 1.5 inches. The hosel-X length of the golf club head 100 is less than 1.5 inches, as is characteristic of a tour iron. In some embodiments, the hosel-X length 174 can be between 1.30 inches and 1.50 inches, 1.30 inches and 1.40 inches, or 1.40 inches and 1.50 inches.

As illustrated in FIG. 4, an offset distance 173 is measured between a forward edge of the hosel 105 to a forwardmost point of the golf club head 100. Typically, the forwardmost point is located at the bottom of the strikeface 111 and adjacent the sole 107. The offset distance 172 can vary for golf club heads within the same set due to different loft angles. Therefore, in order to compare sets of irons, an average is taken of the offset distances 173 of all golf clubs within a set. The average offset for a tour iron set is generally less than 0.140 inch. The average offset for a game-improvement iron set is generally greater than 0.140 inch. The average offset for a set of golf clubs comprising golf club heads similar to club head 100 is less than 0.140 inch. The offset distance 172 of a single golf club head 100 can be between 0.100 inches and 0.160 inches. In some embodiments, the offset distance can be between 0.100 inch and 0.110 inch, 0.110 inch and 0.120 inch, 0.120 inch and 0.130 inch, 0.130 inch and 0.140 inch, 0.140 inch and 0.150 inch, or 0.150 inch and 0.160 inch.

An upper portion depth 116 is measured adjacent the top rail 106 and orthogonal to the strikeface 111 from the front 104 to the rear 103, as shown in FIG. 4. The average upper portion depth of a tour iron is generally less than 0.290 inch. The average upper portion depth of a game improvement iron is generally greater than 0.290 inch. The average upper portion depth for a set of golf clubs comprising golf club heads similar to golf club head 100 is less than 0.290 inch, as is characteristic of a set of tour irons.

A parameter that is similar between game-improvement and tour irons is the height of the golf club head. As illustrated in FIG. 2, the golf club head 100 can each have a maximum height 175 measured along the loft plane 20 from the lead edge axis 35 to the highest point on the top rail 106. Golf club head 600 can have a similar height golf club head 100. The maximum height 175 can be between 2.0 inches and 2.5 inches. In some embodiments, the maximum height 175 can be between 2.0 inches and 2.1 inches, 2.1 inches and 2.2 inches, 2.2 inches and 2.3 inches, 2.3 inches and 2.4 inches, and 2.4 inches and 2.5 inches.

Table I, below, compares blade length, hosel X, average offset, average upper portion depth, and maximum height of a tour iron versus a game improvement iron.

TABLE I

| | Blade Length | Hosel X | Offset (AVG of All Lofts) | Upper Portion Depth (AVG of All Lofts) | Maximum Height |
|---|---|---|---|---|---|
| Tour Iron | <2.8" | <1.5" | <0.140" | <0.290" | 2.0"-2.5" |
| Game Improvement | >2.8" | >1.5" | >0.140" | >0.290" | 2.0"-2.5" |

B. CG and MOI of Golf Club Head

In order to accurately understand the benefits of the perimeter weighting of the golf club head 100, one must consider both the MOI and CG characteristics of the golf club head 100 and the tour size of the golf club head 100. Although game-improvement irons are known for having high MOT values, they lack other features unique to tour irons. The golf club described herein marries the benefits of a game-improvement iron with a tour iron style.

In some embodiments, the CG 60 of the golf club head 100, 600 was shifted down and back compared to a flat back tour iron. The CG 60 position of the golf club head 100 can also be measured from the lead edge plane.

The CG 60 of the golf club heads 100, 600 can be located above the lead edge plane by between 0.380 inch and 0.670 inch. In some embodiments, the CG 60 of the golf club heads 100, 600 can be located above the lead edge plane by between 0.400 inch and 0.650 inch, 0.380 inch and 0.400 inch, 0.400 inch and 0.420 inch, 0.420 inch and 0.440, 0.440 inch and 0.460 inch, 0.460 inch and 0.480 inch, 0.480 inch and 0.500 inch, 0.500 inch and 0.520 inch, 0.520 inch and 0.540 inch, 0.540 inch and 0.560 inch, 0.560 inch and 0.580 inch, 0.580 inch and 0.600 inch, 0.600 inch and 0.620 inch, 0.620 inch and 0.640 inch, 0.640 inch and 0.660 inch, or 0.660 inch and 0.670 inch. In other embodiments, the CG 60 can be located above the lead edge plane by 0.380 inch, 0.390 inch, 0.400 inch, 0.410 inch, 0.420 inch, 0.430 inch, 0.440 inch, 0.450 inch, 0.460 inch, 0.470 inch, 0.480 inch, 0.490 inch, 0.500 inch, 0.510 inch, 0.520 inch, 0.530 inch, 0.540 inch, 0.550 inch, 0.560 inch, 0.570 inch, 0.580 inch, 0.590 inch, 0.600 inch, 0.610 inch, 0.620 inch, 0.630 inch, 0.640 inch, 0.650 inch, 0.660 inch, or 0.670 inch.

As described above, the golf club heads 100 and 600 described herein can comprise light weight inserts 140, 440, and 640 in the center of the golf club heads. These weights can be added to the perimeter of the golf club heads 100 and 600 without greatly changing the overall weight of the golf club heads 100, 600, but does allow for a shifting of the CG 60, and raising MOI. This perimeter weighting can come in the form of toe weights, a tip weight, or added body material around the perimeter. The compact nature of the golf club heads 100 and 600 leads to material properties playing a greater role in MOI improvement than structural properties. As described above, the MOI about the CG 60 and about the x-axis 30, Ixx, can range from 78 to 120 gram square inches. The MOI about the CG 60 and about the y-axis 40, Iyy, can range from 310 to 466 gram square inches. These MOI values can apply to golf club head 100 and 600. These MOI values can further apply to any embodiment having insert 140, 640, or multi-material insert 440.

IV. Methods

Figure 24:
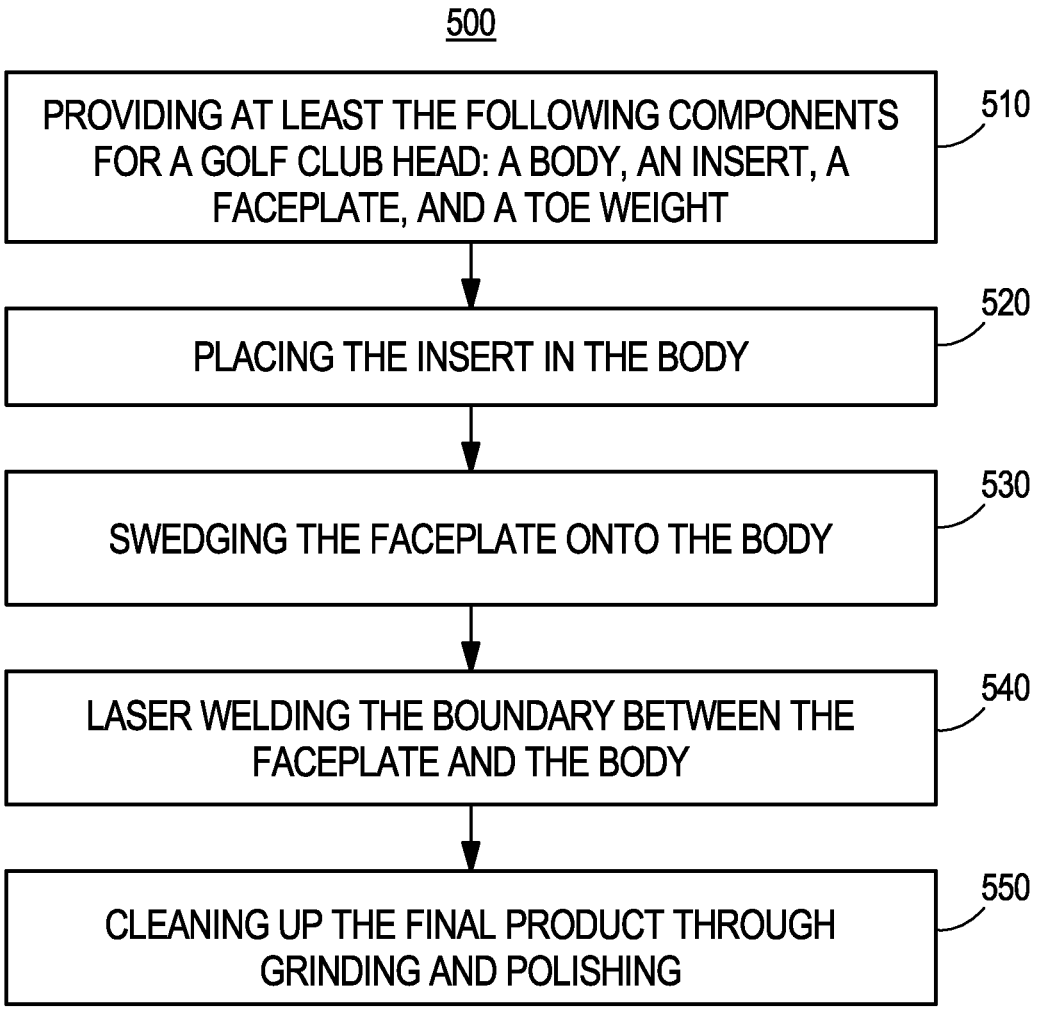
FIG. 24 shows a method of manufacturing the golf club head of FIG. 1.

As shown in FIG. 24, a method 500 of manufacturing the golf club head 100 is described herein. The method comprises providing each component 510, placing the insert in the body 520, swedging (swagging) the faceplate onto the body 530, laser welding a boundary between the faceplate and the body 540, and cleaning up the final product through grinding and polishing. In some embodiments of the method 500, the method 500 can consist of steps 510, 520, 530 and 550.

Step 510 can comprise providing at least a body 110, an insert 140 or a multi-material insert 440, and a faceplate 155 as components for the golf club head 100. In some embodiments, providing the body 110 can consist of one or more of: forging, casting, forming by additive manufacturing, machining, or any other suitable method for forming the body 110. Step 510 can comprise forming the body 110 as a unitary piece.

In some embodiments, providing the insert 140 can consist of one or more of: forging, casting, forming by additive manufacturing, machining, or any other suitable method for forming the body 140. In some embodiments, the insert 140 or a portion of the multi-material insert 440 is molded by pouring a resin into a fiber reinforcing structure to form an elastomeric matrix composite. The insert 140 can be formed as a unitary piece having a uniform density or as multiple pieces having different densities. In some embodiments, having the multi-material insert 440, the insert 440 can be formed into a single unit or can be placed into the cavity 120 in two separate portions.

In some embodiments providing the multi-material insert 440 comprises (1) providing a first portion 450 of the insert 440, (2) providing a second portion 460 of the insert 440, and (3) joining the first and second portions 450, 460 of the insert 440. Providing the first portion 450 of the insert 440 can comprise molding the first portion 440. Providing the second portion 460 of the insert 440 can comprise casting, forging, stamping, die casting, or other means of providing the second portion 460. In some embodiments, the sub-steps of (1) providing the second portion 460 and (2) joining the first and second portions 450, 460 are combined when the first portion 450 is molded and joined to the second portion 460. In some embodiments, the insert 440 may be sanded, ground, or polished before being inserted into the cavity 120 of the golf club head 100.

In some embodiments, forming the faceplate 155 can consist of forging, casting, machining, forming by additive manufacturing, or otherwise forming the faceplate 155. In some embodiments, forming the faceplate 155 can comprise machining, casting, or forging a variable thickness geometry into the faceplate 155.

In some embodiments, step 510 of method 500 can further comprise providing a toe weight, a tip weight, and/or a toe screw weight. In these embodiments, step 510 further comprises welding the toe weight 161 into a toe cavity 114 of the body 110. In other embodiments, the toe weight 161 can be swedged (swaged), adhered, or otherwise secured onto the body 610. For embodiments of the golf club head 100 further comprising a toe screw weight, the toe screw weight can be screwed into the golf club head in step 510, 520, 530, or 550.

Step 520 of the method 500 comprises placing the insert 140 in a cavity 120 of the body 110. The insert 140 is inserted through a front opening of the cavity 120 at a front 104 of the body 110. In some embodiments, this step 520 involves applying adhesive, such as epoxy, to the cavity 120 of the body 110 and to the insert 140 to secure the insert 140 into the body 110. In some embodiments, this step 520 involves applying one more tape layers, such as tape layer 150, to the cavity 120 before placing the insert 140 into the cavity. The one or more tape layers, such as tape layer 150, can form a strong and durable connection between the insert 140 and the cavity 120 of the body 110. Furthermore, the use of tape can reduce the possibility for rattling and other undesirable quality issues. In some embodiments, various other methods of fastening the insert 140 to the body 110 are combined for maximum security. Not all embodiments of the method 500 require adhering or securing the insert 140 into the cavity 120.

Step 530 of method 500 comprises securing the faceplate 155 onto the body 110. The faceplate 155 is placed within the indentation 142. By placing the faceplate 155 in the indentation 142, the faceplate 155 is positioned so that it covers the insert 140 and the cavity 120 of the body 110. Step 530 can further comprise swedging (swagging) the faceplate 155 onto the body 110 so that the faceplate 155 is embedded in the indentation 142 on the front 104 of the body 110. In this way, the insert 140 is held within the golf club head 100 and completely isolated from the outside of the golf club head 100. In other embodiments, the faceplate 155 is adhered, press-fit, or otherwise secured to the body.

Some golf club heads are manufactured by methods including co-forging (also known as integrated forging) and joining individually cast parts by high temperature and high applied pressure. These methods apply high temperatures which affect multiple components of the golf club head, including any inserts. For example, the co-forging process occurs at temperatures between 700 and 1000 degrees Celsius. The melting point of some aluminum alloys falls between 650 and 680 degrees Celsius. Thus, for an aluminum insert, co-forging would ruin the integrity of the aluminum material. The insert 140, 440, the body 110, and the faceplate 155 are not co-forged together, because co-forging can lead to high temperatures which can compromise the insert 140, 440.

Furthermore, TIG welding a faceplate onto the golf club head could also impart high temperatures to the golf club head which could compromise the insert. The possible materials for a low-density center of an iron-type golf club head are significantly limited due to conventional manufacturing processes. The golf club head 100 can be manufactured with a wide variety of insert materials, because the manufacturing process does not place the final assembly under high temperatures. Additionally, some insert materials described herein, such as a thermoplastic composite, simply cannot be co-forged with a metal body material. The manufacturing method 500 described herein allows the insert 140, 440 to be formed from any suitable material without requiring that the material be able to be co-forged with the body 110.

Step 530 and step 540, described below, both employ low-heat methods of securing the faceplate 155 to enclose the insert 140 within the cavity 120. Swedging, laser welding, and other low temperature methods of securing the faceplate 155 allow the insert 140 or 440 to comprise a wide variety of materials in order to fine-tune acoustics, feel, and weighting. The low-head methods of steps 530 and 540 further allow versatility in the design, such as the use of adhesives and/or tape around the cavity 120 to reduce unwanted rattling and vibration.

Step 540 comprises laser welding a boundary between the faceplate 155 and the body 110. The process of step 540 is also referred to as surface fusion treatment. After the faceplate 155 is swedged onto the body 110 in step 530, the overlapping region or boundary between the faceplate 155 and the body 110 is laser welded. This laser welding process blends the metal materials of the faceplate 155 and the body 110 without creating a deep heat affected zone (hereafter "HAZ"). Laser welding the boundary eliminates any cracks or seams between the faceplate 155 and the body 110. In some embodiments, the golf club head 100 is finished with a coating in step 550, as described below. If the boundary has even minute cracks or seams, the coating can seep into the seams and cause quality issues. Laser welding the boundary in step 540 eliminates this manufacturing issue.

Step 540, described above, can be conducted without compromising the integrity of the materials within the cavity 120 because the HAZ depth is between 0.03 inch and 0.08 inch, which can be less than the thickness 112 of the faceplate 155. In some embodiments, the HAZ depth can be less than 0.08 inch, less than 0.07 inch, less than 0.06 inch, less than 0.05 inch, less than 0.04 inch, or less than 0.03 inch. In some embodiments, the HAZ depth can be 0.03 inch, 0.04 inch, 0.05 inch, 0.06 inch, 0.07 inch, or 0.08 inch. Laser welding heats the insert and other cavity fillers, such as tape layer(s), to a temperature that is lower than a melting temperature of the insert material. The heat imparted to the golf club head 100 during step 540 does not compromise any of the materials sealed within the cavity 120.

In step 550 of the method 550, the golf club head 100 is cleaned up through grinding and polishing. Grinding is used to create a smooth surface on the strikeface 111 of the golf club head 100. Furthermore, this step 550 can comprise polishing the surface of the golf club head 100 after grinding. In some embodiments, grooves are ground into the strikeface 111 of the faceplate 155, and the strikeface 111 is thereafter polished. No step in the manufacturing method 500 comprises co-forging with different materials.

Figure 25:
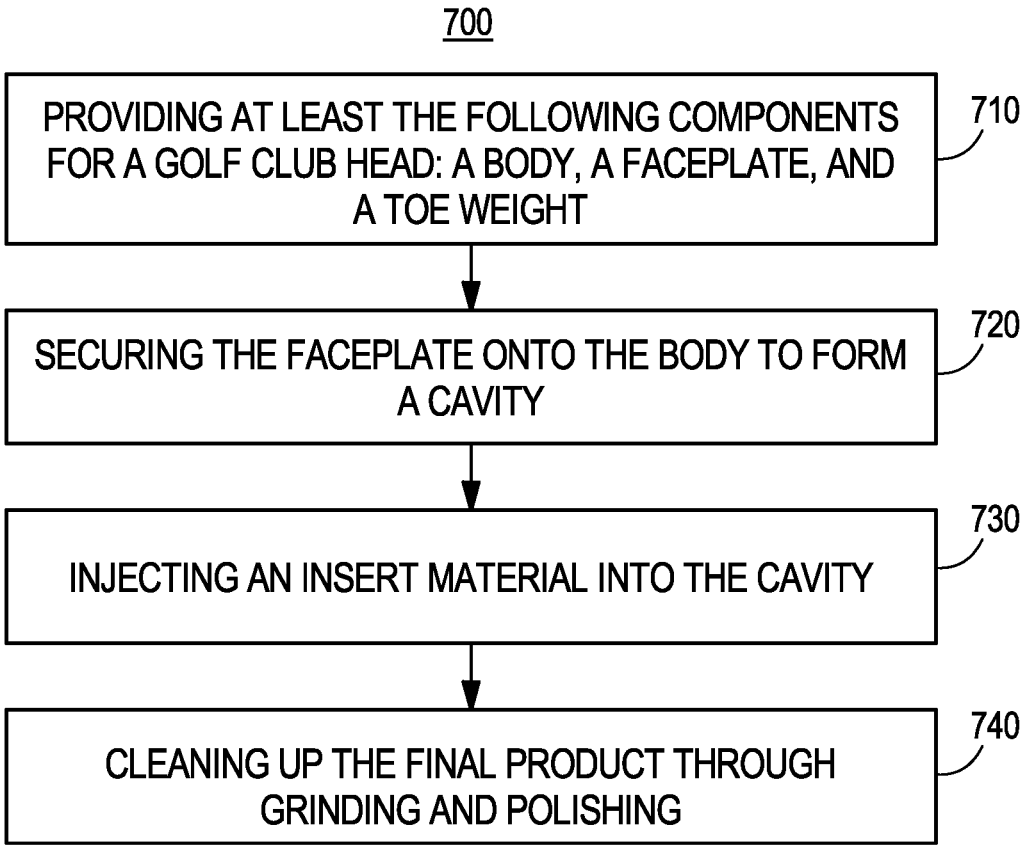
FIG. 25 shows a method of manufacturing the golf club head of FIG. 14.

As shown in FIG. 25, a method 700 of manufacturing a golf club head, similar to golf club head 600, comprises providing at least a body 610, an insert material, a faceplate 655, welding or swedging the faceplate 655 onto the body 610, injecting an insert material into the cavity 620 of the body 610, and polishing and cleaning the golf club head 600.

In step 710, the body 610 can be forged, cast, or formed by additive manufacturing. The faceplate 655 can be forged, cast, or formed by additive manufacturing. In a variation of the manufacturing process 700, the strikeface 655 is integrally formed as part of the body 610 rather than being separately formed as a faceplate 655 and welded or swedged onto a front opening of the body 610. In some embodiments, step 710 of method 700 further comprises providing a toe weight 661, a tip weight 650, and/or a toe screw weight 662. In these embodiments, step 710 further comprises welding the toe weight 661 into a toe cavity 614 of the body 610. In other embodiments, the toe weight 661 can be swedged (swaged), adhered, or otherwise secured onto the body 610. For embodiments of the golf club head 600 further comprising a toe screw weight 662, the toe screw weight 662 can be screwed into the golf club head in step 710, 720, 730, or 750.

Furthermore, in step 710 of method 700, an opening wall 782 defining a rear opening 680 can either be formed into the body 610 or can be cut into the rear 603 of the body 610 after the body 610 is formed. Step 710 can further comprise polishing or finishing the opening wall 782 of the rear 603.

Step 720 comprises placing the faceplate 655 within an indentation 642 of the body. The faceplate 655 is welded, swedged (swaged), or otherwise secured to the body 610. The body 610 and strikeplate 655 form a cavity 620. After the faceplate 655 is secured to the body 610, the only opening to the cavity 620 is the rear opening 680 of the body 610, as illustrated for the embodiment of FIGS. 14-23. In some embodiments, step 720 of method 700 can further comprise a laser welding or surface fusion treatment process, similar to that described in step 540 of method 500 above.

In step 730, the insert material is injected, in liquid form, into the cavity 620 through the opening 60 in the rear. The cavity 620 of the body 610 serves as a mold for the injected material. In some embodiments, the injection molding process results in the insert material bonding to the surfaces of the cavity 620. To inject the material into the cavity 620 under pressure, an injection apparatus must be sealed to the mouth of the rear opening 680. The planar surface surrounding the rear opening 680 in the upper portion 608 of the golf club head 600 allows a good seal to be made between the injection apparatus and the body 610 of the golf club head 600. In some embodiments, where the insert 640 only partially fills the cavity 620, the injection apparatus is configured to further form a seal with a portion of the cavity 620 to prevent the material from filling the entire cavity 620.

Step 740 of the method 700, the golf club head 600 is cleaned up through grinding and polishing. Grinding is used to create a smooth surface on the strikeface 611 of the golf club head 600. Furthermore, this step 740 can comprise polishing the surface of the golf club head 600 after grinding. In some embodiments, grooves are ground into the strikeface 611 of the faceplate 655, and the strikeface 611 is thereafter polished.

A method of making some embodiments of the golf club head 600, resembles the method 500 more closely than the method 700 described above. In some embodiments, a method of forming the golf club head 600 wherein the golf club head 600 comprises a metal insert 640, would require placing the insert 640 within the cavity 640 prior to swedging on the faceplate 655.

V. Examples

Example 1: Measurement of Golf Club Head

The golf club head 100, as described above, was measured using several different parameters. The included the blade length 173, hosel-x length 174, the offset distance 172, the upper portion depth 116, and the maximum height 175. These values were compared to a game improvement iron and are both shown in Table II, below. Both the golf club head 100 and the game improvement iron that were measured were 7-irons, having a roughly equivalent loft angle.

TABLE II

Parameters for Example 1.

| | Blade Length | Hosel X | Offset | Upper Portion Depth | Maximum Height |
|---|---|---|---|---|---|
| Golf club head 100 | 2.727" | 1.345" | 0.085" | 0.250" | 2.040" |
| Game Improvement | 2.802" | 1.630" | 0.175" | 0.315" | 2.045" |

Example 2: Moment of Inertia (MOI) Comparison and Center of Gravity (CG) Comparison A test has been conducted to compare the MOI of a traditional tour iron head to golf club heads 100 described above. The traditional tour iron head used in this comparison test is identical in size and headweight to the sample golf club head. Thus, this test isolated the MOI as a variable, to provide an accurate comparison of the performance of the sample over the traditional tour iron head. The test produced an Ixx value of roughly 108 gram square inches for the sample club head and an Ixx value of roughly 103 gram square inches for the traditional tour iron head. Therefore, the MOI around the x-axis 30 is approximately 4.8% higher in the sample club head. The test produced an Iyy value of roughly 413 gram square inches for the sample club head and an Iyy value of roughly 398 gram square inches for the traditional tour iron head. Therefore, the MOI around the y-axis 40 is approximately 3.7% higher in the sample club head. This test shows that the lightweight insert for the golf club head 100 provides an improvement in MOI without altering the size or weight of the golf club head 100.

Additionally, a comparison was done between five club heads: (1) an iron similar to golf club head 600, having an opening in the rear and an insert formed from TPC; (2) an iron similar to golf club head 600, having an opening in the rear and an insert formed from aluminum; (3) an iron similar to golf club head 100, having an enclosed cavity filled with a TPC insert; (4) an iron similar to golf club head 100, having an enclosed cavity filled with an aluminum insert; and (5) a solid steel club head having a similar overall club head volume to the golf club heads described herein. Measurements were taken using computer aided design (CAD) models of each golf club head. Table III below summarizes the MOI data collected. Table IV below summarizes the CG data collected.

TABLE III

MOI Comparison Data for Example 2

| Club Head | Mass (g) | MOIxx | MOIyy | MOIxx efficiency | MOIyy efficiency |
|---|---|---|---|---|---|
| (1) Filled with TPC (opening in rear) | 265.0 | 97.4 | 414.4 | 0.368 | 1.564 |
| (2) Filled with Aluminum (opening in rear) | 278.0 | 100.0 | 421.8 | 0.360 | 1.517 |
| (3) Filled with TPC (enclosed cavity) | 254.1 | 96.1 | 410.3 | 0.378 | 1.615 |

TABLE III-continued

| MOI Comparison Data for Example 2 | | | | | |
|---|---|---|---|---|---|
| Club Head | Mass (g) | MOIxx | MOIyy | MOIxx efficiency | MOIyy efficiency |
| (4) Filled with Aluminum (enclosed cavity) | 265.0 | 98.0 | 415.5 | 0.370 | 1.568 |
| (5) Solid Steel | 314.0 | 106.6 | 438.8 | 0.340 | 1.398 |

Since MOI is a function of distance from the CG and mass, the MOI will reflect changes in the overall mass of the golf club head. Therefore, to accurately compare club head MOI, the difference in total mass of the golf club head must be accounted for. In order to illustrate the efficiency of the MOI across the compared golf club heads, the MOI was divided by the mass of the golf club head to arrive at an MOI efficiency value. The MOI efficiency value of golf club heads can be compared, independent of mass, to show how the structure and localized weighting of the golf club heads affects the MOI. Therefore, although the MOI values in both the x-axis 30 and the y-axis 40 directions were higher for the solid steel golf club head (5) than for the low-density insert golf club heads (1) through (4), the MOI efficiency of the solid steel golf club head (5) was lower than the MOI efficiency of golf club heads (1) through (4). Therefore, the golf club heads (1) through (4) with low-density inserts are more forgiving than a golf club head lacking the low-density insert 140, 440, 460 of the golf club head 100, 600 described herein.

As can be seen from Table III, the golf club heads (1) through (4) with low-density inserts have MOI efficiencies in the x-axis 30 direction of 5.9% to 11.2% higher than solid steel golf club head (5). As can be seen from Table III, the club heads (1) through (4) with low-density inserts have MOI efficiencies in the y-axis 40 direction of 8.5% to 15.5% higher than solid steel golf club head (5).

In addition to increasing the MOI, lowering of the CG can also benefit golf club head performance. The golf club heads 100, 600 described herein comprise a lower CG 60 than an equivalent solid steel iron having a similar shape to golf club heads 100 and 600. Lower CG is desirable in tour irons because shots are easier to shape when the CG is lower. For golf club head 600, the lowering of the CG is due in part to the elimination of high-density body material by inclusion of the opening 680 in the rear 603.

TABLE IV

| CG Comparison Data for Example 2 | | | | |
|---|---|---|---|---|
| Golf Club Head | Mass (g) | CGx | CGy | CGz |
| (1) Filled with TPC (opening in rear) | 265.0 | 0.037 | 0.528 | −0.510 |
| (2) Filled with Aluminum (opening in rear) | 278.0 | 0.022 | 0.532 | −0.517 |
| (3) Filled with TPC (enclosed cavity) | 254.1 | 0.055 | 0.566 | −0.525 |
| (4) Filled with Aluminum (enclosed cavity) | 265.0 | 0.040 | 0.562 | −0.528 |
| (5) Solid Steel | 314.0 | −0.012 | 0.543 | −0.539 |

Referring to FIG. 1, the CGy is measured in the y-axis 40 direction (vertical) and upward from the lead edge axis 35. The CGx is measured horizontally along the lead edge axis 35 with the origin at the y-axis 40, such that the CG is closer to the heel 102 when the CGx value is positive. The CGz is measured rearward, horizontally along the z-axis 50 from the lead edge axis 35. The CGy value is lower in golf club heads 1 and 2 than in golf club heads 3-5. This shows that the golf club heads having the opening in the rear of the body (similar to golf club head 600, described above) have a desirably lower CG. The CG is 2.06% lower in club head 2 than in steel club head 5. The CG is 2.84% lower in golf club head 1 than in steel golf club head 5, indicating that the low-density TPC insert results in an even better CG placement than it's aluminum insert counterpart (golf club head 2).

The comparison data in Tables III and IV further illustrates the strengths of the enclosed cavity embodiments and the rear opening embodiments. Although all embodiments of the invention (comparison golf club heads (1) through (4)) show improvements over the solid club head (5), both the enclosed cavity embodiments (comparison golf club heads (3) and (4)) and the rear opening embodiments (comparison golf club heads (1) and (2)) provide unique benefits. The comparison data shows that the MOI efficiency in both the x-axis 30 direction and the y-axis 40 direction is higher in the enclosed cavity club heads (3) and (4) than in the club heads (1), (2), and (5), as shown in the MOI efficiency columns of Table II. This suggests that the enclosed cavity embodiments, similar to golf club heads 100 described herein or comparison club heads (3) and (4), are more forgiving than embodiments having an opening in the rear, such as golf club head 600 or comparison club heads (1) and (2). However, embodiments with a rear opening 680 in the body 610 have lower CG values than the embodiments having an enclosed cavity, as shown in the CGy column of Table IV.

Example 3: Center of Gravity Flat Back Versus Inflection Seam Back Comparison In addition to MOI and feel, the location of the CG of a golf club head affects performance. In particular, the CG location affects the amount of torque that is imparted to the golf club head upon impact with a golf ball. By lowering the CG, the arm between the force applied by the golf ball and the CG is lessened, since the golf ball is typically struck with a lower portion of the strikeface. This shortened arm between the applied force and the CG results in lower torque and improved launch characteristics upon impact with a golf ball. Therefore, in order to provide the golfer with the best possible experience, the golf club head described herein comprises a low CG.

To illustrate the how the uniform depth of the upper portions 108, 608 of the golf club head 100, 600 leads to a lower CG 60, a comparison was done between a golf club head, similar to golf club heads 100 and 600, and a comparison golf club head having a varying depth from its top rail to its sole. The comparison golf club head has a planar rear stretching from its top rail to its sole. In order to provide an accurate illustration, the comparison golf club head and the golf club head similar to 100 and 600 were both modeled with the same total mass. The results of the comparison are outlined in Table IV below.

TABLE IV

| CG Comparison Data for Example 3 | | | | |
|---|---|---|---|---|
| Golf Club Head | Mass (g) | CGx | CGy | CGz |
| Golf club head similar to 100 and 600 (rear with inflection point & uniform upper portion depth) | 261.0 | 0.044 | 0.569 | −0.528 |
| Comparison golf club head (planar rear) | 261.0 | 0.047 | 0.608 | −0.542 |

As shown in Table IV, the CGy value, which is measured along the vertical y-axis 40, is significantly lower for the golf club head similar to 100 and 600. Specifically, the golf club head similar to 100 and 600 comprises a CGy 0.039 inch lower than the comparison golf club head. This shows that the uniform depth of the upper portion 108, 608 above the inflection point 130, 630, lowers the CG, providing better launch and spin characteristics and higher ball speed.

Furthermore, the CGz value, is measured along the z-axis 50, wherein rearward of the CG 60 is negative and forward of the CG 60 is positive. The CG 60 of the golf club head similar to 100 and 600 is closer to the front of the golf club head.

Example 4: Feel and Sound

Part of the appeal of tour irons is their compact profile and sleek aesthetic design. Furthermore, forged golf club heads are perceived by many golfers to perform better than cast club heads. Therefore, it is critical that a tour iron satisfy these expectations. Golfers especially enjoy the sound and feel of forged tour irons over other types of irons. In golf the "feel" of the golf club head, as perceived by a golfer, plays a big role in the golfer's performance. The "feel" is generally affected by weighting, materials, acoustics, and the thickness of the strikeface. Most golfers agree that tour irons provide a solid feel that is absent from many other types of irons. The golf club heads described herein exhibit a solid feel and acoustic quality that equals if not exceeds existing tour irons.

A survey has been conducted to quantify the feel of a sample tour iron, having a golf club head similar to the golf club head 100 described herein. Twenty golfers participated in the survey and compared their experiences with the sample iron to their experiences with a traditional tour iron. After using both the sample and the traditional iron, survey participants were asked the following question for each iron: "How satisfied are you with the impact experience (feel/sound) that this iron provides?" A majority of the players preferred the impact experience of the sample tour iron over the traditional tour iron.

Finally, the quality and durability of the iron is critical to lasting performance. The strikeface 111 and 611 is engineered to withstand, alone, the stresses placed on it by striking a golf ball. However, the inclusion of the thermoplastic composite insert 140, 640, the fully metal insert 140, 640, or the multi-material insert 440 gives the golf club head an additionally solid feel and improves the acoustic quality of the golf club head over similar hollow-bodied golf club heads. The faceplate 155, 655 can improve the quality and durability of the golf club head by ensuring that the insert 140, 640 remains secured inside the golf club head at all times.

By combining and balancing CG placement, perimeter weighting for MOI, and a tour iron look and feel, the golf club head 100, 600 described herein fills a need in the art for an iron type club head that marries the reliability of a game-improvement iron with the elegance of a tour iron.

The golf club heads 100 and 600 described herein functions as tour type golf club heads. They offer a high MOI while remaining smaller than typical game-improvement irons. These multi-material golf club heads 100 and 600 offer a compact product with exceptional forgiveness.

While FIGS. 1-23 depict specific embodiments of golf club heads, the disclosure of embodiments is intended to be illustrative of the scope of the present disclosure and is not intended to be limiting. It is intended that the scope of the present disclosure shall be limited only to the extent required by the appended claims.

As the rules to golf may change from time to time (e.g., new regulations may be adopted or old rules may be eliminated or modified by golf standard organizations and/or governing bodies), golf equipment related to the methods, apparatus, and/or articles of manufacture described herein may be conforming or non-conforming to the rules of golf at any particular time. Accordingly, golf equipment related to the methods, apparatus, and/or articles of manufacture described herein may be advertised, offered for sale, and/or sold as conforming or non-conforming golf equipment. The methods, apparatus, and/or articles of manufacture described herein are not limited in this regard.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are stated in such claim.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Clause 1: A golf club head comprising a faceplate, a body, and an insert; the body comprising an upper portion, a lower portion, a sole, a rear, and a top rail; wherein: the faceplate and a portion of the body define a striking surface of the golf club head; the faceplate, the sole, the rear, and the top rail enclose a cavity; the rear comprises an inflection seam; the sole rests on a ground plane; a loft plane is tangential to the faceplate and intersects the ground plane; a centerplane, perpendicular to the loft plane, and coincident with a centerpoint of the striking surface; the upper portion is bounded by the top rail and the inflection seam; the upper portion comprises a height measured along the centerplane from the top rail to the inflection seam, in a direction parallel to the loft plane; the lower portion comprises a height measured along the centerplane from the sole to the inflection seam, in a direction parallel to the loft plane; the height of the upper portion and the height of the lower portion have a ratio of between 9:8 and 6:11; the upper portion comprises a first depth and the lower portion comprises a second depth, wherein the depths are measured perpendicular to the loft plane from the striking surface to an outer surface of the rear, along the centerplane; the first depth is constant and is less than the second depth; the sole, the rear, the top rail, and the faceplate enclose a cavity; the insert is received in the cavity, and the insert complements 90% or more of the cavity; the faceplate comprises a first material of a first density; the body comprises a second material of a second density; the insert comprises a third material of a third density; and the third density is less than the first and second densities.

Clause 2: The golf club head of clause 1, further comprising: a heel and a toe; an x-axis, extending in a heel-to-toe direction, parallel to the striking surface, and coincident with a center of gravity of the club head; a y-axis, orthogonal to the ground plane and coincident with the center of gravity; wherein: a moment of inertia, Ixx, measured about the x-axis ranges between 78 gram square inches and 120 gram square inches; and a moment of inertia, Iyy, measured about the y-axis ranges between 310 gram square inches and 466 gram square inches.

Clause 3: The golf club head of clause 3, wherein the third density is between 2.4 and 5.0 g/cc.

Clause 4: The golf club head of clause 3, wherein the third material comprises a material selected from the group consisting of: aluminum and titanium.

Clause 5: The golf club head of clause 1, wherein the first density is between 2.6 and 8.7 g/cc and the second density is between 7.7 and 8.1 g/cc.

Clause 6: The golf club head of clause 5, wherein the first material comprises a material selected from the group consisting of: a steel-based material, a titanium-based material, an aluminum alloy, or a titanium alloy; the second material comprises a material selected from the group consisting of: a steel-based material or a steel alloy.

Clause 7: The golf club head of clause 1, further comprising: a total mass; a toe weight; wherein: the body further comprises: a toe cavity; the toe cavity receives the toe weight; and the toe weight comprises a mass between 5% and 45% of the total mass of the club head.

Clause 8: The golf club head of clause 1, wherein a ratio of the first depth to a maximum of the second depth is between 1:3 and 4:5.

Clause 9: The golf club head of clause 1, further comprising: a center of gravity; and a lead edge axis, parallel to the ground plane, extending in a heel-to-toe direction, and coincident with a point on the centerplane that is lowest on the striking surface; a lead edge plane, parallel to the ground plane and coincident with the lead edge axis; a y-axis, orthogonal to the ground plane, and coincident with the center of gravity; and wherein the center of gravity of the golf club head is located between 0.380 inch and 0.670 inch above the lead edge plane.

Clause 10: The golf club head of clause 1, further comprising: a heel and a toe; a cylindrical hosel integral to the body; a hosel reference plane, parallel to a front edge of the cylindrical hosel, when viewed from a toe side view; a hosel axis, defined as the central axis of the cylindrical hosel; a lead edge axis, parallel to the ground plane, extending in a heel-to-toe direction, and coincident with a point on the centerplane that is lowest on the striking surface; a hosel-X distance, measured from the intersection of the lead edge axis with the centerplane to the intersection of the lead edge axis with the hosel axis, when viewed from a front view, wherein the hosel-X distance is less than 1.5 inches; and an offset distance, measured as the minimum distance between the lead edge axis and the hosel reference plane; wherein the offset distance between 0.05 inch and 0.27 inch.

Clause 11: The golf club head of claim 1, further comprising: a heel and a toe; and a blade length, measured in a heel-to-toe direction from an edge of the striking surface in the heel to an outermost point on the toe; wherein the blade length is less than 2.8 inches.

Clause 12: The golf club head of claim 1, further comprising a high density tape disposed between the insert and the faceplate.

Clause 13: The golf club head of claim 1, wherein: the body further comprises an indentation; the indentation abuts a periphery of the cavity; an area of a rear surface of the faceplate contacts the insert; a remaining area of the rear surface of the faceplate contacts the indentation.

Clause 14: A method of forming a golf club head comprising the following steps: (1) providing a faceplate comprising a first material of a first density; (2) providing a body, comprising a second material of a second density, an upper portion, a lower portion, a sole, a rear, and a top rail; wherein: the faceplate and a portion of the body define a striking surface of the golf club head; the rear comprises an inflection seam; the sole rests on a ground plane; a loft plane is tangential to the faceplate and intersects the ground plane; a centerplane, extending in a top rail-to-sole direction, and coincident with a centerpoint of the striking surface; the upper portion is bounded by the top rail and the inflection seam; the upper portion comprises a height measured along the centerplane from the top rail to the inflection seam, in a direction parallel to the loft plane; the lower portion comprises a height measured along the centerplane from the sole to the inflection seam, in a direction parallel to the loft plane; the height of the upper portion and the height of the lower portion have a ratio of between 9:8 and 6:11; the upper portion comprises a first depth and the lower portion comprises a second depth, wherein the depths are measured perpendicular to the loft plane from the striking surface to an outer surface of the rear, along the centerplane; the first depth is constant and is less than the second depth; the sole, the rear, and the top rail define a cavity; (3) providing an insert, comprising a third material of a third density, wherein the third density is less than the first and second densities; and (4) placing the insert within the cavity; where after the insert complements 90% or more of the cavity; and (5) securing the faceplate to the body, wherein the faceplate further defines and encloses the cavity.

Clause 15: The method of forming a golf club head of clause 14, wherein securing the faceplate to the body in step (5) comprises: swedging the faceplate onto the body; laser welding a boundary between the faceplate and the body.

Clause 16: The method of forming a golf club head of clause 15, wherein laser welding the boundary of the faceplate and the body comprises creating a heat affected zone comprising a depth of less than 0.070 inch.

Clause 17: The method of forming a golf club head of clause 15, wherein: the golf club head further comprises: a heel and a toe; an x-axis, extending in a heel-to-toe direction, parallel to the striking surface, and coincident with a center of gravity of the club head; a y-axis, orthogonal to the ground plane and coincident with the center of gravity; wherein: a moment of inertia, Ixx, measured about the x-axis ranges between 78 gram square inches and 120 gram square inches; and a moment of inertia, Iyy, measured about the y-axis ranges between 310 gram square inches and 466 gram square inches.

Clause 18: A method of forming a golf club head of clause 14, further comprising placing a tape layer onto the insert between steps (4) and (5), wherein the tape layer is sandwiched between the insert and the faceplate upon completion of step (5).

Clause 19: A method of forming a golf club head of clause 14, wherein: the method further comprises forming a cylindrical hosel integral to the body; the golf club head further comprises: a heel and a toe; a hosel reference plane, parallel to a front edge of the cylindrical hosel, when viewed from a toe side view; a hosel axis, defined as the central axis of the cylindrical hosel; a lead edge axis, parallel to the ground plane, extending in a heel-to-toe direction, and coincident with a point on the centerplane that is lowest on the striking surface; a hosel-X distance, measured from the intersection of the lead edge axis with the centerplane to the intersection of the lead edge axis with the hosel axis, when viewed from a front view, wherein the hosel-X distance is less than 1.5 inches; and an offset distance, measured as the minimum distance between the lead edge axis and the hosel reference plane; wherein the offset distance between 0.05 inch and 0.27 inch.

Clause 20: A method of forming a golf club head of clause 14, wherein: the golf club head comprises a total mass; the body further comprises a toe cavity; and the method further comprising: forming a toe weight, the toe weight comprising a mass between 5% and 45% of the total mass of the golf club head; and securing the toe weight within the toe cavity.

Clause 21: A golf club head comprising a faceplate, a body, and an insert; the body comprising an upper portion, a lower portion, a sole, a rear, and a top rail; wherein: the faceplate and a portion of the body define a striking surface of the golf club head; the faceplate, the sole, the rear, and the top rail enclose a cavity; the rear comprises an inflection seam; the sole rests on a ground plane; a loft plane is tangential to the faceplate and intersects the ground plane; a centerplane, perpendicular to the loft plane, and coincident with a centerpoint of the striking surface; the upper portion is bounded by the top rail and the inflection seam; the upper portion comprises a height measured along the centerplane from the top rail to the inflection seam, in a direction parallel to the loft plane; the lower portion comprises a height measured along the centerplane from the sole to the inflection seam, in a direction parallel to the loft plane; the height of the upper portion and the height of the lower portion have a ratio of between 9:8 and 6:11; the upper portion comprises a first depth and the lower portion comprises a second depth, wherein the depths are measured perpendicular to the loft plane from the striking surface to an outer surface of the rear, along the centerplane; the first depth is constant and is less than the second depth; the sole, the rear, the top rail, and the faceplate enclose a cavity; the insert is received in the cavity, and the insert complements 90% or more of the cavity; the insert comprises a first portion and a second portion; the faceplate comprises a first material of a first density; the body comprises a second material of a second density; the first portion of the insert comprises a third material of a third density; the second portion of the insert comprises a fourth material of a fourth density; and the third density is less than the first, second, and fourth densities.

Clause 22: The golf club head of clause 21, wherein the second portion of the insert does not contact the faceplate.

Clause 23: The golf club head of clause 22, wherein the second portion of the insert is wholly located in the lower portion of the body.

Clause 24: The golf club head of clause 21, wherein the fourth density is greater than the first and second densities.

Clause 25: The golf club head of clause 21, wherein a ratio of the first depth to a maximum of the second depth is between 1:3 and 4:5.

Clause 26: The golf club head of clause 21, further comprising: a center of gravity; and a lead edge axis, parallel to the ground plane, extending in a heel-to-toe direction, and coincident with a point on the centerplane that is lowest on the striking surface; a lead edge plane, parallel to the ground plane and coincident with the lead edge axis; a y-axis, orthogonal to the ground plane, and coincident with the center of gravity; and wherein the center of gravity of the golf club head is located between 0.380 inch and 0.670 inch above the lead edge plane.

Clause 27: The golf club head of clause 21, further comprising: a heel and a toe; a cylindrical hosel integral to the body; a hosel reference plane, parallel to a front edge of the cylindrical hosel, when viewed from a toe side view; a hosel axis, defined as the central axis of the cylindrical hosel; a lead edge axis, parallel to the ground plane, extending in a heel-to-toe direction, and coincident with a point on the centerplane that is lowest on the striking surface; a hosel-X distance, measured from the intersection of the lead edge axis with the centerplane to the intersection of the lead edge axis with the hosel axis, when viewed from a front view, wherein the hosel-X distance is less than 1.5 inches; and an offset distance, measured as the minimum distance between the lead edge axis and the hosel reference plane; wherein the offset distance between 0.05 inch and 0.27 inch.

Clause 28: The golf club head of clause 21, further comprising: a heel and a toe; and a blade length, measured in a heel-to-toe direction from an edge of the striking surface in the heel to an outermost point on the toe; wherein the blade length is less than 2.8 inches.

Clause 29: The golf club head of clause 21, further comprising a high density tape disposed between the insert and the faceplate.

Clause 30: The golf club head of clause 21, wherein the first depth is less than 0.290 inch.

Clause 31: The golf club head of clause 21, wherein the third density is between 2.4 and 5.0 g/cc.

Clause 32: The golf club head of clause 31, wherein: the third material comprises a material selected from the group consisting of: aluminum and titanium; and the fourth material comprises tungsten.

Clause 33: The golf club head of clause 21, further comprising: a total mass; a toe weight; wherein: the body further comprises: a toe cavity; the toe cavity receives the toe weight; and the toe weight comprises a mass between 5% and 45% of the total mass of the club head.

Clause 34: The golf club head of clause 21, further comprising: a heel and a toe; an x-axis, extending in a heel-to-toe direction, parallel to the striking surface, and coincident with a center of gravity of the club head; a y-axis, orthogonal to the ground plane and coincident with the center of gravity; wherein: a moment of inertia, Ixx, measured about the x-axis ranges between 78 gram square inches and 120 gram square inches; and a moment of inertia, Iyy, measured about the y-axis ranges between 310 gram square inches and 466 gram square inches.

Clause 35: A method of forming a golf club head comprising the following steps: (1) providing a faceplate comprising a first material of a first density; (2) providing a body, comprising a second material of a second density, an upper portion, a lower portion, a sole, a rear, and a top rail; wherein: the faceplate and a portion of the body define a striking surface of the golf club head; the rear comprises an inflection seam; the sole rests on a ground plane; a loft plane is tangential to the faceplate and intersects the ground plane; a centerplane, extending in a top rail-to-sole direction, and coincident with a centerpoint of the striking surface; the upper portion is bounded by the top rail and the inflection seam; the upper portion comprises a height measured along the centerplane from the top rail to the inflection seam, in a direction parallel to the loft plane; the lower portion comprises a height measured along the centerplane from the sole to the inflection seam, in a direction parallel to the loft plane;

the height of the upper portion and the height of the lower portion have a ratio of between 1:1 and 2:1; the upper portion comprises a first depth and the lower portion comprises a second depth, wherein the depths are measured perpendicular to the loft plane from the striking surface to an outer surface of the rear, along the centerplane; the first depth is constant and is less than the second depth; the sole, the rear, and the top rail define a cavity; (3) providing an insert, comprising a first portion and a second portion; wherein: the first portion comprises a third material of a third density; the second portion comprises a fourth material of a fourth density; the third density is less than the first, second, and fourth densities; (4) placing the insert within the cavity; where after the insert fills 90% or more of the cavity; and (5) securing the faceplate to the body, wherein the faceplate further defines and encloses the cavity.

Clause 36: A method of forming a golf club head of clause 35, wherein securing the faceplate to the body in step (5) comprises: swedging the faceplate onto the body; heat treating (or laser welding) a boundary between the faceplate and the body.

Clause 37: The method of forming a golf club head of clause 35, wherein laser welding the boundary of the faceplate and the body comprises creating a heat affected zone comprising a depth of less than 0.070 inch.

Clause 38: The method of forming a golf club head of clause 35, wherein: the golf club head further comprises: a heel and a toe; an x-axis, extending in a heel-to-toe direction, parallel to the striking surface, and coincident with a center of gravity of the club head; a y-axis, orthogonal to the ground plane and coincident with the center of gravity; wherein: a moment of inertia, Ixx, measured about the x-axis ranges between 78 gram square inches and 120 gram square inches; and a moment of inertia, Iyy, measured about the y-axis ranges between 310 gram square inches and 466 gram square inches.

Clause 39: A method of forming a golf club head of clause 35, further comprising placing a tape layer onto the insert between steps (4) and (5), wherein the tape layer is sandwiched between the insert and the faceplate upon completion of step (5).

Clause 40: A method of forming a golf club head of clause 35, wherein the first portion and the second portion of the insert are integrally formed prior to step (4).

Clause 41: A golf club head comprising: a faceplate, a body, and an insert; the body comprising an upper portion, a lower portion, a sole, a rear, and a top rail; wherein: the faceplate and a portion of the body define a striking surface of the golf club head; the faceplate, the sole, the rear, and the top rail define a cavity; the rear comprises an inflection seam and a wall defining an opening; the opening wall is above the inflection seam, and comprises: a top wall adjacent the top rail, a bottom wall adjacent the inflection seam, a toe wall, and a heel wall; the sole rests on a ground plane; a loft plane is tangential to the faceplate and intersects the ground plane; a centerplane, perpendicular to the loft plane, and coincident with a centerpoint of the striking surface; a projected area of the opening, taken parallel to the loft plane, comprises an area between 25% and 50% of a projected area of the entire rear; the upper portion is bounded by the top rail and the inflection seam; the upper portion comprises a height measured along the centerplane from the top rail to the inflection seam, in a direction parallel to the loft plane; the lower portion comprises a height measured along the centerplane from the sole to the inflection seam, in a direction parallel to the loft plane; the height of the upper portion and the height of the lower portion have a ratio of between 1:1 and 2:1; the upper portion comprises a first depth and the lower portion comprises a second depth, wherein the depths are measured perpendicular to the loft plane from the striking surface to an outer surface of the rear, along the centerplane; the first depth is constant and is less than the second depth; the sole, the rear, the top rail, and the faceplate enclose a cavity; the insert is received in the cavity, and the insert complements up to 90% of the cavity; the faceplate comprises a first material of a first density; the body comprises a second material of a second density; the insert comprises a third material of a third density; and the third density is less than the first and second densities.

The invention claimed is:

1. A golf club head comprising:

a faceplate, a body, and an insert;

the body comprising an upper portion, a lower portion, a sole, a rear, and a top rail;

wherein:

the faceplate and a portion of the body define a striking surface of the golf club head;

the faceplate, the sole, the rear, and the top rail enclose a cavity;

the rear comprises an inflection seam;

the sole rests on a ground plane;

a loft plane is tangential to the faceplate and intersects the ground plane;

the upper portion is bounded by the top rail and the inflection seam;

the lower portion is bounded by the sole and the inflection seam;

the upper portion defines a rear opening that connects to the cavity;

the rear opening covers a projected area between 25% and 50% of a total projected area of the rear, wherein the projected areas are measured parallel to the loft plane;

the cavity comprises a volume;

the cavity volume is between 17% and 32% of the total club head volume;

the cavity volume in the lower portion is greater than the cavity volume in the upper portion;

the insert is received in the cavity, and the insert complements 90% or more of the cavity;

the faceplate comprises a first material of a first density;

the body comprises a second material of a second density;

the insert comprises a third material of a third density;

the third density is less than the first and second densities; and the third density is between 2.4 and 3.0 g/cc.

2. The golf club head of claim 1, wherein the insert is visible through the rear opening.

3. The golf club head of claim 1, further comprising a badge; wherein the badge covers the rear opening.

4. The golf club head of claim 1, further comprising:

a heel and a toe;

an x-axis, extending in a heel-to-toe direction, parallel to the striking surface, and coincident with a center of gravity of the club head;

a y-axis, orthogonal to the ground plane and coincident with the center of gravity;

wherein:

a moment of inertia, Ixx, measured about the x-axis ranges between 78 gram square inches and 120 gram square inches; and a moment of inertia, Iyy, measured about the y-axis ranges between 310 gram square inches and 466 gram square inches.

5. The golf club head of claim 1, wherein the third material comprises a material selected from the group consisting of: a glass-filled elastomer, a stainless steel-filled elastomer, a tungsten-filled elastomer, a thermoplastic polyurethane (TPU), a thermoplastic elastomer (TPE), a aramid fiber-reinforced polymer, and a carbon-fiber reinforced polymer.

6. The golf club head of claim 1, wherein:

the first density is between 2.6 and 8.7 g/cc; and the second density is between 7.7 and 8.1 g/cc.

7. The golf club head of claim 6, wherein the first material comprises a material selected from the group consisting of: a steel-based material, a titanium-based material, an aluminum alloy, and a titanium alloy; and the second material comprises a material selected from the group consisting of: a steel-based material and a steel alloy.

8. The golf club head of claim 1, further comprising:

a total mass;

a toe weight;

wherein:

the body further comprises: a toe cavity;

the toe cavity receives the toe weight; and the toe weight comprises a mass between 5% and 45% of the total mass of the club head.

9. The golf club head of claim 1, wherein:

the golf club head further comprises a centerplane, perpendicular to the loft plane, and coincident with a centerpoint of the striking surface;

the upper portion comprises a height measured along the centerplane from the top rail to the inflection seam, in a direction parallel to the loft plane;

the lower portion comprises a height measured along the centerplane from the sole to the inflection seam, in a direction parallel to the loft plane;

the height of the upper portion and the height of the lower portion have a ratio of between 9:8 and 6:11;

the upper portion comprises a first depth and the lower portion comprises a second depth, wherein the depths are measured perpendicular to the loft plane from the striking surface to an outer surface of the rear, along the centerplane; and a ratio of the first depth to a maximum of the second depth is between 1:3 and 4:5.

10. The golf club head of claim 1, further comprising:

a center of gravity; and a centerplane, perpendicular to the loft plane, and coincident with a centerpoint of the striking surface;

a lead edge axis, parallel to the ground plane, extending in a heel-to-toe direction, and coincident with a point on the centerplane that is lowest on the striking surface;

a lead edge plane, parallel to the ground plane and coincident with the lead edge axis;

a y-axis, orthogonal to the ground plane, and coincident with the center of gravity; and wherein the center of gravity of the golf club head is located between 0.380 inch and 0.670 inch above the lead edge plane.

11. The golf club head of claim 1, further comprising:

a heel and a toe;

a cylindrical hosel integral to the body;

a hosel reference plane, parallel to a front edge of the cylindrical hosel, when viewed from a toe side view;

a hosel axis, defined as the central axis of the cylindrical hosel;

a lead edge axis, parallel to the ground plane, extending in a heel-to-toe direction, and coincident with a point on the centerplane that is lowest on the striking surface;

a hosel-X distance, measured from the intersection of the lead edge axis with the centerplane to the intersection of the lead edge axis with the hosel axis, when viewed from a front view, wherein the hosel-X distance is less than 1.5 inches; and an offset distance, measured as the minimum distance between the lead edge axis and the hosel reference plane; wherein the offset distance between 0.05 inch and 0.27 inch.

12. The golf club head of claim 1, further comprising:

a heel and a toe; and a blade length, measured in a heel-to-toe direction from an edge of the striking surface in the heel to an outermost point on the toe; wherein the blade length is less than 2.8 inches.

13. The golf club head of claim 1, wherein:

the body further comprises an indentation;

the indentation abuts a periphery of the cavity;

an area of a rear surface of the faceplate contacts the insert;

a remaining area of the rear surface of the faceplate contacts the indentation.

14. A method of forming a golf club head comprising the following steps:

(1) providing a faceplate comprising a first material of a first density;

(2) providing a body, comprising a second material of a second density, an upper portion, a lower portion, a sole, a rear, and a top rail; wherein:

the faceplate and a portion of the body define a striking surface of the golf club head;

the faceplate, the sole, the rear, and the top rail enclose a cavity;

the rear comprises an inflection seam;

the sole rests on a ground plane;

a loft plane is tangential to the faceplate and intersects the ground plane;

the upper portion is bounded by the top rail and the inflection seam;

the lower portion is bounded by the sole and the inflection seam;

the upper portion defines a rear opening that connects to the cavity;

the rear opening covers a projected area between 25% and 50% of a total projected area of the rear, wherein the projected areas are measured parallel to the loft plane;

the cavity comprises a volume;

the cavity volume is between 17% and 32% of the total club head volume;

the cavity volume in the lower portion is greater than the cavity volume in the upper portion;

(3) securing the faceplate to the body, wherein the faceplate further defines and encloses the cavity; and (4) injecting an insert material, through the rear opening, into the cavity to form the insert; whereafter the insert complements 90% or more of the cavity, and wherein:

the insert material comprises a third material of a third density;

the third density is less than the first and second densities, and the third density is between 2.4 and 3.0 g/c.

15. The method of forming a golf club head of claim 14, further comprising:

providing a badge; and securing the badge over the rear opening.

16. The method of forming a golf club head of claim 14, wherein securing the faceplate to the body in step (3) comprises a process selected from the group consisting of: welding the faceplate onto the body and swedging the faceplate onto the body.

17. The method of forming a golf club head of claim 15, wherein:

the golf club head further comprises:

a heel and a toe;

an x-axis, extending in a heel-to-toe direction, parallel to the striking surface, and coincident with a center of gravity of the club head;

a y-axis, orthogonal to the ground plane and coincident with the center of gravity;

wherein:

a moment of inertia, Ixx, measured about the x-axis ranges between 78 gram square inches and 120 gram square inches; and a moment of inertia, Iyy, measured about the y-axis ranges between 310 gram square inches and 466 gram square inches.

18. The method of forming a golf club head of claim 14, wherein:

the method further comprises forming a cylindrical hosel integral to the body;

the golf club head further comprises:

a heel and a toe;

a hosel reference plane, parallel to a front edge of the cylindrical hosel, when viewed from a toe side view;

a hosel axis, defined as the central axis of the cylindrical hosel;

a lead edge axis, parallel to the ground plane, extending in a heel-to-toe direction, and coincident with a point on the centerplane that is lowest on the striking surface;

a hosel-X distance, measured from the intersection of the lead edge axis with the centerplane to the intersection of the lead edge axis with the hosel axis, when viewed from a front view, wherein the hosel-X distance is less than 1.5 inches; and an offset distance, measured as the minimum distance between the lead edge axis and the hosel reference plane; wherein the offset distance between 0.05 inch and 0.27 inch.

19. The method of forming a golf club head of claim 14, wherein:

the golf club head further comprises a centerplane, perpendicular to the loft plane, and coincident with a centerpoint of the striking surface;

the upper portion comprises a height measured along the centerplane from the top rail to the inflection seam, in a direction parallel to the loft plane;

the lower portion comprises a height measured along the centerplane from the sole to the inflection seam, in a direction parallel to the loft plane;

the height of the upper portion and the height of the lower portion have a ratio of between 9:8 and 6:11;

the upper portion comprises a first depth and the lower portion comprises a second depth, wherein the depths are measured perpendicular to the loft plane from the striking surface to an outer surface of the rear, along the centerplane; and a ratio of the first depth to a maximum of the second depth is between 1:3 and 4:5.

20. The method of forming a golf club head of claim 14, wherein:

the golf club head comprises a total mass;

the body further comprises a toe cavity; and the method further comprising:

forming a toe weight, the toe weight comprising a mass between 5% and 45% of the total mass of the golf club head; and securing the toe weight within the toe cavity.

* * * * *